US011713206B2

(12) United States Patent
Yanagisawa et al.

(10) Patent No.: US 11,713,206 B2
(45) Date of Patent: Aug. 1, 2023

(54) MEDIUM LOADING DEVICE AND IMAGE FORMING SYSTEM

(71) Applicant: SEIKO EPSON CORPORATION, Tokyo (JP)

(72) Inventors: Hirofumi Yanagisawa, Shiojiri (JP); Kazuyoshi Ohashi, Matsumoto (JP); Shun Hara, Matsumoto (JP); Kenji Uchibori, Shiojiri (JP); Kei Sadakuni, Kiyosu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/652,955

(22) Filed: Mar. 1, 2022

(65) Prior Publication Data

US 2022/0281702 A1 Sep. 8, 2022

(30) Foreign Application Priority Data

Mar. 4, 2021 (JP) ..... 2021-034601

(51) Int. Cl.
*B65H 31/34* (2006.01)
*B65H 31/38* (2006.01)

(52) U.S. Cl.
CPC ..... *B65H 31/34* (2013.01); *B65H 31/38* (2013.01); *B65H 2511/11* (2013.01); *B65H 2511/524* (2013.01); *B65H 2515/10* (2013.01); *B65H 2515/12* (2013.01); *B65H 2515/40* (2013.01); *B65H 2515/805* (2013.01); *B65H 2801/06* (2013.01); *B65H 2801/27* (2013.01)

(58) Field of Classification Search
CPC ..... B65H 31/34; B65H 33/08; B65H 31/38; B65H 31/36; B65H 2301/4222; B65H 2511/11; B65H 2511/524; G03G 15/6547; G03G 2215/0089
See application file for complete search history.

(56) References Cited

U.S. PATENT DOCUMENTS 9,809,408 B2 * 11/2017 Maenishi ..... B65H 31/20

FOREIGN PATENT DOCUMENTS

JP 2020-090376 A 6/2020

* cited by examiner

*Primary Examiner* — Jeremy R Severson
(74) *Attorney, Agent, or Firm* — Workman Nydegger

(57) ABSTRACT

A medium loading device includes a side end aligning member which is positioned at a standby position when a medium is ejected; and a control section. When a value based on first information relating to recording density of a medium to be ejected this time and at least one medium among the media ejected previously is equal to or greater than a threshold value, the control section specifies a first position, which overlaps the medium to be ejected this time, as the standby position, and when the value based on the first information is less than the threshold value, the control section specifies a second position, which does not overlap the medium to be ejected this time, as the standby position, and the control section adjusts the threshold value based on second information relating to at least one medium among the media recorded before the ejection at this time.

13 Claims, 16 Drawing Sheets

MEDIUM LOADING DEVICE AND IMAGE FORMING SYSTEM

The present application is based on, and claims priority from JP Application Serial Number 2021-034601, filed Mar. 4, 2021, the disclosure of which is hereby incorporated by reference herein in its entirety.

BACKGROUND

1. Technical Field

The present disclosure relates to a medium loading device for loading a printed medium and an image forming system including the medium loading device.

2. Related Art

A sheet loading device described in JP-A-2020-090376 includes an ejecting unit that ejects a sheet on which an image is formed; a first loading section on which the ejected sheet is loaded; and an aligning member which is provided under the ejecting unit and can move in a width direction orthogonal to a sheet transport direction by the ejecting unit. The aligning member abuts against a side end of the ejected sheet in the width direction to align the sheets. The sheet is an example of a medium, the ejecting unit is an example of an ejecting section, the first loading section is an example of a processing tray, and the aligning member is an example of a side end aligning member.

Immediately after the image is formed by an ink jet method, the medium becomes wet with ink. As the medium becomes wet, the slidability of the medium decreases. More specifically, as the amount of ink used to form the image on a medium surface increases, the water content on the medium surface increases. Therefore, as the image ratio of the medium increases, the slidability of the medium decreases. Therefore, when the image ratio of the medium is high, the ejected medium may buckle caused by the sliding resistance of the medium, which is already loaded, with the medium surface, and there is a case where the medium is not be ejected normally. The image ratio is an example of the recording density.

In the medium loading device described in JP-A-2020-090376, when the recording density of the medium is equal to or greater than a threshold value, and when the ejecting section ejects the medium, the side end aligning member moves inward from the side end of the medium ejected by the ejecting section. Then, after the medium is ejected by the ejecting section, the side end aligning member moves outward from the side end of the medium ejected by the ejecting section, and then abuts against the side end of the ejected medium to align the medium. In other words, when the recording density of the medium is equal to or greater than the threshold value, a longer processing time for alignment is required as compared with a case where the recording density of the medium is less than the threshold value, and thus, the productivity of the medium loading device decreases.

Even when the recording density is the same, the slidability of the medium when the medium is ejected from the ejecting section is not necessarily the same. For example, when the tip end of the medium ejected from the ejecting section is curled downward, the angle at which the medium surface at the tip end of the medium hits the medium surface which is already loaded becomes an obtuse angle, and thus, the slidability of the medium decreases. In addition, the water content of the medium surface changes depending on the time from the formation of the image on the medium to the ejection of the medium and the environmental conditions. In other words, even when the recording density is the same, the slidability of the medium when the medium is ejected from the ejecting section changes due to other factors. Therefore, when the slidability of the medium is lower than expected from the recording density of the medium, and when the side end aligning member is not moved inward from the side end of the medium ejected by the ejecting section, there is a concern that buckling of the medium occurs. In addition, when the side end aligning member is moved inward from the side end of the medium ejected by the ejecting section even though the slidability of the medium is not as low as expected from the recording density due to other factors, there is a concern that the productivity of the medium loading device decreases.

SUMMARY

According to an aspect of the present disclosure, there is provided a medium loading device including: an ejecting section that performs recording by discharging a liquid, and repeats ejection of a medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

According to another aspect of the present disclosure, there is provided a medium loading device including: an ejecting section that performs recording by discharging a liquid, and repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section determines a control parameter for controlling at least one of a position of the first position in the width direction and a time during which the side end aligning member stands by at the first position, based on second information relating to at least one of the media recorded before the ejection at this time, and controls the side end aligning member with the control parameter determined based on the second information.

According to still another aspect of the present disclosure, there is provided an image forming system including: a recording section that performs recording by discharging a liquid on a medium; an ejecting section that repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

According to still another aspect of the present disclosure, there is provided an image forming system including: a recording section that performs recording by discharging a liquid on a medium; an ejecting section that repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section determines a control parameter for controlling at least one of a position of the first position in the width direction and a time during which the side end aligning member stands by at the first position, based on second information relating to at least one of the media recorded before the ejection at this time, and controls the side end aligning member with the control parameter determined based on the second information.

DESCRIPTION OF EXEMPLARY EMBODIMENTS

Figure 1:
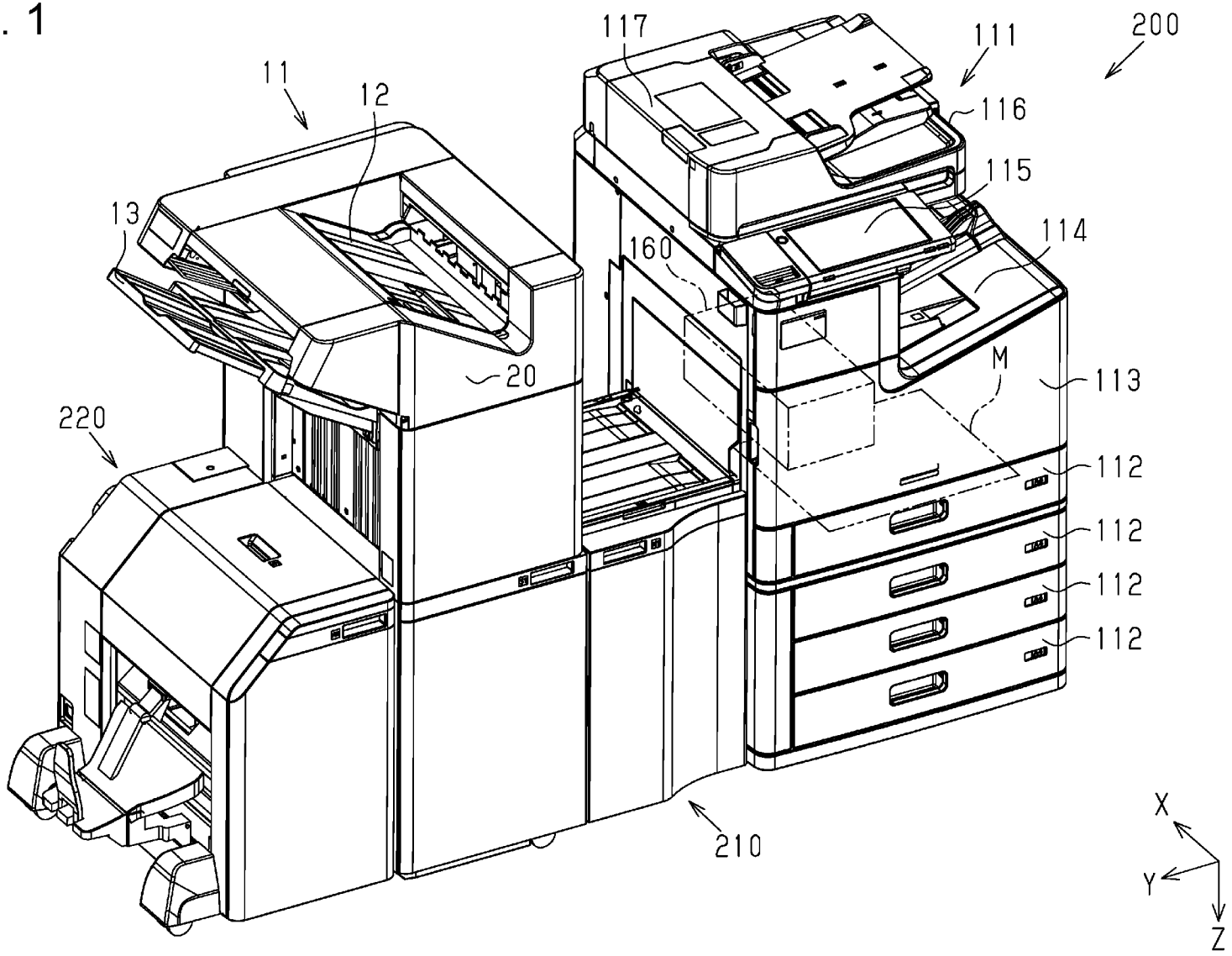
FIG. 1 is a perspective view illustrating a medium loading device and an image forming system.

Hereinafter, a medium loading device according to a first embodiment and a second embodiment and an image forming system including the medium loading device will be described with reference to the drawings. The image forming system, for example, discharges ink, which is an example of a liquid, onto a medium such as a paper sheet, performs an image forming process for recording characters or images on the medium, loads the recorded medium, and performs predetermined post-processing and the like.

In the drawings, a direction of gravity is illustrated by a Z axis, and a direction along a horizontal plane is illustrated by an X axis and a Y axis, assuming that the medium loading device and the image forming system including the medium loading device are placed on the horizontal plane. The X axis, the Y axis, and the Z axis are orthogonal to each other. In the following description, a direction along the X axis is also referred to as a width direction X, a direction along the Y axis is also referred to as a depth direction Y, and a direction along the Z axis is also referred to as a gravity direction Z.

A direction of the length of the medium in a transport direction is referred to as a length direction Y1. A direction of the length of the medium in a direction orthogonal to the transport direction is the same as the width direction X in the image forming system. Therefore, the direction of the length of the medium in the direction orthogonal to the transport direction is also referred to as the width direction X. In addition, the length of the medium in the direction orthogonal to the transport direction is referred to as a medium width A, and the length of the medium in the transport direction is referred to as a medium length B.

First Embodiment

Overview of Image Forming System

As illustrated in FIG. 1, an image forming system 200 includes a recording device 111 that performs recording on a medium M, and a medium loading device 11 that loads the media M in the unit of number of copies and ejects the media M as a medium bundle. The recording device 111 performs recording on the medium M by a recording section 160 that performs recording by discharging the liquid. The recording device 111 is, for example, an ink jet type printer that discharges ink onto the medium M and prints characters or images. In the medium loading device 11, after the media M recorded by the recording device 111 are loaded into a medium bundle, post-processing such as staple processing for binding the medium bundle may be performed.

The image forming system 200 may include a transport device 210 that transports the medium M recorded by the recording device 111 and ejected from the recording device 111 to the medium loading device 11. In other words, the recording device 111 and the medium loading device 11 may be directly coupled to each other, or the recording device 111 and the medium loading device 11 may be coupled to each other via the transport device 210.

The image forming system 200 may include one or a plurality of processing devices different from the medium loading device 11. For example, the medium M transported to the medium loading device 11 or a folding device 220 that folds the medium bundle loaded by the medium loading device 11 may be coupled to the medium loading device 11.

The recording device 111 includes one or a plurality of medium accommodation sections 112 capable of accommodating the medium M, and a main body portion 113 having the recording section 160 for performing the recording on the medium M. Further, the recording device 111 may include a first ejection tray 114 from which the medium M is ejected, and an operation section 115 such as a touch panel for operating the recording device 111. In addition, the recording device 111 may include an image reading section 116 that reads an image of a document, and an automatic feeding section 117 that sends the document to the image reading section 116.

The medium loading device 11 includes a second ejection tray 12 from which the medium M is ejected, and a stacker tray 13 capable of loading a large amount of media M. In the first ejection tray 114 of the recording device 111, the medium M is ejected in a state where the recorded surface faces downward. In the second ejection tray 12 of the medium loading device 11, the medium M is ejected in a state where the recorded surface faces upward.

Configuration of Medium Loading Device and Flow of Medium Loading Processing

Figure 2:
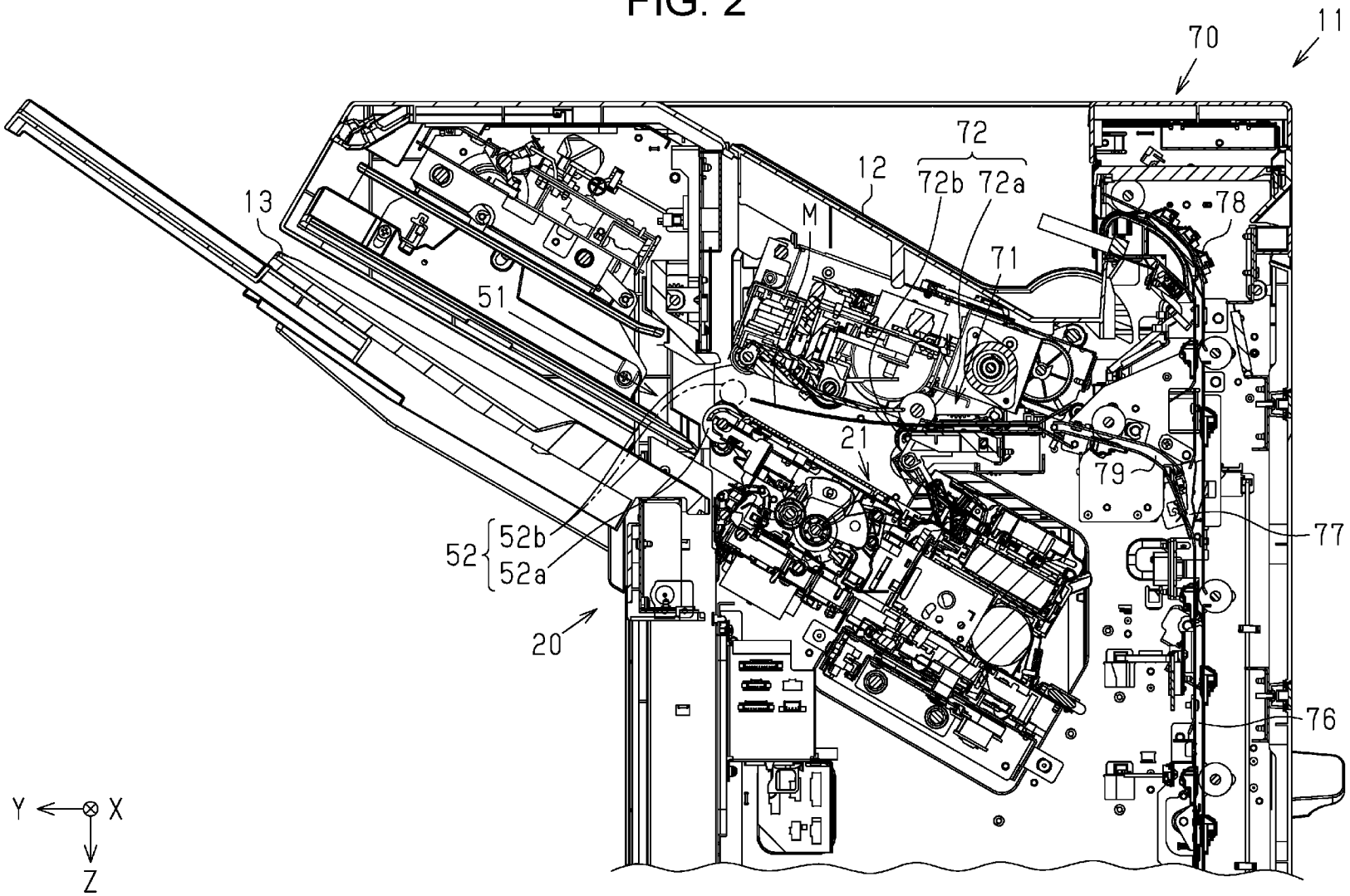
FIG. 2 is a side sectional view illustrating a loading section of the medium loading device.

As illustrated in FIG. 2, the medium loading device 11 includes a transport section 70 that transports the medium M, and a loading section 20 that loads the medium M in the unit of number of copies and ejects the media M as a medium bundle. The transport section 70 includes a transport-in path 76 for transporting in the medium M from the recording device 111, a first transport path 78, a second transport path 79, and a branch section 77 that branches the transport-in path 76 into the first transport path 78 and the second transport path 79. The loading section 20 includes a processing tray 21 for performing shift processing or the like by loading the medium M and moving the ejection position of the medium M in the width direction X in the unit of number of copies, and a bundle ejecting section 51 that ejects the medium M loaded on the processing tray 21 as a medium bundle to the stacker tray 13.

The medium M is transported in from a transport-in section (not illustrated) included in the medium loading device 11, and is transported upward by the transport-in path 76. The branch section 77 is configured to be able to switch whether the medium M transported through the transport-in path 76 is transported toward the first transport path 78 or transported toward the second transport path 79. When the medium M is transported toward the first transport path 78 by the branch section 77, the medium M is transported through the first transport path 78, and then ejected to the second ejection tray 12 positioned above the medium loading device 11. When the medium M is transported toward the second transport path 79 by the branch section 77, the medium M is transported to the loading section 20 through the second transport path 79, and then ejected to the processing tray 21 positioned in the medium loading device 11.

The transport section 70 includes an ejecting section 71 that ejects the medium M transported through the second transport path 79 to the processing tray 21. The ejecting section 71 is configured as an ejecting roller pair 72 including an ejecting driving roller 72*a* that is rotationally driven by a transport motor (not illustrated) and an ejecting driven roller 72*b* that is driven to rotate by nipping the ejecting driving roller 72*a*. The ejecting section 71 repeats the ejection of the medium M recorded by the recording section 160 illustrated in FIG. 1, which performs recording by discharging the liquid. The processing tray 21 loads the media M in the order of being ejected by the ejecting section 71.

In the medium M, the end portion first ejected from the ejecting section 71 is referred to as a tip end, and the end portion finally ejected from the ejecting section 71 is referred to as a rear end. In other words, the end portions of the medium M in the length direction Y1 are the tip end and the rear end. Further, the end portion of the medium M in the width direction X is referred to as a side end.

When the medium M is ejected by the ejecting section 71, the medium ejecting operation is performed in the processing tray 21, and when the rear end of the medium M is ejected from the ejecting section 71, the medium aligning operation is performed in the processing tray 21. In the medium aligning operation, first, a rear end aligning operation for aligning the rear ends of the media M is performed, and then a side end aligning operation for aligning the side ends of the media M is performed. Details of the medium ejecting operation, the rear end aligning operation, and the side end aligning operation will be described later.

The medium M is loaded on the processing tray 21 each time the medium M is ejected, and the medium M is aligned on the processing tray 21 each time the medium M is loaded. Therefore, an aligned medium bundle is formed on the processing tray 21. Then, the position of the medium bundle in the width direction X when being ejected to the stacker tray 13 is shifted in the width direction X with respect to the medium bundle ejected to the stacker tray 13 immediately before the medium bundle. In this manner, the shift processing is performed in the processing tray 21. Details of the shift processing will be described later.

The bundle ejecting section 51 is configured as a bundle ejecting roller pair 52 including a bundle ejecting driving roller 52*a* that is rotationally driven by a bundle ejecting motor (not illustrated) and a bundle ejecting driven roller 52*b* that is driven to rotate by nipping the bundle ejecting driving roller 52*a*. The bundle ejecting driving roller 52*a* is positioned at the end portion on the stacker tray 13 side on the processing tray 21. The bundle ejecting driven roller 52*b* is configured to be capable of switching the position between a nip position (illustrated by the two-dot chain line in FIG. 2) that nips the bundle ejecting driving roller 52*a* and a separated position (illustrated by the solid line in FIG. 2) that is positioned above the bundle ejecting driving roller 52*a* away from the bundle ejecting driving roller 52*a*.

When the ejecting section 71 ejects the medium M to the processing tray 21, the bundle ejecting driven roller 52*b* is positioned at a separated position illustrated by the solid line in FIG. 2. By positioning the bundle ejecting driven roller 52*b* away from the bundle ejecting driving roller 52*a*, a space is formed between the bundle ejecting driven roller 52*b* and the bundle ejecting driving roller 52*a*. Accordingly, the medium M can be ejected to the processing tray 21 without coming into contact with the bundle ejecting driven roller 52*b*. Then, the medium M can be aligned on the processing tray 21 by the medium aligning operation.

When the medium bundle aligned by the medium aligning operation is formed on the processing tray 21 and the medium bundle is ejected to the stacker tray 13, the bundle ejecting driven roller 52*b* descends from the separated position illustrated by the solid line in FIG. 2, and is positioned at the nip position illustrated by the two-dot chain line in FIG. 2. Then, the bundle ejecting driving roller 52*a* is rotationally driven by a bundle ejecting motor (not illustrated), and accordingly, the medium bundle is ejected from the processing tray 21 to the stacker tray 13.

Regarding Medium Ejecting Operation

Figure 3:
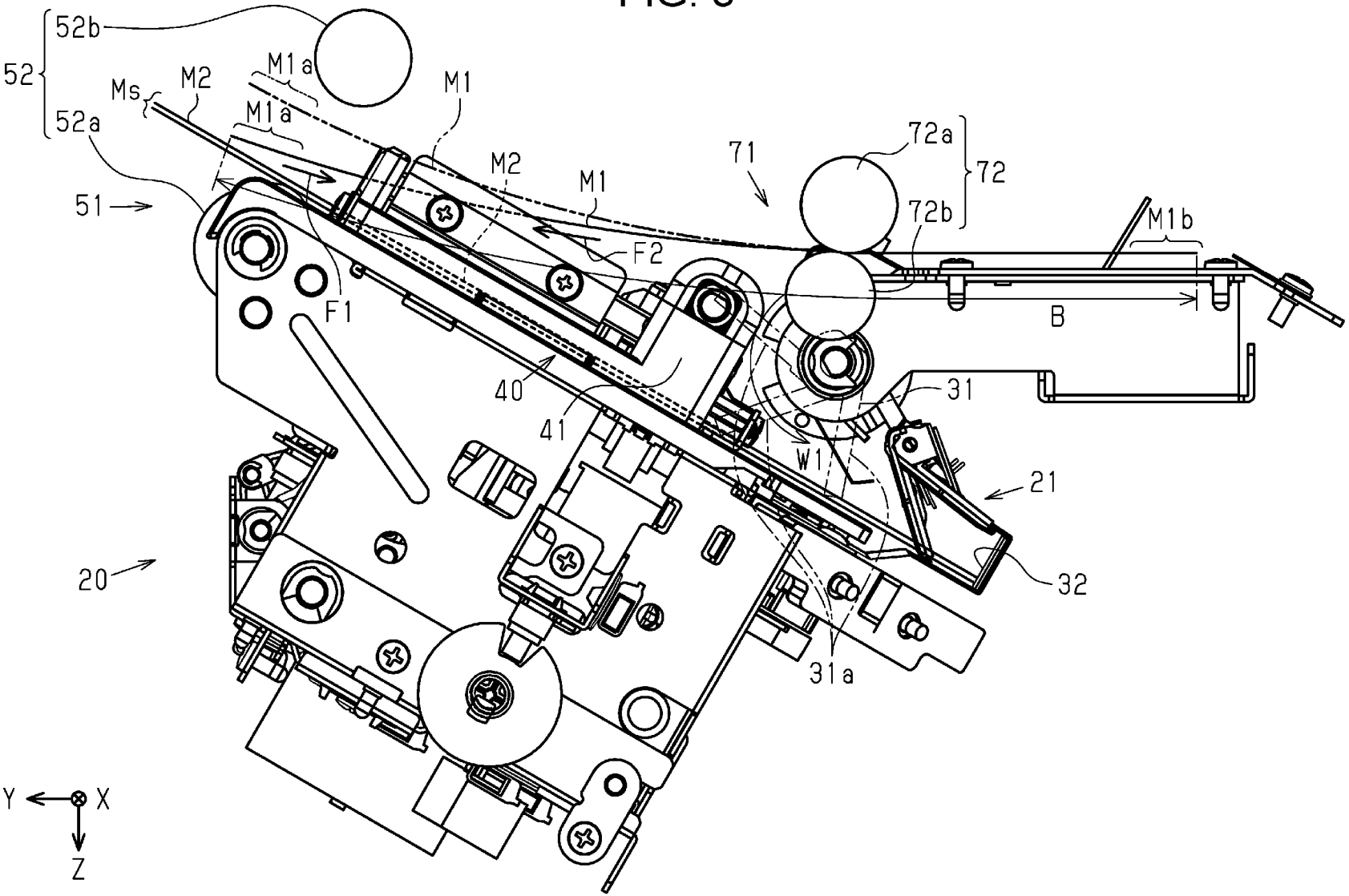
FIG. 3 is a schematic side view illustrating a state of the medium when the medium is ejected.

As illustrated in FIG. 3, the ejecting section 71 ejects a medium M1 to be ejected this time to the processing tray 21. When the medium M is not loaded on the processing tray 21, the medium M1 to be ejected this time is directly ejected onto the processing tray 21. In other words, when the medium M1 to be ejected this time is the first medium M in the unit of number of copies, the ejecting section 71 ejects the medium M1 to be ejected this time directly onto the processing tray 21. When the medium M is loaded on the processing tray 21, the medium M1 to be ejected this time is ejected onto a medium Ms loaded on the processing tray 21. In other words, when the medium M1 to be ejected this time is not the first medium M in the unit of number of copies, the ejecting section 71 ejects the medium M1 to be ejected this time on a medium M2 ejected previously.

When the ejecting section 71 ejects the medium M1 to be ejected this time, the medium M1 to be ejected this time is ejected from a tip end part M1*a* of the medium M1 to be ejected this time to the processing tray 21. When the tip end part M1*a* of the medium M1 to be ejected this time is ejected from the ejecting section 71, the lower surface of the tip end part M1*a* comes into contact with the upper surface of the medium M2 ejected previously. Then, as the tip end part M1*a* is ejected, the medium M1 to be ejected this time is ejected while the lower surface of the tip end part M1*a* rubs the upper surface of the medium M2 ejected previously. In addition, depending on conditions such as the medium length B of the medium M1 to be ejected this time, the curling direction of the tip end part M1*a*, and the number of media Ms loaded on the processing tray 21, there is a case where the lower surface of the tip end part M1*a* of the medium M1 to be ejected this time does not come into contact with the upper surface of the medium M2 ejected previously.

When the lower surface of the medium M1 to be ejected this time and the upper surface of the medium M2 ejected previously come into contact with each other, a frictional force F1 is generated between the lower surface of the medium M1 to be ejected this time and the upper surface of the medium M2 ejected previously. In the following description, the "frictional force F1 between the lower surface of the medium M1 to be ejected this time and the upper surface of the medium M2 ejected previously" is simply referred to as "frictional force F1". When the frictional force F1 is large, and when the medium M1 to be ejected this time is ejected, there is a concern that the medium M1 to be ejected this time buckles. In addition, a drag force F2 that resists against buckling is generated in the medium M1 to be ejected this time according to the bending strength of the medium M1 to be ejected this time. In the following description, the "drag force F2 that resists against occurring buckling in the medium M1 to be ejected this time" is simply referred to as "drag force F2". When the drag force F2 is greater than the frictional force F1, the medium M1 to be ejected this time is unlikely to buckle. More specifically, when F1>F2, the medium M1 to be ejected this time is likely to buckle, and when F1<F2, the medium M1 to be ejected this time is unlikely to buckle. In other words, the ease of buckling of the medium M1 to be ejected this time is caused by the frictional force F1 and the drag force F2.

Figure 4:
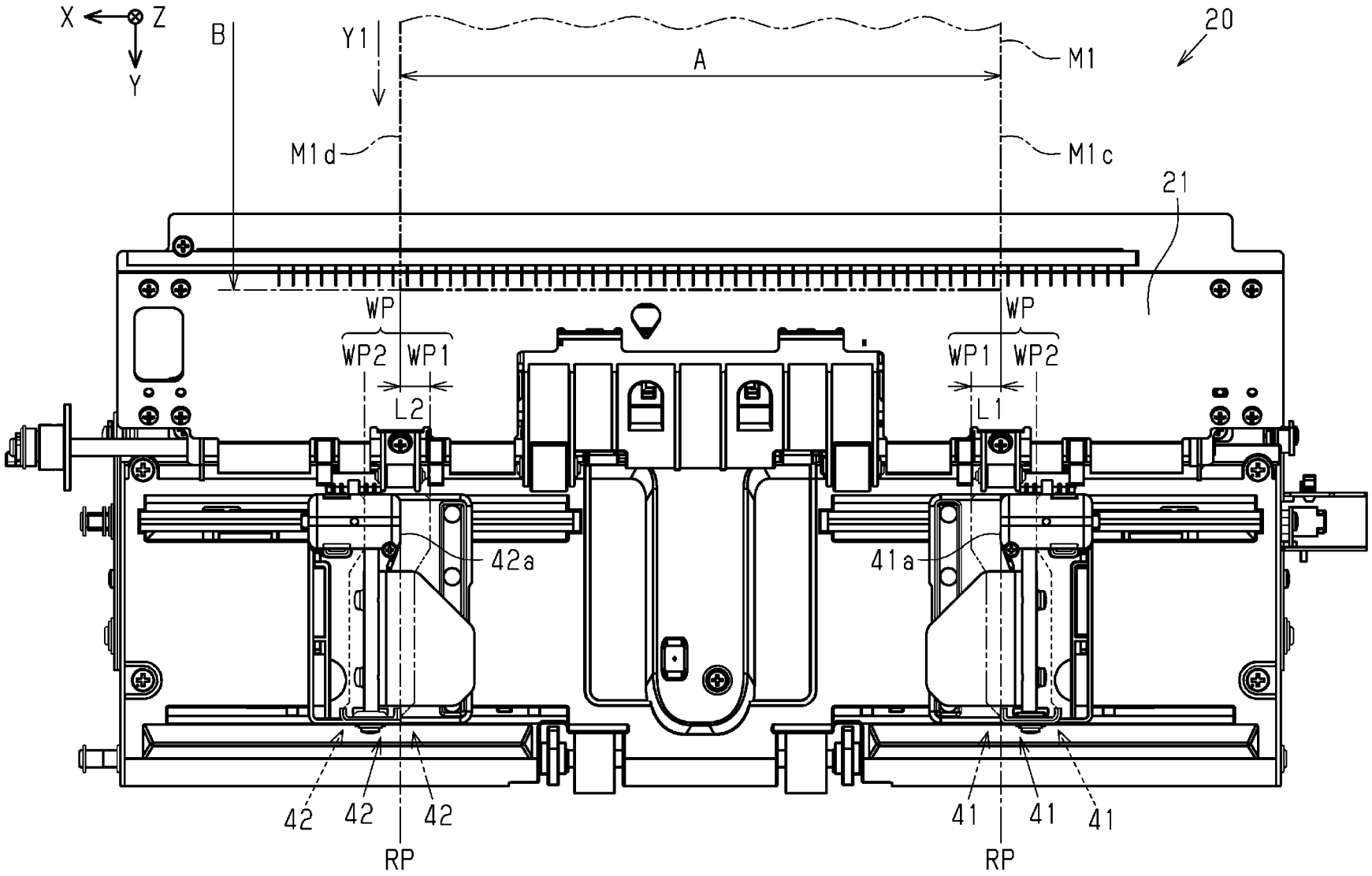
FIG. 4 is a plan view illustrating a positional relationship of a first side end guide member, a second side end guide member, and a medium.

As illustrated in FIG. 4, the loading section 20 includes a first side end guide member 41 that is disposed below one side in the width direction X of the medium M1 to be ejected this time and moves in the width direction X. The side ends of the medium M1 to be ejected this time are a first side end M1*c* and a second side end M1*d*. The one side is the first side end M1*c* side, and is the −X direction side in the width direction X. In addition, the other side is the second side end M1*d* side, and is the +X direction side in the width direction X.

The first side end guide member 41 is positioned at a standby position WP of either a first position WP1 or a second position WP2 when the medium M1 to be ejected this time is ejected. The first position WP1 is a position that overlaps the medium M1 to be ejected this time in the width direction X, and the second position WP2 is a position that does not overlap the medium M1 to be ejected this time in the width direction X.

The first side end guide member 41 has an aligning surface 41*a* that abuts against the first side end M1*c* of the medium M1 to be ejected this time and aligns the medium M1 to be ejected this time. The aligning surface 41*a* is a surface orthogonal to the width direction X. The position of the first side end guide member 41 is referred to as a reference position RP when the aligning surface 41*a* and the assumed first side end M1*c* of the medium M1 to be ejected this time when the medium M1 to be ejected this time is ejected from the ejecting section 71, overlap each other in the width direction X. When the first side end guide member 41 is positioned on the +X direction side of the reference position RP, the first side end guide member 41 is assumed to overlap the medium M1 to be ejected this time in the width direction X, and thus, the first side end guide member 41 is positioned at the first position WP1. In addition, when the first side end guide member 41 is positioned on the −X direction side of the reference position RP, the first side end guide member 41 is assumed not to overlap the medium M1 to be ejected this time in the width direction X, and thus, the first side end guide member 41 is positioned at the second position WP2. In addition, there is a case where "assumed to overlap" is described as "overlap", and "assumed not to overlap" is described as "does not overlap".

When the standby position WP of the first side end guide member 41 is the second position WP2, the first side end guide member 41 does not overlap the medium M1 to be ejected this time in the width direction X. Therefore, as soon as the medium M1 to be ejected this time starts to be ejected, at least on the first side end M1*c* side, the lower surface of the tip end part M1*a* of the medium M1 (illustrated by the solid line in FIG. 3) to be ejected this time comes into contact with the upper surface of the medium M2 ejected previously.

When the standby position WP of the first side end guide member 41 is the first position WP1, the first side end guide member 41 overlaps the medium M1 to be ejected this time in the width direction X. Therefore, for a while after the medium M1 to be ejected this time starts to be ejected, on the first side end M1*c* side, the lower surface of the tip end part M1*a* of the medium M1 (illustrated by the two-dot chain line in FIG. 3) to be ejected this time does not come into contact with the upper surface of the medium M2 ejected previously. In other words, on the first side end M1*c* side, the first side end guide member 41 suppresses the contact between the tip end part M1*a* of the medium M1 to be ejected this time and the medium M2 ejected previously. Therefore, the timing at which the lower surface of the tip end part M1*a* of the medium M1 to be ejected this time comes into contact with the upper surface of the medium M2 ejected previously can be delayed. Then, even after the lower surface of the tip end part M1*a* of the medium M1 to be ejected this time comes into contact with the upper surface of the medium M2 ejected previously, the first side end guide member 41 can continuously suppress the contact between the medium M1 to be ejected this time and the medium M2 ejected previously.

When the first side end guide member 41 is positioned at the first position WP1, the aligning surface 41*a* of the first side end guide member 41 may overlap the medium M1 to be ejected this time in the width direction X, and a part that moves in the width direction X together with the first side end guide member 41 may overlap the medium M1. In other words, on the first side end M1*c* side, the member that moves together with the first side end guide member 41 may suppress the contact between the tip end part M1*a* of the medium M1 to be ejected this time and the medium M2 ejected previously.

The loading section 20 includes a second side end guide member 42 that is disposed below the other side in the width direction X of the medium M1 to be ejected this time and moves in the width direction X. In addition, the other side is the second side end M1*d* side, and is the +X direction side in the width direction X. In the present embodiment, the second side end guide member 42 is configured to have a symmetrical shape with the first side end guide member 41 in the width direction X.

The second side end guide member 42 is positioned at a standby position WP of either a first position WP1 or a second position WP2 when the medium M1 to be ejected this time is ejected. The first position WP1 is a position that overlaps the medium M1 to be ejected this time in the width direction X, and the second position WP2 is a position that does not overlap the medium M1 to be ejected this time in the width direction X.

The second side end guide member 42 has an aligning surface 42*a* that abuts against the second side end M1*d* of the medium M1 to be ejected this time and aligns the medium M1 to be ejected this time. The aligning surface 41*a* is a surface orthogonal to the width direction X. The position of the second side end guide member 42 is referred to as the reference position RP when the aligning surface 42*a* and the assumed second side end M1*d* of the medium M1 to be ejected this time when the medium M1 to be ejected this time is ejected from the ejecting section 71, overlap each other in the width direction X. When the second side end guide member 42 is positioned on the −X direction side of the reference position RP, the second side end guide member 42 is assumed to overlap the medium M1 to be ejected this time in the width direction X, and thus, the second side end guide member 42 is positioned at the first position WP1. In addition, when the second side end guide member 42 is positioned on the +X direction side of the reference position RP, the second side end guide member 42 is assumed not to overlap the medium M1 to be ejected this time in the width direction X, and thus, the second side end guide member 42 is positioned at the second position WP2.

When the standby position WP of the second side end guide member 42 is the second position WP2, as soon as the medium M1 to be ejected this time starts to be ejected, at least on the second side end M1*d* side, the lower surface of the tip end part M1*a* of the medium M1 (illustrated by the solid line in FIG. 3) to be ejected this time comes into contact with the upper surface of the medium M2 ejected previously.

When the standby position WP of the second side end guide member 42 is the first position WP1, for a while after the medium M1 to be ejected this time starts to be ejected, on the second side end M1*d* side, the lower surface of the tip end part M1*a* of the medium M1 to be ejected this time does not come into contact with the upper surface of the medium M2 ejected previously. In other words, on the second side end M1*d* side, the second side end guide member 42 suppresses the contact between the tip end part M1*a* (illustrated by the two-dot chain line in FIG. 3) of the medium M1 to be ejected this time and the medium M2 ejected previously. Therefore, the timing at which the lower surface of the tip end part M1*a* of the medium M1 to be ejected this time comes into contact with the upper surface of the medium M2 ejected previously can be delayed. Then, even after the lower surface of the tip end part M1*a* of the medium M1 to be ejected this time comes into contact with the upper surface of the medium M2 ejected previously, the second side end guide member 42 can continuously suppress the contact between the medium M1 to be ejected this time and the medium M2 ejected previously.

When the second side end guide member 42 is positioned at the first position WP1, the aligning surface 42*a* of the second side end guide member 42 may overlap the medium M1 to be ejected this time in the width direction X, and a part that moves in the width direction X together with the second side end guide member 42 may overlap the medium M1. In other words, on the second side end M1*d* side, the member that moves together with the second side end guide member 42 may suppress the contact between the tip end part M1*a* of the medium M1 to be ejected this time and the medium M2 ejected previously.

Regarding Rear End Aligning Operation

As illustrated in FIG. 3, the loading section 20 includes a rear end aligning member 31 that is disposed below the ejecting section 71 and above the processing tray 21, and rotates in an aligning direction W1, and a rear end reference surface 32, which is a reference surface on the rear end side when aligning the rear end of the medium M1 to be ejected this time. The rear end aligning member 31 is made of a rubber material or the like having a large friction coefficient, and has a plurality of blade-shaped parts 31*a* on the outer periphery.

When the ejecting section 71 ejects the medium M1 to be ejected this time, a rear end part M1*b* of the medium M1 to be ejected this time is finally ejected to the processing tray 21. When the rear end part M1*b* of the medium M1 to be ejected this time is ejected, the three blade-shaped parts 31*a* of the rear end aligning member 31 that rotates in the aligning direction W1 come into contact with the upper surface of the rear end part M1*b* of the medium M1 to be ejected this time in order, and draws the medium M1 to be ejected this time toward the rear end reference surface 32. Then, the rear end of the medium M1 to be ejected this time abuts against the rear end reference surface 32.

Since the friction coefficient of the blade-shaped part 31*a* is large, the rear end aligning member 31 can easily draw the medium M1 to be ejected this time to the rear end reference surface 32 side. Further, the blade-shaped part 31*a* intermittently comes into contact with the upper surface of the medium M1 to be ejected this time. In other words, the blade-shaped part 31*a* intermittently draws the medium M1 to be ejected this time. Therefore, it is possible to suppress drawing of the medium M1 to be ejected this time to the rear end reference surface 32 as compared with a state where the rear end of the medium M1 to be ejected this time abuts against the rear end reference surface 32. As a result, it is possible to maintain a state where the rear end of the medium M1 to be ejected this time abuts against the rear end reference surface 32. In addition, the medium M1 to be ejected this time between the rear end aligning member 31 and the rear end reference surface 32 is unlikely to buckle, and thus, it is desirable that the position of the rear end aligning member 31 is a position close to the rear end reference surface 32.

The rear end aligning member 31 may constantly rotate, or may rotate for a certain period of time at the timing when the rear end of the medium M1 to be ejected this time by is ejected by the ejecting section 71. The rear end aligning member 31 may be any member as long as it is possible to draw the medium M1 to be ejected this time. The rear end aligning member 31 may be, for example, a knurled belt, a brush, a sponge roller, or the like.

In the example illustrated in FIG. 3, the processing tray 21 on which the medium M is loaded is disposed at an angle of approximately 30 degrees with respect to the horizontal plane. The gravity acting on the medium M1 to be ejected this time exerts a force to move the medium M1 to be ejected this time toward the rear end reference surface 32 on the processing tray 21, and the rear end of the medium M1 to be ejected this time exerts a force to hold this state even after abutting against the rear end reference surface 32. Accordingly, it is easy to align the medium M1 to be ejected this time with the rear end reference surface 32 side, and it is possible to suppress disturbance of the loading state after aligning the medium M1 to be ejected this time. In addition, the angle formed by the processing tray 21 with respect to the horizontal plane may be set to an appropriate value.

Regarding Side End Aligning Operation

As illustrated in FIG. 4, in the side end aligning operation, one of the first side end guide member 41 and the second side end guide member 42 is specified as the side end aligning member, and the guide member specified as the side end aligning member is controlled as the side end aligning member. During the side end aligning operation, the position of the guide member which is not specified as the side end aligning member is fixed, and the aligning surface of the guide member is a reference surface when the side ends M1*c* and M1*d* of the medium M1 to be ejected this time are aligned. The side end aligning member is positioned at a standby position WP of either a first position WP1 or a second position WP2 when the medium M1 to be ejected this time is ejected.

First, the side end aligning operation when the first side end guide member 41 is controlled as the side end aligning member and the standby position WP of the first side end guide member 41 is the first position WP1, will be described.

Figure 5:
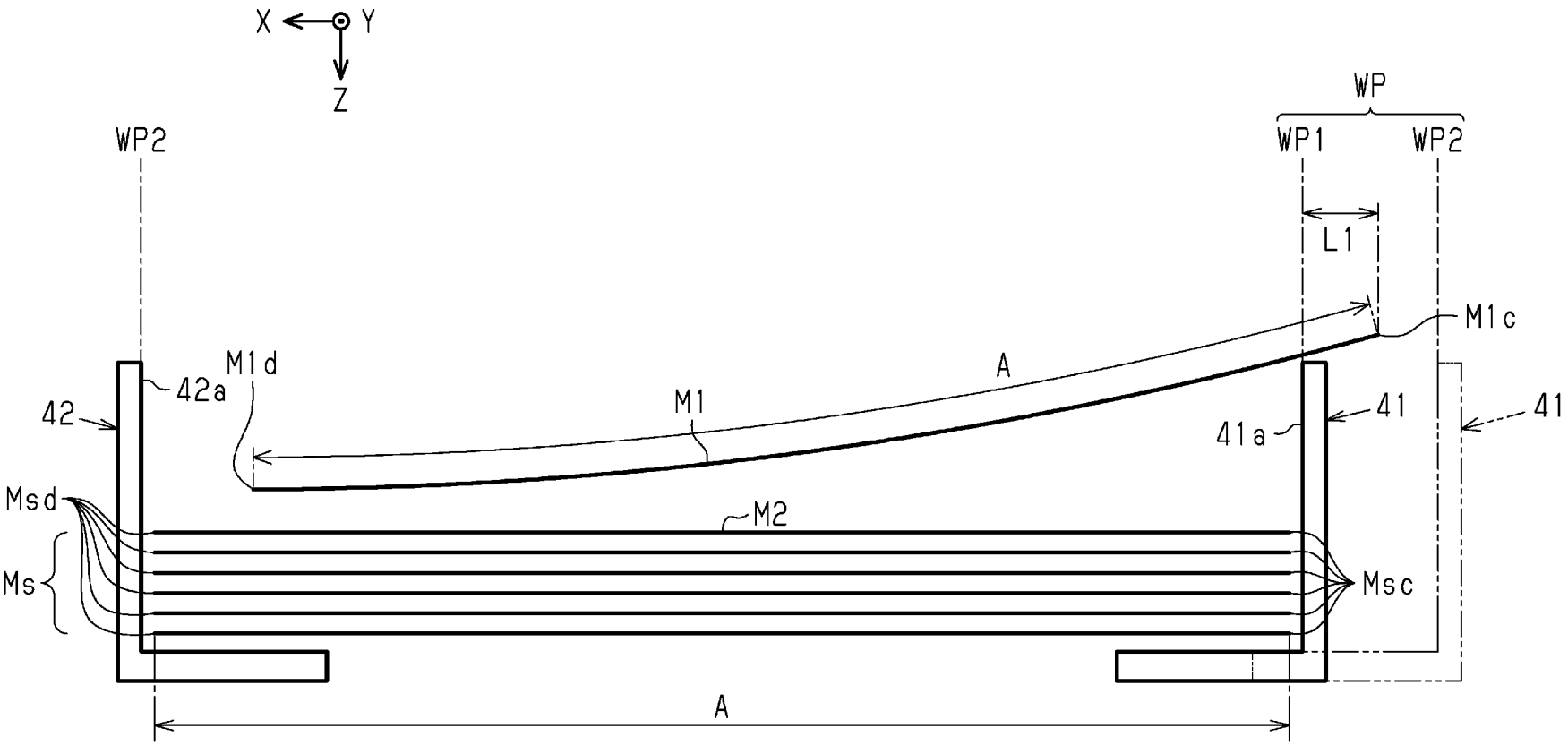
FIG. 5 is a schematic view illustrating a state of the medium when the first side end guide member is positioned at a first position.

As illustrated in FIG. 5, when the first side end guide member 41 is controlled as the side end aligning member, the position of the second side end guide member 42 is fixed at the second position WP2, and the aligning surface 42*a* of the second side end guide member 42 serves as a reference surface. The first side end guide member 41 is positioned at the first position WP1, which is the standby position WP, when the medium M1 to be ejected this time is ejected. In addition, after this, the first side end guide member 41 moves in the width direction X orthogonal to the ejecting direction of the medium M1 to be ejected this time, and performs the side end aligning operation. More specifically, the first side end guide member 41 moves to the first position WP1, which is the side end aligning position, after moving toward the second position WP2 side away from the first position WP1, and aligns the first side end M1*c* of the medium M1 to be ejected this time with a first side end Msc of the medium Ms loaded on the processing tray 21. In addition, in the example illustrated in FIG. 5, the side end aligning position is set to the first position WP1, but the side end aligning position and the first position WP1 may not have to be the same position. For example, the first position WP1, which is the standby position WP, may be inside the reference position RP and outside the side end aligning position.

In other words, the first side end guide member 41 is configured to be positioned, as the side end aligning member, at the standby position WP when the medium M1 to be ejected this time is ejected, and then to be capable of aligning the first side end M1*c* of the medium M1 to be ejected this time with the first side end Msc of the medium Ms loaded on the processing tray 21. Then, the standby position WP at this time is set to the first position WP1.

When the standby position WP of the first side end guide member 41 is the first position WP1, and when the medium M1 to be ejected this time is ejected by the ejecting section 71, the second side end guide member 42 is positioned at the second position WP2, and the first side end guide member 41 is positioned at the first position WP1. Therefore, the first side end guide member 41 positioned at the first position WP1 overlaps the medium M1 to be ejected this time in the width direction X. Accordingly, on the first side end M1*c* side, the first side end guide member 41 suppresses the contact between the medium M1 to be ejected this time and the medium M2 ejected previously.

At the set timing, the first side end guide member 41 is separated from the first position WP1 and starts moving toward the second position WP2. When this timing is early, the side end aligning operation can be started at the same time when the rear end of the medium M1 to be ejected this time is ejected from the ejecting section 71. When this timing is late, the contact between the medium M1 to be ejected this time and the medium M2 ejected previously can be suppressed for a while after the rear end of the medium M1 to be ejected this time is ejected from the ejecting section 71.

The distance in the width direction X between the aligning surface 41*a* of the first side end guide member 41 at the first position WP1 and the assumed first side end M1*c* of the medium when the medium M1 to be ejected this time is ejected from the ejecting section 71, is referred to as an overlapping amount L1. It is assumed that the first side end guide member 41 at the first position WP1 and the medium M1 to be ejected this time overlap each other on the first side end M1*c* side of the medium M1 to be ejected this time by the amount of overlapping amount L1 in the width direction X. In addition, in the following description, the "distance in the width direction X between the aligning surface 41*a* of the first side end guide member 41 at the first position WP1 and the assumed first side end M1*c* of the medium when the medium M1 to be ejected this time is ejected from the ejecting section 71" is simply referred to as "overlapping amount L1". By setting the first position WP1 of the first side end guide member 41 and the second position WP2 of the second side end guide member 42 further to the +X direction side, the overlapping amount L1 can be increased. When the overlapping amount L1 is large, the contact between the medium M1 to be ejected this time and the medium M2 ejected previously can be further suppressed. When the overlapping amount L1 is small, the moving distance to the second position WP2 becomes short even when the timing at which the first side end guide member 41 is separated from the first position WP1 and starts moving toward the second position WP2 side is the same. Therefore, after the rear end of the medium M1 to be ejected this time is ejected from the ejecting section 71, it is possible to shorten the time until the first side end M1*c* of the medium M1 to be ejected this time is aligned with the first side end Msc of the medium Ms loaded on the processing tray 21.

The first side end guide member 41 positioned at the second position WP2 does not overlap the medium M1 to be ejected this time in the width direction X. Therefore, when the first side end guide member 41 moves from the second position WP2 to the first position WP1, the aligning surface 41*a* of the first side end guide member 41 can abut against the first side end M1*c* of the medium M1 to be ejected this time. The first side end guide member 41, as the side end aligning member moves in the width direction X orthogonal to the ejecting direction of the medium M ejected this time, and performs the side end aligning operation of aligning the first side end M1*c* of the medium M ejected this time with the first side end Msc of the medium Ms loaded on the processing tray 21. As the first side end guide member 41 moves from the second position WP2 to the first position WP1 as the side end aligning position, the first side end M1*c* of the medium M1 to be ejected this time is aligned.

In order to align the side ends of the medium M, it is desirable to set the distance between the first position WP1 of the first side end guide member 41 and the second position WP2 of the second side end guide member 42 at the time of aligning the side ends of the medium M ejected this time, to be equal to the medium width A.

The ejecting section 71 ejects the next medium M while the first side end guide member 41 is positioned at the first position WP1 as the side end aligning position. Accordingly, in the next medium M, the contact between the medium M1 to be ejected this time and the medium M2 ejected previously can also be suppressed.

Next, the side end aligning operation, which is performed by the side end aligning member, when the first side end guide member 41 is controlled as the side end aligning member and the standby position WP of the first side end guide member 41 is the second position WP2, will be described.

Figure 6:
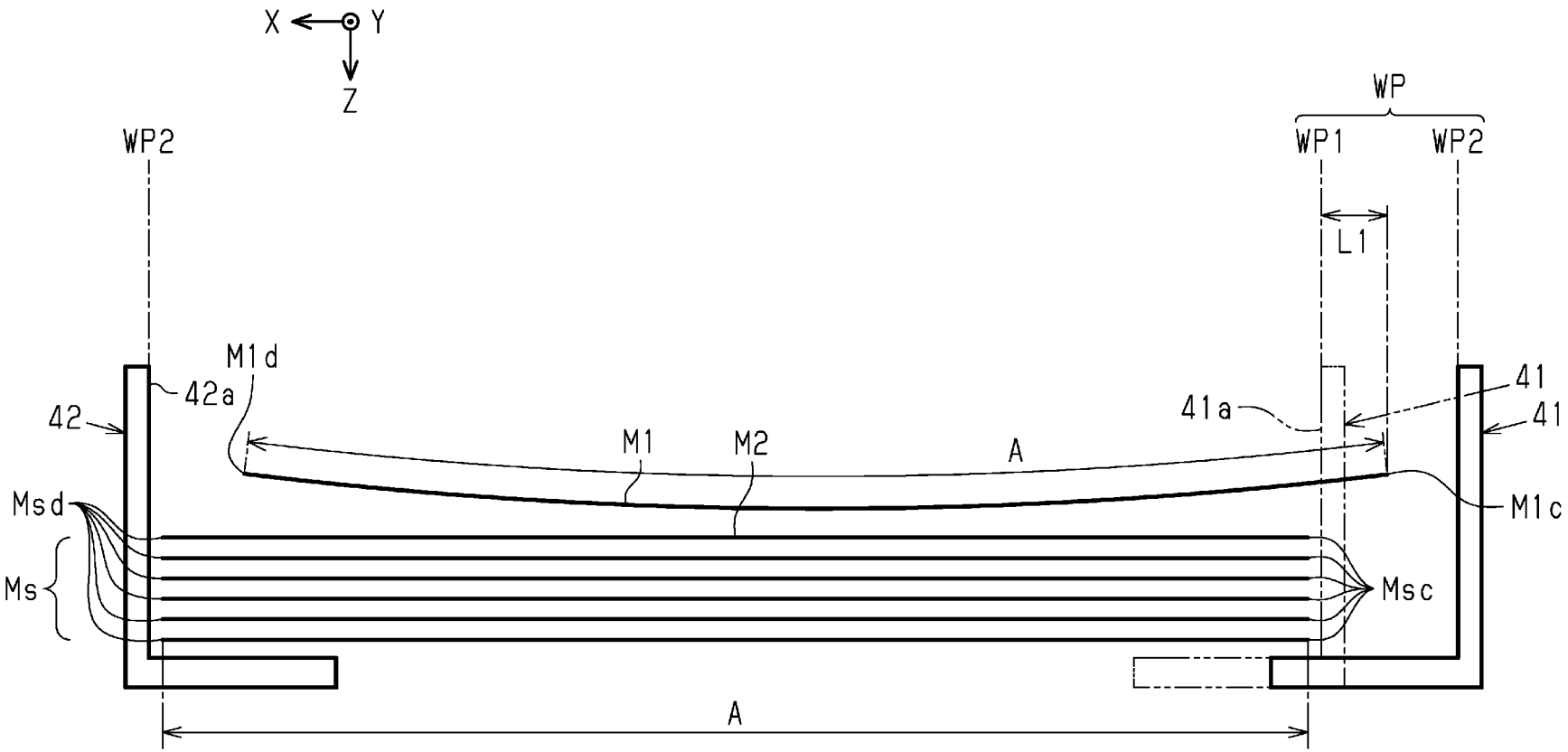
FIG. 6 is a schematic view illustrating a state of the medium when the first side end guide member is positioned at a second position.

As illustrated in FIG. 6, when the first side end guide member 41 is controlled as the side end aligning member, the position of the second side end guide member 42 is fixed at the second position WP2, and the aligning surface 42*a* of the second side end guide member 42 serves as a reference surface. The first side end guide member 41 is positioned at the second position WP2, which is the standby position WP, when the medium M1 to be ejected this time is ejected. In addition, after this, the first side end guide member 41 moves in the width direction X orthogonal to the ejecting direction of the medium M1 to be ejected this time, and performs the side end aligning operation. More specifically, the first side end guide member 41 moves to the first position WP1, which is the side end aligning position from the second position WP2, and aligns the first side end M1*c* of the medium M1 to be ejected this time with the first side end Msc of the medium Ms loaded on the processing tray 21.

In other words, the first side end guide member 41 is configured to be positioned, as the side end aligning member, at the standby position WP when the medium M1 to be ejected this time is ejected, and then to be capable of aligning the first side end M1*c* of the medium M1 to be ejected this time with the first side end Msc of the medium Ms loaded on the processing tray 21. Then, the standby position WP at this time is set to the second position WP2.

When the standby position WP of the first side end guide member 41 is the second position WP2, and when the medium M1 to be ejected this time is ejected by the ejecting section 71, the second side end guide member 42 is positioned at the second position WP2, and the first side end guide member 41 is positioned at the second position WP2. Therefore, the first side end guide member 41 positioned at the second position WP2 does not overlap the medium M1 to be ejected this time in the width direction X.

When the standby position WP of the first side end guide member 41 is the second position WP2, in the side end aligning operation, the first side end guide member 41 does not require an extra operation of moving from the second position WP2 side to the outside in the width direction X. Therefore, after the rear end of the medium M1 to be ejected this time is ejected from the ejecting section 71, it is possible to shorten the time until the first side end M1*c* of the medium M1 to be ejected this time is aligned with the first side end Msc of the medium Ms loaded on the processing tray 21.

Next, the side end aligning operation, which is performed by the side end aligning member, when the second side end guide member 42 is controlled as the side end aligning member and the standby position WP of the second side end guide member 42 is the first position WP1, will be described. In addition, in the present embodiment, since the configuration and the side end aligning operation of the second side end guide member 42 in the width direction X are the same as those of the first side end guide member 41, a common description thereof will be omitted.

Figure 7:
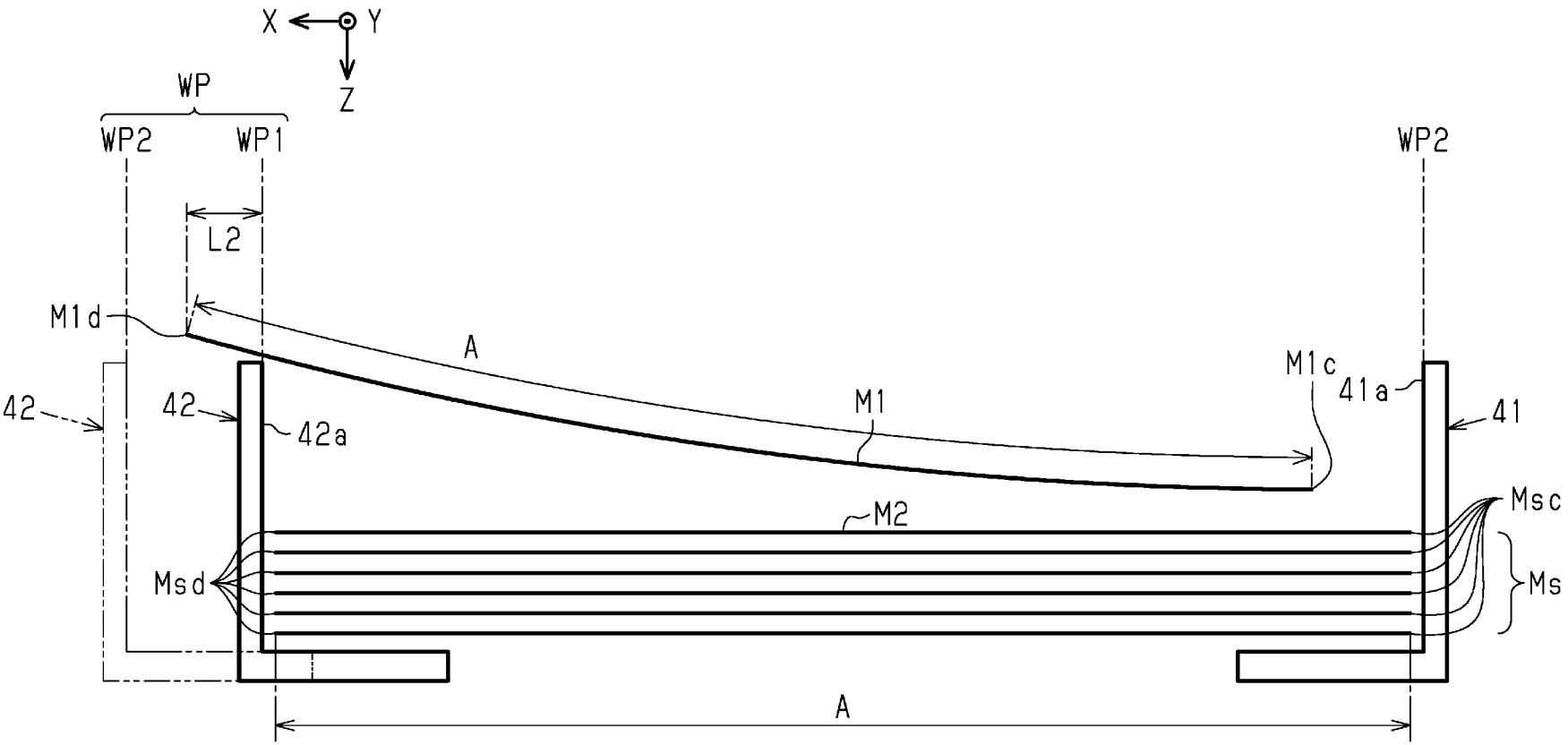
FIG. 7 is a schematic view illustrating a state of the medium when the second side end guide member is positioned at the first position.

As illustrated in FIG. 7, when the second side end guide member 42 is controlled as the side end aligning member, the position of the first side end guide member 41 is fixed at the second position WP2, and the aligning surface 41*a* of the first side end guide member 41 serves as a reference surface. The second side end guide member 42 is positioned at the first position WP1, which is the standby position WP, when the medium M1 to be ejected this time is ejected. In addition, after this, the second side end guide member 42 moves in the width direction X orthogonal to the ejecting direction of the medium M1 to be ejected this time, and performs the side end aligning operation. More specifically, the second side end guide member 42 moves to the first position WP1, which is the side end aligning position, after moving toward the second position WP2 side away from the first position WP1, and aligns the second side end M1*d* of the medium M1 to be ejected this time with a second side end Msd of the medium Ms loaded on the processing tray 21. In addition, in the example illustrated in FIG. 7, the side end aligning position is set to the first position WP1, but the side end aligning position and the first position WP1 may not have to be the same position. For example, the first position WP1, which is the standby position WP, may be inside the reference position RP and outside the side end aligning position.

In other words, the second side end guide member 42 is configured to be positioned, as the side end aligning member, at the standby position WP when the medium M1 to be ejected this time is ejected, and then to be capable of aligning the second side end M1*d* of the medium M1 to be ejected this time with the second side end Msd of the medium Ms loaded on the processing tray 21. Then, the standby position WP at this time is set to the first position WP1.

When the standby position WP of the second side end guide member 42 is the first position WP1, and when the medium M1 to be ejected this time is ejected by the ejecting section 71, the first side end guide member 41 is positioned at the second position WP2, and the second side end guide member 42 is positioned at the first position WP1. Therefore, the second side end guide member 42 positioned at the first position WP1 overlaps the medium M1 to be ejected this time in the width direction X. Accordingly, on the second side end M1*d* side, the second side end guide member 42 suppresses the contact between the medium M1 to be ejected this time and the medium M2 ejected previously.

The distance in the width direction X between the aligning surface 42*a* of the second side end guide member 42 at the first position WP1 and the assumed second side end M1*d* of the medium when the medium M1 to be ejected this time is ejected from the ejecting section 71, is referred to as an overlapping amount L2. It is assumed that the second side end guide member 42 at the first position WP1 and the medium M1 to be ejected this time overlap each other on the second side end M1*d* side of the medium M1 to be ejected this time by the amount of overlapping amount L2 in the width direction X. In addition, in the following description, the "distance in the width direction X between the aligning surface 42*a* of the second side end guide member 42 at the first position WP1 and the assumed second side end M1*d* of the medium when the medium M1 to be ejected this time is ejected from the ejecting section 71" is simply referred to as "overlapping amount L2".

The second side end guide member 42, as the side end aligning member moves in the width direction X orthogonal to the ejecting direction of the medium M ejected this time, and performs the side end aligning operation of aligning the first side end M1*c* of the medium M ejected this time with the first side end Msc of the medium Ms loaded on the processing tray 21. As the second side end guide member 42 moves from the second position WP2 to the first position WP1 as the side end aligning position, the second side end M1*d* of the medium M to be ejected this time is aligned.

Next, the side end aligning operation, which is performed by the side end aligning member, when the second side end guide member 42 is controlled as the side end aligning member and the standby position WP of the second side end guide member 42 is the second position WP2, will be described. In addition, in the present embodiment, since the configuration and the side end aligning operation of the second side end guide member 42 in the width direction X are the same as those of the first side end guide member 41, a common description thereof will be omitted.

Figure 8:
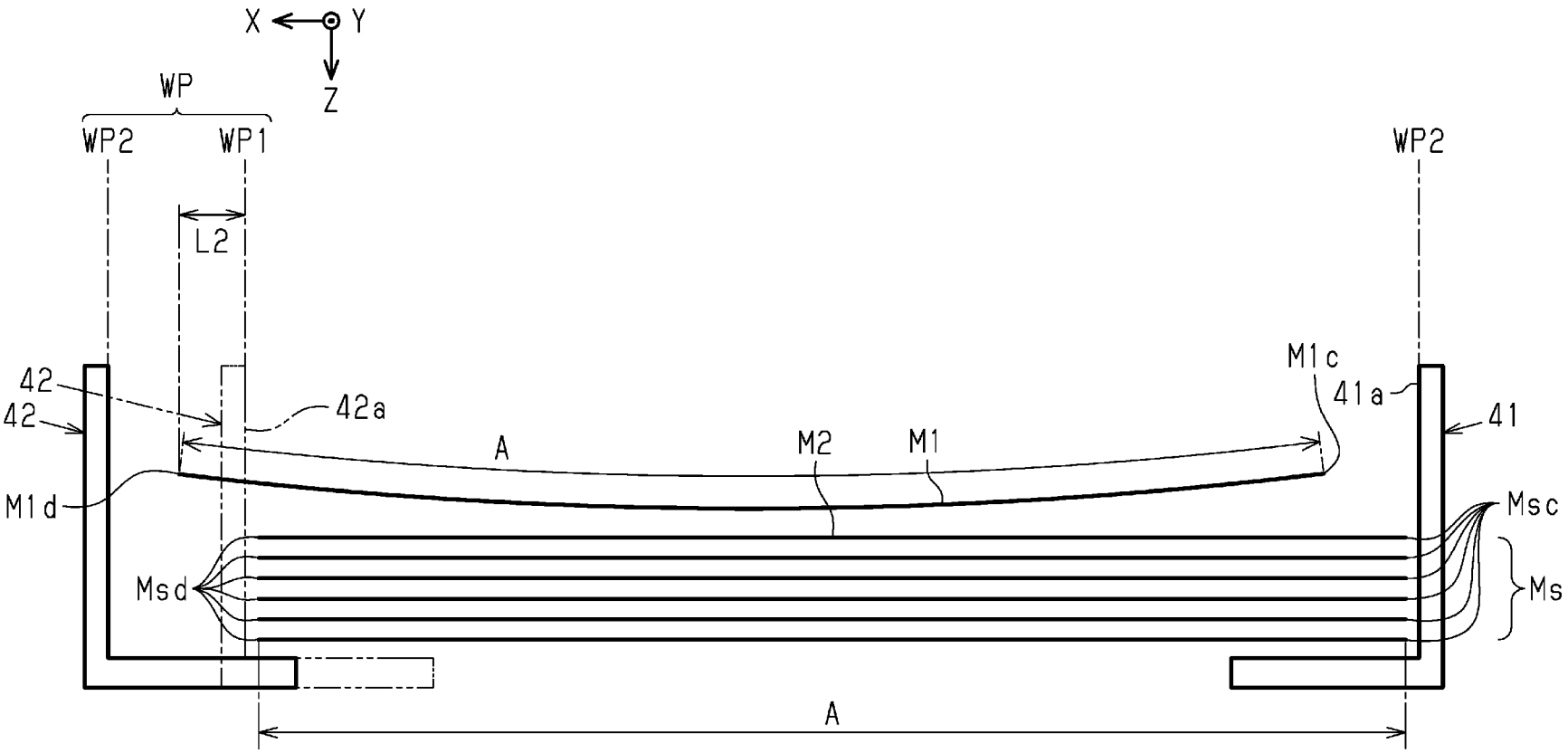
FIG. 8 is a schematic view illustrating a state of the medium when the second side end guide member is positioned at the second position.

As illustrated in FIG. 8, when the second side end guide member 42 is controlled as the side end aligning member, the position of the first side end guide member 41 is fixed at the second position WP2, and the aligning surface 41*a* of the first side end guide member 41 serves as a reference surface. The second side end guide member 42 is positioned at the second position WP2, which is the standby position WP, when the medium M1 to be ejected this time is ejected. In addition, after this, the second side end guide member 42 moves in the width direction X orthogonal to the ejecting direction of the medium M1 to be ejected this time, and performs the side end aligning operation. More specifically, the second side end guide member 42 moves to the first position WP1, which is the side end aligning position from the second position WP2, and aligns the second side end M1*d* of the medium M1 to be ejected this time with the second side end Msd of the medium Ms loaded on the processing tray 21.

In other words, the second side end guide member 42 is configured to be positioned, as the side end aligning member, at the standby position WP when the medium M1 to be ejected this time is ejected, and then to be capable of aligning the second side end M1*d* of the medium M1 to be ejected this time with the second side end Msd of the medium Ms loaded on the processing tray 21. Then, the standby position WP at this time is set to the second position WP2.

When the standby position WP of the second side end guide member 42 is the second position WP2, and when the medium M1 to be ejected this time is ejected by the ejecting section 71, the first side end guide member 41 is positioned at the second position WP2, and the second side end guide member 42 is positioned at the second position WP2. Therefore, the first side end guide member 41 positioned at the second position WP2 does not overlap the medium M1 to be ejected this time in the width direction X.

Regarding Shift Processing

The shift processing is performed in the processing tray 21 before the medium bundle of which the rear ends and the side ends are aligned is ejected to the stacker tray 13. After the side end aligning operation, on the processing tray 21, the position of the medium bundle in the width direction X is shifted in the state of the medium bundle, and the position of the medium bundle in the width direction X when ejected to the stacker tray 13 is changed.

When the side end aligning operation ends, the aligning surface 41*a* abuts against the first side end Msc of the medium Ms loaded on the processing tray 21, and the aligning surface 42*a* abuts against the second side end Msd of the medium Ms loaded on the processing tray 21. Then, before the medium Ms loaded on the processing tray 21 is ejected to the stacker tray 13, the first side end guide member 41 and the second side end guide member 42 move at the same speed, at the same timing, and in the same direction in the width direction X by the same distance. Accordingly, the position of the medium Ms loaded on the processing tray 21 in the width direction X can be changed.

The position of the reference surface when the side ends M1*c* and M1*d* of the medium M1 to be ejected this time are aligned may be changed for each unit of number of copies.

For example, the position of the aligning surface 42*a*, which is the reference surface, is a position away from the reference position RP by 10 mm in the +X direction in the first medium bundle, and may be a position away from the reference position RP by 20 mm in the +X direction in the next medium bundle. In other words, the position of the reference surface when the side ends M1*c* and M1*d* are aligned is changed for each unit of number of copies, and thus, the position in the width direction X of the medium Ms loaded on the processing tray 21 when the side ends M1*c* and M1*d* are aligned may be changed for each unit of number of copies. For example, in the first medium bundle, the aligning surface 41*a* may be the reference surface, and in the next medium bundle, the aligning surface 42*a* may be the reference surface. In other words, the aligning surface which is the reference surface when the side ends M1*c* and M1*d* are aligned is changed for each unit of number of copies, and thus, the position in the width direction X of the medium Ms loaded on the processing tray 21 when the side ends M1*c* and Mid are aligned may be changed for each unit of number of copies.

Configuration of Image Forming System

Figure 9:
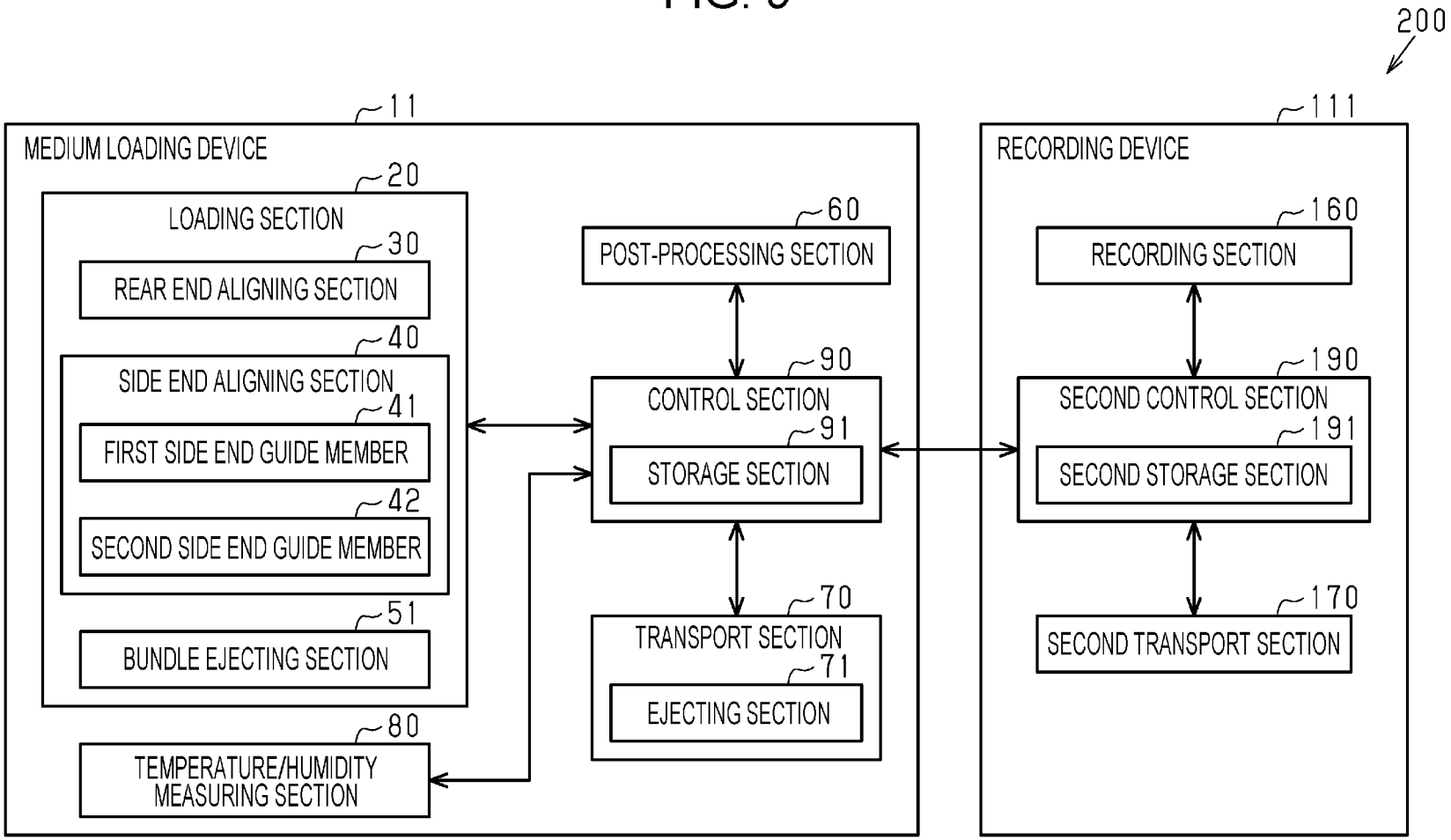
FIG. 9 is a block diagram illustrating a configuration of the medium loading device and the image forming system.

As illustrated in FIG. 9, the recording device 111 includes the recording section 160 that performs recording on the medium M by discharging a liquid, a second transport section 170 that transports the medium M recorded by the recording section 160 to the medium loading device 11, and a second control section 190 that controls the recording device 111. The second control section 190 includes a second storage section 191 that stores information. In the recording device 111 and the medium loading device 11 illustrated in FIG. 9, components which are not related to the loading of the medium M are omitted.

The recording device 111 may be coupled to an external network and receive a recording command from a server, a computer, or the like, which is coupled to the network. As information relating to the medium M to be recorded, the recording command may include information on the size of the medium M, the basis weight of the medium M, the type of the medium M, the number of recorded pages and the recorded data on each page, the designation of single-sided recording or double-sided recording, the number of recording sections, and the type of post-processing.

For example, the second storage section 191 included in the recording device 111 stores information on the size of the medium M, the basis weight of the medium M, the type of the medium M, and the like, which is accommodated in the recording device 111. When the recording device 111 receives a recording command, the second control section 190 checks whether or not the medium M that satisfies the size of the medium M, the basis weight of the medium M, the type of the medium M, and the like, which are included in the recording command, is accommodated in the recording device 111. When the recording device 111 determines that the medium M designated in the recording command is accommodated in the recording device 111, the recording device 111 receives the recording command. Then, the second control section 190 controls the operation of the recording section 160 and the second transport section 170 in response to the recording command to perform recording on the medium M. In addition, the recording device 111 may perform recording by the recording command from the operation section 115 illustrated in FIG. 1.

The medium loading device 11 includes the loading section 20, the transport section 70 having the ejecting section 71, and a control section 90 that controls the medium loading device 11. The loading section 20 is configured with a rear end aligning section 30 that aligns the rear ends of the media M, a side end aligning section 40 that aligns the side ends of the media M by moving the side end aligning member, and the bundle ejecting section 51 that ejects the aligned medium bundle. The control section 90 includes a storage section 91 that stores information. The movement of the side end aligning member is controlled by the control section 90. Information is exchanged between the control section 90 and the second control section 190 by wired or wireless communication. In addition, the medium loading device 11 may include a post-processing section 60 that performs post-processing in the unit of one medium or in the unit of number of copies. The post-processing in the unit of one medium is, for example, punching processing. Further, the post-processing in the unit of number of copies is, for example, staple processing. In addition, the post-processing in the unit of number of copies may be punching processing.

The medium loading device 11 may include a temperature/humidity measuring section 80. The temperature/humidity measuring section 80 measures the temperature and humidity of the environment in which the image forming system 200 is installed. The temperature/humidity measuring section 80 aims to measure the temperature and humidity of the environment in which the medium M is recorded by the recording section 160. Therefore, the recording device 111 including the recording section 160 may include the temperature/humidity measuring section 80.

Regarding Information Relating to Medium

As illustrated in FIG. 9, when the medium M recorded by the recording section 160 is ejected from the recording device 111 to the medium loading device 11, the second control section 190 notifies the control section 90 of the information relating to the medium M1 to be ejected this time. When the medium M1 to be ejected this time is the final medium in the unit of number of copies, in addition to the information relating to the medium M1 to be ejected this time, information indicating that the medium M1 is the final medium in the unit of number of copies is notified. In addition, the medium M1 to be ejected this time from the recording device 111 to the medium loading device 11 is the medium M1 to be ejected this time to the processing tray 21 by the ejecting section 71. The information relating to the medium M1 to be ejected this time is stored in the storage section 91 as the information relating to the medium recorded before the ejection at this time, and is stored in the storage section 91 until at least the processing in the unit of number of copies ends, in the medium loading device 11. In addition, until the medium M1 to be ejected this time from the recording device 111 to the medium loading device 11 is ejected this time to the processing tray 21 by the ejecting section 71, there is a time lag corresponding to the transport time required for transport during this period.

The information relating to the medium M1 to be ejected this time is information necessary for the medium loading device 11 to load the medium M recorded by the recording device 111 and eject the medium M as a medium bundle. For example, the size of the medium M is information necessary when the medium aligning operation is performed. By notifying the medium width A and the medium length B, when loading the medium M1 to be ejected this time, the medium loading device 11 can align the medium M1 to be ejected this time with the notified size of the medium M.

The ease of buckling of the medium M1 to be ejected this time when the medium ejecting operation is performed is caused by the frictional force F1 and the drag force F2. In other words, the information relating to the frictional force F1 and the information relating to the drag force F2 are information on factors of ease of buckling. Therefore, the information relating to the medium M1 to be ejected this time includes information relating to the frictional force F1 and information relating to the drag force F2.

The information relating to the medium M1 to be ejected this time includes the recording density on the lower surface of the medium M1 to be ejected this time and the recording density on the upper surface of the medium M1 to be ejected this time. In addition, in the following description, the "recording density on the lower surface of the medium M1 to be ejected this time" is simply referred to as "first lower surface recording density", and the "recording density on the upper surface of the medium M1 to be ejected this time" is simply referred to as "first upper surface recording density".

The recording density refers to a liquid discharge amount per area of the medium M. The recording density is indicated by 0 to 100%. For example, the ratio of the number of dots, which were actually hit, with respect to the number of dots that the recording section 160 can hit on the medium M is the recording density.

Further, the recording density may be a recording ratio of the medium M. The recording ratio of the medium M is a ratio of the recording region to the area of the medium M. Furthermore, the recording density may be given by the product of the liquid discharge amount per area of the medium M and the recording ratio of the medium M.

As the recording density increases, the medium surface becomes wet with ink. As the medium M becomes wet, the slidability of the medium M decreases, and thus, the frictional force F1 increases. Therefore, the first lower surface recording density and the first upper surface recording density are information relating to the frictional force F1.

When there is a difference in recording density between the upper surface of the medium M and the lower surface of the medium M, the end portion of the medium M is curled toward the surface where the recording density is small. More specifically, when the fibers of the medium M absorb moisture and expand, the expansion coefficient of the fibers differs when there is a difference in the recording density between the upper surface of the medium M and the lower surface of the medium M. Therefore, the end portion of the medium M is curled toward the surface having a small expansion coefficient. In other words, the curl state of the medium M can be estimated from the difference in recording density between the upper surface of the medium M and the lower surface of the medium M. For example, when the tip end part M1*a* of the medium M1 to be ejected this time is not curled, the angle at which the tip end part M1*a* of the medium M1 to be ejected this time comes into contact with the medium M2 ejected previously becomes an acute angle. Meanwhile, for example, when the tip end of the medium M1 to be ejected this time is curled downward, the angle at which the tip end part M1*a* of the medium M1 to be ejected this time comes into contact with the medium M2 ejected previously becomes an obtuse angle. Accordingly, the frictional force F1 increases, and thus, the slidability decreases. In other words, the subtraction value obtained by subtracting the first lower surface recording density from the first upper surface recording density is a value that substitutes for the curl amount of the medium M1 to be ejected this time. In addition, in the following description, the "subtraction value obtained by subtracting the first lower surface recording density from the first upper surface recording density" is simply referred to as "subtraction value". The second control section 190 may notify the control section 90 of the subtraction value as information relating to the medium M1 to be ejected this time.

The information relating to the medium M1 to be ejected this time may include the actual curl amount of the medium M1 to be ejected this time. For example, the recording device 111 includes a curl sensor (not illustrated) that measures the curl amount of the medium M1 to be ejected this time, and the second control section 190 may notify the control section 90 of the measured curl amount as the information relating to the medium M1 to be ejected this time. In addition, when the curl amount of the medium M1 to be ejected this time can be estimated from the recorded image pattern, the second control section 190 may notify the control section 90 of the estimated curl amount as information relating to the medium M1 to be ejected this time. Further, the value that substitutes for the curl amount of the medium M1 to be ejected this time, including the curl amount and the subtraction value, is information relating to the frictional force F1.

The information relating to the medium M1 to be ejected this time may include the recording density distribution in the width direction X on the lower surface of the medium M1 to be ejected this time, and may include the recording density distribution in the width direction X on the upper surface of the medium M1 to be ejected this time. In addition, in the following description, the "recording density distribution in the width direction X on the lower surface of the medium M1 to be ejected this time" is simply referred to as "first lower surface width direction recording density distribution". Further, the "recording density distribution in the width direction X on the upper surface of the medium M1 to be ejected this time" is simply referred to as "first upper surface width direction recording density distribution". In addition, the "recording density distribution in the width direction X on the upper surface of the medium M2 ejected previously" is simply referred to as "second upper surface width direction recording density distribution".

For example, the medium surface of the lower surface of the medium M1 to be ejected this time is divided into two in the width direction X, that is, a medium surface on the first side end M1*c* side and a medium surface on the second side end M1*d* side. In addition, the first lower surface width direction recording density distribution is configured with two pieces of information, that is, the recording density of the medium surface of the lower surface on the first side end M1*c* side, and the recording density of the medium surface of the lower surface on the second side end M1*d* side. Further, the number of divisions may be 3 or more.

The first lower surface width direction recording density distribution and the first upper surface width direction recording density distribution are information relating to the frictional force F1. For example, on the lower surface of the medium M1 to be ejected this time, according to the first lower surface width direction recording density distribution, the control section 90 can determine which the frictional force F1 is greater among the frictional force F1 of the medium surface on the first side end M1*c* side and the frictional force F1 of the medium surface on the second side end M1*d* side. For example, on the upper surface of the medium M1 to be ejected this time, according to the first upper surface width direction recording density distribution, the control section 90 can determine which the frictional force F1 is greater among the frictional force F1 of the medium surface on the first side end M1*c* side and the frictional force F1 of the medium surface on the second side end M1*d* side.

The information relating to the medium M1 to be ejected this time may include the recording density distribution in the length direction Y1 on the lower surface of the medium M1 to be ejected this time, and may include the recording density distribution in the length direction Y1 on the upper surface of the medium M1 to be ejected this time. In addition, in the following description, the "recording density distribution in the length direction Y1 on the lower surface of the medium M1 to be ejected this time" is simply referred to as "first lower surface length direction recording density distribution". Further, the "recording density distribution in the length direction Y1 on the upper surface of the medium M1 to be ejected this time" is simply referred to as "first upper surface length direction recording density distribution".

The first lower surface length direction recording density distribution and the first upper surface length direction recording density distribution are information relating to the frictional force F1. The medium M1 to be ejected this time is ejected while the lower surface of the tip end part M1*a* of the medium M1 to be ejected this time rubs the upper surface of the medium M2 ejected previously. According to the first lower surface length direction recording density distribution and the first upper surface length direction recording density distribution notified to the control section 90, the recording density of the part where the medium M rubs can be grasped, and the magnitude of the frictional force F1 at the part where the medium M rubs can be determined more accurately.

The information relating to the medium M1 to be ejected this time may include the size of the medium M1 to be ejected this time. The size of the medium M1 to be ejected this time is information necessary when the medium aligning operation is performed in the medium loading device 11. Since the medium M having a long medium length B and the medium M having a short medium width A have a small bending strength, the size of the medium M1 to be ejected this time is also information relating to the drag force F2.

The information relating to the medium M1 to be ejected this time may include the basis weight of the medium M1 to be ejected this time. The basis weight of the medium M1 to be ejected this time is a weight per unit area of the medium M1 to be ejected this time, and as the basis weight decreases, the bending strength of the medium M decreases. Therefore, the basis weight of the medium M1 to be ejected this time is information relating to the drag force F2.

The information relating to the medium M1 to be ejected this time may include the type of the medium M1 to be ejected this time. The type of the medium M1 to be ejected this time is, for example, the brand or the paper grain direction of the medium M1 to be ejected this time. Since there is a case where the bending strength differs depending on the brand of the medium M1 to be ejected this time, the brand of the medium M1 to be ejected this time is information relating to the drag force F2. Further, since the bending strength is smaller when the paper grain direction is the width direction X than that when the paper grain direction is the length direction Y1, the paper grain direction is information relating to the drag force F2.

When the recording device 111 includes the temperature/humidity measuring section 80, the information relating to the medium M1 to be ejected this time may include the temperature and humidity of the environment in which the medium M1 to be ejected this time is recorded. For example, when the medium M recorded by the recording section 160 is ejected from the recording device 111 to the medium loading device 11, the second control section 190 may notify the control section 90 of the value measured by the temperature/humidity measuring section 80 as information relating to the medium M1 to be ejected this time. For example, when the humidity of the environment in which the medium M1 to be ejected this time is recorded is high, it takes time for the medium surface to dry. Therefore, the humidity of the environment in which the medium M1 to be ejected this time is recorded is information relating to the frictional force F1. Further, when the temperature of the environment in which the medium M1 to be ejected this time is recorded is low, improvement in the water containing state by the drying process is not observed, and it takes time for the medium surface to dry. Therefore, the temperature of the environment in which the medium M1 to be ejected this time is recorded is information relating to the frictional force F1. In addition, the influence of temperature is less than the influence of humidity.

The information relating to the medium M1 to be ejected this time may include the time at which the medium M1 to be ejected this time is recorded. The control section 90 subtracts the time when the medium M1 to be ejected this time is recorded from the time when the medium M1 to be ejected this time is ejected. Accordingly, the control section 90 can calculate the elapsed time from the recording of the medium M1 to be ejected this time to the ejection. In addition, in the following description, the "elapsed time from the recording of the medium M1 to be ejected this time to the ejection" is simply referred to as "first elapsed time". The control section 90 may control the side end aligning operation using the first elapsed time. Since the medium surface is not yet dry when the first elapsed time is short, the time when the medium M1 to be ejected this time is recorded is information relating to the frictional force F1. In addition, the second control section 190 may notify the control section 90 of the elapsed time from the time when the medium M1 to be ejected this time is recorded to the time when the medium M1 to be ejected this time is ejected from the recording device 111 to the medium loading device 11, as information relating to the medium M1 to be ejected this time.

Information such as the transport speed of the medium M in the recording device 111, the resolution at the time of recording, and the processing content on the medium M may be used as a substitute for the first elapsed time. In other words, the information relating to the medium M1 to be ejected this time may include information that can be used as a substitute for the first elapsed time, such as the transport speed of the medium M1 to be ejected this time in the recording device 111, the resolution at the time of recording, the processing content on the medium M1 to be ejected this time, and the like. When the transport speed of the medium M is slow, the first elapsed time becomes long. When the resolution at the time of recording is high, the recording time becomes long, and thus, the first elapsed time becomes long. Depending on the processing content on the medium M, the first elapsed time becomes long. For example, when the medium M is subjected to the reverse ejection processing or the double-sided recording processing, the first elapsed time becomes long.

The information relating to the medium M1 to be ejected this time may be input by the user. For example, the user may input the information relating to the medium M1 to be ejected this time in the operation section 115 illustrated in FIG. 1 included in the recording device 111. Further, the medium loading device 11 may include an operation section (not illustrated) that can be input by the user, and the user may input information relating to the medium M1 to be ejected this time by the operation section. For example, the temperature and humidity of the environment in which the medium M1 to be ejected this time is recorded may be input by the user.

Regarding First Information and Second Information

The information used for controlling the medium aligning operation includes information relating to the recording density of at least one of the medium M1 to be ejected this time and the medium M2 ejected previously, and information relating to at least one of the media recorded before the ejection at this time. In addition, in the following description, the "information relating to the recording density of at least one of the medium M1 to be ejected this time and the medium M2 ejected previously" is simply referred to as "first information", and the "information relating to at least one of the media recorded before the ejection at this time" is simply referred to as "second information". In addition, there may be a plurality of second information.

Each time the medium M recorded by the recording section 160 is ejected from the recording device 111 to the medium loading device 11, the information relating to the medium M1 to be ejected this time is stored in the storage section 91. In other words, the storage section 91 stores information relating to the medium recorded before the ejection at this time.

The information relating to the medium recorded before the ejection at this time includes information relating to the medium M2 ejected previously, and includes the information relating to the medium M1 to be ejected this time. Then, the information relating to the medium recorded before the ejection at this time includes information relating to the recording density of the medium recorded before the ejection at this time. The control section 90 uses the necessary information among the information relating to the medium M1 to be ejected this time and the information stored in the storage section 91 as the first information and the second information for controlling the medium aligning operation.

The storage section 91 that stores the information relating to the medium recorded before the ejection at this time stores the recording density on the upper surface of the medium M2 ejected previously and the recording density on the lower surface of the medium M2 ejected previously. In addition, in the following description, the "recording density on the upper surface of the medium M2 ejected previously" is simply referred to as "second upper surface recording density".

While the lower surface of the tip end part M1*a* of the medium M1 to be ejected this time rubs the upper surface of the medium M2 ejected previously, the medium M1 to be ejected this time is ejected. Therefore, the frictional force F1 is generated between the lower surface of the medium M1 to be ejected this time and the upper surface of the medium M2 ejected previously. The frictional force F1 depends on the recording density of at least one medium of the medium M1 to be ejected this time and the medium M2 ejected previously.

More specifically, when the recording density of the lower surface of the medium M1 to be ejected this time is high, the moisture content of the lower surface of the medium M1 to be ejected this time becomes high. Accordingly, the slidability of the medium surface deteriorates, and thus, the frictional force F1 becomes large and buckling becomes easy. When the recording density on the upper surface of the medium M2 ejected previously is high, the moisture content of the upper surface of the medium M2 ejected previously becomes high. Accordingly, the slidability of the medium surface deteriorates, and thus, the frictional force F1 becomes large and buckling becomes easy. When the recording density on the upper surface of the medium M1 to be ejected this time is higher than the recording density on the lower surface, the difference in moisture content due to the difference in recording density between the upper surface and the lower surface becomes large, and thus, the tip end of the medium M1 to be ejected this time curls downward. Accordingly, the lower surface of the medium M1 to be ejected this time and the upper surface of the medium M2 ejected previously are in strong contact with each other, and the frictional force F1 becomes large and buckling becomes easy. When the recording density on the lower surface of the medium M2 ejected previously is higher than the recording density on the upper surface, the difference in moisture content due to the difference in recording density between the upper surface and the lower surface becomes large, and thus, the tip end of the medium M2 ejected previously curls downward. Accordingly, the lower surface of the medium M1 to be ejected this time and the upper surface of the medium M2 ejected previously are in strong contact with each other, and the frictional force F1 becomes large and buckling becomes easy. In other words, the first information relating to the recording density of at least one medium among the medium M1 to be ejected this time and the medium M2 ejected previously is information relating to the frictional force F1 and is a factor of the frictional force F1. Therefore, the first information relating to the recording density of at least one medium among the medium M1 to be ejected this time and the medium M2 ejected previously is used for controlling the medium aligning operation as a factor of the ease of buckling in the medium M1 to be ejected this time.

In the present embodiment, the first information is the first lower surface recording density and the second upper surface recording density. In addition, the value based on the first information is the total value obtained by adding the first lower surface recording density and the second upper surface recording density, and is a value based on the information relating to the recording density of both the media, that is, the medium M1 to be ejected this time and the medium M2 ejected previously. The control section 90 calculates the total value obtained by adding the first lower surface recording density and the second upper surface recording density, and controls the side end aligning operation using the total value. In addition, in the following description, the "total value obtained by adding the first lower surface recording density and the second upper surface recording density" is simply referred to as "total value". Further, the "threshold value" used in the following description is a threshold value in the value based on the first information, and is a threshold value in the total value in the present embodiment.

The medium M1 to be ejected this time is ejected while the lower surface of the tip end part M1*a* of the medium M1 to be ejected this time rubs the upper surface of the medium M2 ejected previously. As the total value increases, the medium surfaces slide in a wetter state. In other words, as the total value increases, the slidability between the medium M1 to be ejected this time and the medium M2 ejected previously decreases, and thus, the frictional force F1 becomes large and buckling becomes easy. The total value as the value based on the first information is the information relating to the frictional force F1 and is a factor of the frictional force F1. Therefore, in the present embodiment, the total value is used for controlling the medium aligning operation as a factor of the ease of buckling in the medium M1 to be ejected this time.

More specifically, when the total value is greater than the threshold value, the standby position WP of the side end aligning member is set to the first position WP1, and the side end aligning member suppresses the contact between the medium M1 to be ejected this time and the medium M2 ejected previously. Therefore, buckling of the medium M1 to be ejected this time is suppressed. When the total value is smaller than the threshold value, the standby position WP of the side end aligning member is set to the second position WP2, and the time for aligning the medium M1 to be ejected this time can be shortened compared to a case where the standby position WP is the first position WP1.

The second control section 190 may calculate the total value. Then, when the medium M1 to be ejected this time is ejected from the recording device 111 to the medium loading device 11, the second control section 190 may notify the control section 90 of the total value as the information relating to the medium M1 to be ejected this time.

In addition to the first information, there are other factors that make it easier to buckle. The ease of buckling of the medium M1 to be ejected this time is caused by the frictional force F1 and the drag force F2 which is a force against the frictional force F1. When the frictional force F1 is greater than the drag force F2, and when the second position WP2 where the medium M1 to be ejected this time does not overlap the side end aligning member is specified as the standby position WP, the medium M1 to be ejected this time easily buckles. Further, when the frictional force F1 is smaller than the drag force F2, the medium M1 to be ejected this time is unlikely to buckle, and thus, it is not necessary to specify the first position WP1 where the medium M1 to be ejected this time overlaps the side end aligning member as the standby position WP. Not only that, when the first position WP1 is specified as the standby position WP, it takes time for the medium aligning operation, and thus, the productivity of the medium loading device 11 decreases. Among the information relating to the medium, in addition to the first information relating to the recording density of at least one medium of the medium M1 to be ejected this time and the medium M2 ejected previously, there is information relating to the frictional force F1. Further, the information relating to the medium may include information relating to the drag force F2. In other words, when the specification of the standby position WP is controlled only by the value based on the first information, there is a concern that the performance of the medium loading device 11 deteriorates.

When the actual frictional force F1 is smaller than the frictional force F1 assumed from the total value, the control section 90 may adjust the threshold value based on the second information, or may determine the control parameter when the side end aligning member made to stand by at the first position WP1 based on the second information. Then, when the first position WP1 is specified as the standby position WP, the control section 90 may control the side end aligning member to stand by at the first position WP1 with the control parameter determined based on the second information. Both the adjustment of the threshold value and the control with the determined control parameters may be performed, or only one of these may be performed. More specifically, the control parameters when the side end aligning member stands by at the first position WP1 are control parameters for controlling at least one of the position of the first position WP1 in the width direction X and the time when the side end aligning member stands by at the first position WP1. In addition, in the following description, the "control parameter when the side end aligning member is made to stand by at the first position WP1" is simply referred to as "control parameter". The position of the first position WP1 in the width direction X and the time for the side end aligning member to stand by at the first position WP1 are changed within a range in which the influence on buckling is small. Accordingly, it is possible to suppress the decrease in the productivity of the medium loading device 11 while suppressing buckling of the medium M1 to be ejected this time.

When the actual frictional force F1 is greater than the frictional force F1 assumed from the total value, the control section 90 may adjust the threshold value based on the second information, and the control section 90 may determine the control parameters based on the second information. Then, when the first position WP1 is specified as the standby position WP, the control section 90 may control the side end aligning member to stand by at the first position WP1 with the control parameter determined based on the second information. Both the adjustment of the threshold value and the control with the determined control parameters may be performed, or only one of these may be performed. The position of the first position WP1 in the width direction X and the time for the side end aligning member to stand by at the first position WP1 are changed within a range in which the influence on productivity is small. Accordingly, buckling can be suppressed under recording conditions where buckling could not be suppressed.

The control parameter includes the overlapping amounts L1 and L2 which are the distances in the width direction X between the aligning surfaces 41*a* and 42*a* of the side end aligning member at the first position WP1 and the assumed side ends M1*c* and M1*d* of the medium when the medium M1 to be ejected this time is ejected from the ejecting section 71. The overlapping amounts L1 and L2 are control parameters for controlling the position of the first position WP1 in the width direction X. When the side end aligning member is the first side end guide member 41, the overlapping amount L1 is the distance in the width direction X between the aligning surface 41*a* of the first side end guide member 41 at the first position WP1 and the assumed first side end M1*c* of the medium when the medium M1 to be ejected this time is ejected from the ejecting section 71. When the side end aligning member is the second side end guide member 42, the overlapping amount L2 is the distance in the width direction X between the aligning surface 42*a* of the second side end guide member 42 at the first position WP1 and the assumed second side end M1*d* of the medium when the medium M1 to be ejected this time is ejected from the ejecting section 71. The control section 90 determines the overlapping amounts L1 and L2 based on the second information, and when the first position WP1 is specified as the standby position WP, the control section 90 controls the side end aligning member to stand by at the first position WP1 with the overlapping amounts L1 and L2 determined based on the second information. When the overlapping amounts L1 and L2 are reduced, it is possible to suppress the decrease in the productivity of the medium loading device 11. When the overlapping amounts L1 and L2 are increased, buckling can be suppressed under recording conditions where buckling could not be suppressed.

The control parameter includes the timing at which the side end aligning member moves from the first position WP1. The timing is a control parameter for controlling the time that the side end aligning member stands by at the first position WP1. The control section 90 determines the timing based on the second information, and when the first position WP1 is specified as the standby position WP, the control section 90 controls the side end aligning member to stand by at the first position WP1 with the timing determined based on the second information. When the timing is advanced, it is possible to suppress the decrease in the productivity of the medium loading device 11. When the timing is delayed, buckling can be suppressed under recording conditions where buckling could not be suppressed.

The control parameter includes the selection by the control section 90 to specify either the first side end guide member 41 or the second side end guide member 42 as the side end aligning member. The selection is a control parameter for controlling the position of the first position WP1 in the width direction X. The control section 90 determines the selection based on the second information, and when the first position WP1 is specified as the standby position WP, the control section 90 controls the side end aligning member to stand by at the first position WP1 with the selection determined based on the second information. When the frictional force F1 on the first side end M1*c* side is greater than the frictional force F1 on the second side end M1*d* side, the control section 90 controls the first side end guide member 41 as the side end aligning member, and accordingly, the contact on the first side end M1*c* side is suppressed, and thus, buckling can be suppressed more effectively. When the first side end guide member 41 is selected because the first side end guide member 41 is specified as the side end aligning member, for example, the selected value is 1. At this time, the position of the first position WP1 in the width direction X is a position closer to the first side end M1*c* than to the second side end M1*d*. When the frictional force F1 on the second side end M1*d* side is greater than the frictional force F1 on the first side end M1*c* side, the control section 90 controls the second side end guide member 42 as the side end aligning member, and accordingly, the contact on the second side end M1*d* side is suppressed, and thus, buckling can be suppressed more effectively. When the second side end guide member 42 is selected because the second side end guide member 42 is specified as the side end aligning member, for example, the selected value is 2. At this time, the position of the first position WP1 in the width direction X is a position closer to the second side end M1*d* than to the first side end M1*c*.

The second information may include a subtraction value obtained by subtracting the first lower surface recording density from the first upper surface recording density. The control section 90 may calculate a subtraction value as the second information and adjust the threshold value based on the subtraction value. The control section 90 may determine the control parameter based on the subtraction value as the second information. Then, when the first position WP1 is specified as the standby position WP, the control section 90 may control the side end aligning member to stand by at the first position WP1 with the control parameter. The subtraction value is information relating to the frictional force F1 and is a factor of the frictional force F1. Since the frictional force F1 increases when the subtraction value increases, the control section 90 may lower the threshold value when the subtraction value is equal to or greater than a predetermined value.

The second control section 190 may calculate the subtraction value as the second information. Then, when the medium M1 to be ejected this time is ejected from the recording device 111 to the medium loading device 11, the second control section 190 may notify the control section 90 of the subtraction value as the information relating to the medium M1 to be ejected this time.

The second information may include at least one of the size of the medium M1 to be ejected this time, the basis weight of the medium M1 to be ejected this time, and the type of the medium M1 to be ejected this time. The control section 90 may adjust the threshold value based on at least one of the size of the medium M1 to be ejected this time, the basis weight of the medium M1 to be ejected this time, and the type of the medium M1 to be ejected this time, which is the second information. In addition, the control section 90 may determine the control parameter based on at least one of the size of the medium M1 to be ejected this time, the basis weight of the medium M1 to be ejected this time, and the type of the medium M1 to be ejected this time, which is the second information. Then, when the first position WP1 is specified as the standby position WP, the control section 90 may control the side end aligning member to stand by at the first position WP1 with the control parameter. The size of the medium M1 to be ejected this time, the basis weight of the medium M1 to be ejected this time, and the type of the medium M1 to be ejected this time are information relating to the drag force F2 and are factors of the drag force F2.

The size of the medium M is the medium length B and the medium width A. As the medium length B of the medium M1 to be ejected this time increases, the bending strength decreases, and thus, the drag force F2 becomes smaller and buckling of the medium M1 to be ejected this time becomes easy. As the medium length B of the medium M1 to be ejected this time decreases, the ejection ends before the medium length ejected from the ejecting section 71 of the medium M1 to be ejected this time becomes longer, and thus, the drag force F2 does not become smaller, and the medium M1 to be ejected this time is unlikely to buckle. As the medium width A of the medium M1 to be ejected this time decreases, the bending strength decreases, and thus, the drag force F2 becomes smaller and buckling of the medium M1 to be ejected this time becomes easy. As the medium width A of the medium M1 to be ejected this time increases, the bending strength increases, and thus, the drag force F2 becomes large and the medium M1 to be ejected this time is unlikely to buckle.

When the basis weight of the medium M1 to be ejected this time is small, the bending strength decreases, and thus, the drag force F2 becomes smaller and buckling of the medium M1 to be ejected this time becomes easy. When the basis weight of the medium M1 to be ejected this time is large, the bending strength increases, and thus, the drag force F2 becomes large and the medium M1 to be ejected this time is unlikely to buckle.

Since the bending strength is small depending on the type of the medium M1 to be ejected this time, the drag force F2 decreases and buckling of the medium M1 to be ejected this time becomes easy. Since the bending strength is large depending on the type of the medium M1 to be ejected this time, the drag force F2 increases and the medium M1 to be ejected this time is unlikely to buckle.

The second information may include at least one of the temperature and humidity of the environment in which the medium M1 to be ejected this time is recorded. The control section 90 may adjust the threshold value based on at least one of the temperature and humidity of the environment in which the medium M1 to be ejected this time, which is the second information, is recorded. In addition, the control section 90 may determine the control parameter based on at least one of the temperature and humidity of the environment in which the medium M1 to be ejected this time, which is the second information, is recorded. Then, when the first position WP1 is specified as the standby position WP, the control section 90 may control the side end aligning member to stand by at the first position WP1 with the control parameter with which the side end aligning member is determined based on the second information. The temperature and humidity of the environment in which the medium M1 to be ejected this time is recorded are information relating to the frictional force F1 and are factors of the frictional force F1.

The second information may include the number of media Ms loaded on the processing tray 21 when the medium M1 to be ejected this time is ejected. The control section 90 may adjust the threshold value based on the number of media Ms loaded on the processing tray 21 which is the second information. In addition, the control section 90 may determine the control parameter based on the number of media Ms loaded on the processing tray 21, which is the second information. Then, when the first position WP1 is specified as the standby position WP, the control section 90 may control the side end aligning member to stand by at the first position WP1 with the control parameter with which the side end aligning member is determined based on the number of media Ms loaded on the processing tray 21. Since the storage section 91 stores the information relating to the medium recorded before the ejection at this time, the control section 90 can calculate the number of media Ms loaded on the processing tray 21 when the medium M1 to be ejected this time is ejected. When the number of media Ms loaded on the processing tray 21 is large, the frictional force F1 is large because the distance between the upper surface of the medium M2 ejected previously and the lower surface of the medium M1 to be ejected this time is short. In addition, when the number of media Ms loaded on the processing tray 21 is small, the frictional force F1 is small because the distance between the upper surface of the medium M2 ejected previously and the lower surface of the medium M1 to be ejected this time is far. In other words, the number of media Ms loaded on the processing tray 21 is information relating to the frictional force F1 and is a factor of the frictional force F1.

The second information may include the first elapsed time. The control section 90 may calculate the first elapsed time as the second information and adjust the threshold value based on the first elapsed time. Further, the control section 90 may calculate the first elapsed time as the second information and determine the control parameter based on the first elapsed time as the second information. Then, when the first position WP1 is specified as the standby position WP, the control section 90 may control the side end aligning member to stand by at the first position WP1 with the control parameter determined based on the first elapsed time. When the first elapsed time is short, the medium surface of the medium M1 to be ejected this time is not yet dry, and thus, the first elapsed time is information relating to the frictional force F1 and is a factor of the frictional force F1.

The control section 90 subtracts the time when the medium M2 ejected previously is recorded from the time when the medium M1 to be ejected this time is ejected. Accordingly, the control section 90 can calculate the elapsed time from the recording of the medium M2 ejected previously to the ejection of the medium M1 to be ejected this time. In addition, in the following description, the "elapsed time from the recording of the medium M2 ejected previously to the ejection of the medium M1 to be ejected this time" is simply referred to as "second elapsed time".

The second information may include the second elapsed time. The control section 90 may calculate the second elapsed time as the second information and adjust the threshold value based on the second elapsed time. Further, the control section 90 may calculate the second elapsed time as the second information and determine the control parameter based on the second elapsed time as the second information. Then, when the first position WP1 is specified as the standby position WP, the control section 90 may control the side end aligning member to stand by at the first position WP1 with the control parameter determined based on the second elapsed time. When the second elapsed time is short, the medium surface of the medium M2 ejected previously is not yet dry, and thus, the second elapsed time is information relating to the frictional force F1 and is a factor of the frictional force F1.

The information relating to the medium M1 to be ejected this time may include the first lower surface width direction recording density distribution, or may include the first upper surface width direction recording density distribution. Then, the second upper surface width direction recording density distribution is stored in the storage section 91 that stores the information relating to the medium recorded before the ejection at this time.

The second information may include the first lower surface width direction recording density distribution in the width direction X of the lower surface of the medium M1 to be ejected this time. The control section 90 calculates the side end density difference of the medium M1 to be ejected this time, obtained by subtracting the recording density of the medium surface of the lower surface on the second side end M1*d* side from the recording density of the medium surface of the lower surface on the first side end M1*c* side, in the first lower surface width direction recording density distribution. Then, the control section 90 may adjust the threshold value based on the side end density difference which is the second information. Further, the control section 90 may determine the control parameter based on the side end density difference. Then, when the first position WP1 is specified as the standby position WP, the control section 90 may control the side end aligning member to stand by at the first position WP1 with the control parameter determined based on the side end density difference. In addition, in the following description, the "side end density difference of the medium M1 to be ejected this time, obtained by subtracting the recording density of the medium surface of the lower surface on the second side end M1*d* side from the recording density of the medium surface of the lower surface on the first side end M1*c* side" is simply referred to as "first side end density difference".

As the first side end density difference increases, the frictional force F1 between the medium surfaces on the first side end M1*c* side increases compared to the frictional force F1 between the medium surfaces on the second side end M1*d* side. In addition, as the first side end density difference decreases, the frictional force F1 between the medium surfaces on the second side end M1*d* side increases compared to the frictional force F1 between the medium surfaces on the first side end M1*c* side. In other words, the first side end density difference is information relating to the frictional force F1 and is a factor of the frictional force F1.

The second information may include the second upper surface width direction recording density distribution in the width direction X of the upper surface of the medium M1 to be ejected this time. The control section 90 calculates the side end density difference of the medium M2 ejected previously, obtained by subtracting the recording density of the medium surface of the upper surface on the second side end M1*d* side from the recording density of the medium surface of the upper surface on the first side end M1*c* side, in the second upper surface width direction recording density distribution. Then, the control section 90 may adjust the threshold value based on the side end density difference which is the second information. Further, the control section 90 may determine the control parameter based on the side end density difference. Then, when the first position WP1 is specified as the standby position WP, the control section 90 may control the side end aligning member to stand by at the first position WP1 with the control parameter determined based on the side end density difference. In addition, in the following description, the "side end density difference of the medium M1 ejected previously, obtained by subtracting the recording density of the medium surface of the upper surface on the second side end M1*d* side from the recording density of the medium surface of the upper surface on the first side end M1*c* side" is simply referred to as "second side end density difference".

As the second side end density difference increases, the frictional force F1 between the medium surfaces on the first side end M1*c* side increases compared to the frictional force F1 between the medium surfaces on the second side end M1*d* side. In addition, as the second side end density difference decreases, the frictional force F1 between the medium surfaces on the first side end M1*c* side decreases compared to the frictional force F1 between the medium surfaces on the second side end M1*d* side. In other words, the second side end density difference is information relating to the frictional force F1 and is a factor of the frictional force F1.

Regarding Control Method of Medium Aligning Operation

First, the overview of the control method of the medium aligning operation will be described, and then, regarding the flow of the control method of the medium aligning operation, the control executed by the control section 90 in each step will be described in order. After this, the threshold value adjustment processing subroutine, the control parameter determination processing subroutine, the medium aligning operation subroutine, and the side end aligning operation subroutine, which are subroutines performed in the flow of the control method of the medium aligning operation, will be described in order.

Figure 10:
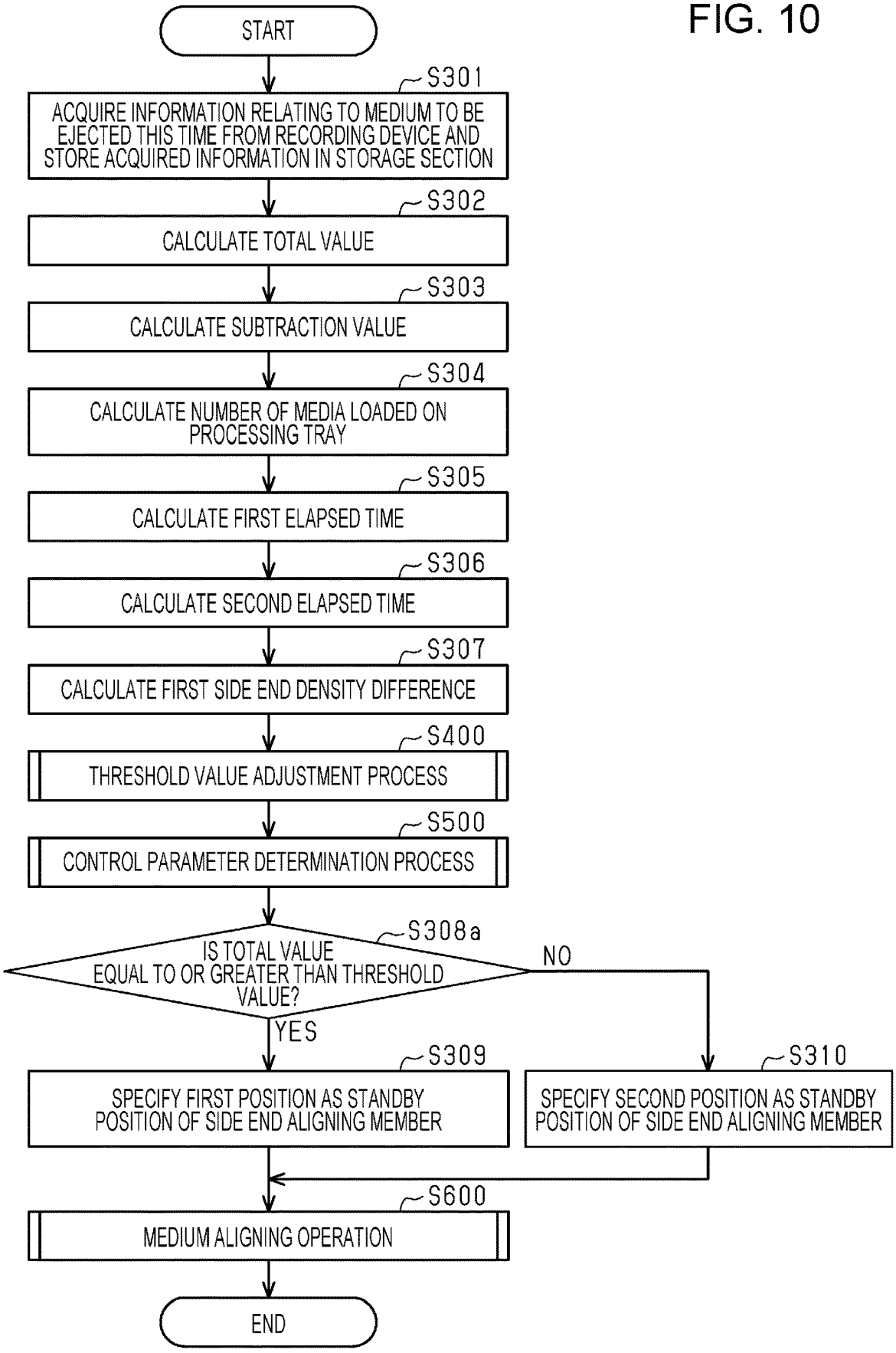
FIG. 10 is a flowchart illustrating a control method of a medium aligning operation according to a first embodiment.

As illustrated in FIG. 10, first, the overview of the control method of the medium aligning operation will be described.

In steps S301 to 307, when the medium M1 to be ejected this time is ejected from the ejecting section 71, the control section 90 acquires the information relating to the medium M1 to be ejected this time from the recording device 111 and stores the acquired information in the storage section 91. Then, the control section 90 selects a plurality of information used for controlling the medium aligning operation from the information relating to the medium M1 to be ejected this time and the information relating to the medium stored in the storage section 91 and ejected up to this time. A calculated value may be calculated based on one of the plurality of information or the plurality of information, and the calculated value may be used as information used for controlling the medium aligning operation. In addition, the medium ejected up to this time includes the medium Ms loaded on the processing tray 21 when the medium M1 to be ejected this time is ejected from the ejecting section 71. In other words, in steps S301 to 307, the first information and the second information to be used for controlling the medium aligning operation are prepared.

In steps S400 to S500, the control section 90 adjusts the threshold value based on the second information. Then, the control section 90 determines the control parameters when the side end aligning member is made to stand by at the first position WP1 based on the second information. The threshold value is a threshold value when the standby position WP is specified by the value based on the first information in steps S308*a* to 309.

In steps S308*a* to 309, the control section 90 determines whether or not the value based on the first information is equal to or greater than the threshold value. In addition, the control section 90 specifies either the first side end guide member 41 or the second side end guide member 42 as the side end aligning member. When the value based on the first information is equal to or greater than the threshold value, the control section 90 specifies the first position WP1 overlapping the medium M1 to be ejected this time in the width direction X as the standby position WP of the side end aligning member. When the value based on the first information is less than the threshold value, the control section 90 specifies the second position WP2 that does not overlap the medium M1 to be ejected this time in the width direction X as the standby position WP of the side end aligning member.

In step S600, the control section 90 executes the medium aligning operation. When the first position WP1 is specified as the standby position WP, the control section 90 controls the side end aligning member to stand by at the first position WP1 with the control parameter determined based on the second information. When the medium aligning operation ends, this flow ends.

As illustrated in FIG. 10, then, regarding the flow of the control method of the medium aligning operation, the control executed by the control section 90 in each step will be described in order. When the medium M1 to be ejected this time, which is recorded by the recording section 160, is ejected from the recording device 111 to the medium loading device 11, and when the second control section 190 notifies the control section 90 of the information relating to the medium M1 to be ejected this time, this flow is started.

In step S301, the control section 90 acquires the information relating to the medium M1 to be ejected this time from the recording device 111 and stores the acquired information in the storage section 91. In step S302, the control section 90 calculates the total value. In step S303, the control section 90 calculates the subtraction value. In step S304, the control section 90 calculates the number of media Ms loaded on the processing tray 21. In step S305, the control section 90 calculates the first elapsed time. In step S306, the control section 90 calculates the second elapsed time. In step S307, the control section 90 calculates the first side end density difference.

In step S400, the control section 90 executes the threshold value adjustment processing subroutine. The threshold value adjustment processing subroutine will be described later. When the threshold value adjustment processing subroutine ends, in step S500, the control section 90 executes the control parameter determination processing subroutine. The control parameter determination processing subroutine will be described later.

When the control parameter determination processing subroutine ends, in step S308*a*, the control section 90 determines whether or not the total value is equal to or greater than the threshold value. When the total value is equal to or greater than the threshold value, step S308*a* becomes YES, and the control section 90 shifts the process to step S309.

In step S309, the control section 90 specifies the first position WP1 as the standby position WP of the side end aligning member. In addition, which of the first side end guide member 41 and the second side end guide member 42 is specified as the side end aligning member in step S509 described later. When the total value is less than the threshold value, step S308*a* becomes NO, and the control section 90 shifts the process to step S310. Then, in step S310, the control section 90 specifies the second position WP2 as the standby position WP of the side end aligning member.

For example, when the first lower surface recording density is 60% and the second upper surface recording density is 60%, the value of the first lower surface recording density is 60 and the value of the second upper surface recording density is 60. At this time, (total value)=(first lower surface recording density)+(second upper surface recording density)=60+60=120. When the threshold value is 100, (total value) (threshold value), the control section 90 determines that the total value is equal to or greater than the threshold value. The higher the recording density, the wetter the medium surface, and the lower the slidability of the medium surface in the medium M. The medium M1 to be ejected this time is ejected while the lower surface of the medium M1 to be ejected this time rubs the upper surface of the medium M2 ejected previously, and thus, as the total value increases, the frictional force F1 increases. Therefore, when the total value is equal to or greater than the threshold value, the control section 90 specifies the first position WP1 as the standby position WP of the side end aligning member. Since the first position WP1 is the standby position WP where the side end aligning member overlaps the medium M1 to be ejected this time in the width direction X, it becomes difficult for the upper surface of the medium M2 ejected previously and the lower surface of the medium M1 to be ejected this time to come into contact with each other.

The first lower surface recording density and the second upper surface recording density may be the recording density of the entire medium surface, or may be the recording density of a part of the medium surface. For example, when the lower surface of the medium M1 to be ejected this time comes into contact with the upper surface of the medium M2 ejected previously, the second upper surface recording density may be the recording density of the tip end part M1*a* of the lower surface of the medium M1 to be ejected this time, which is first contacted.

The first lower surface recording density and the second upper surface recording density may be weighted and added. Since the medium M1 to be ejected this time has a shorter time from the recording compared to the medium M2 ejected previously, the contribution to the frictional force F1 is large. Therefore, the total value may be calculated by weighting such that the contribution of the first lower surface recording density is large. For example, the total value may be added by doubling the weighting of the first lower surface recording density such that (total value)=2×(first lower surface recording density)+(second upper surface recording density). Further, when the time interval in which the medium M is loaded is extremely long, there is a case where the upper surface of the medium M2 ejected previously is already dry when the medium M1 to be ejected this time is ejected. In such a case, the total value may be weighted and added such that the contribution of the second upper surface recording density is eliminated. For example, the total value may be calculated with the weighting coefficient set to "zero" such that (total value)=(first lower surface recording density)+0×(second upper surface recording density).

In step S600, the control section 90 executes the medium aligning operation subroutine. The medium aligning operation subroutine will be described later. When the medium aligning operation subroutine ends, this flow ends.

Regarding Threshold Value Adjustment Processing Subroutine

Figure 11:
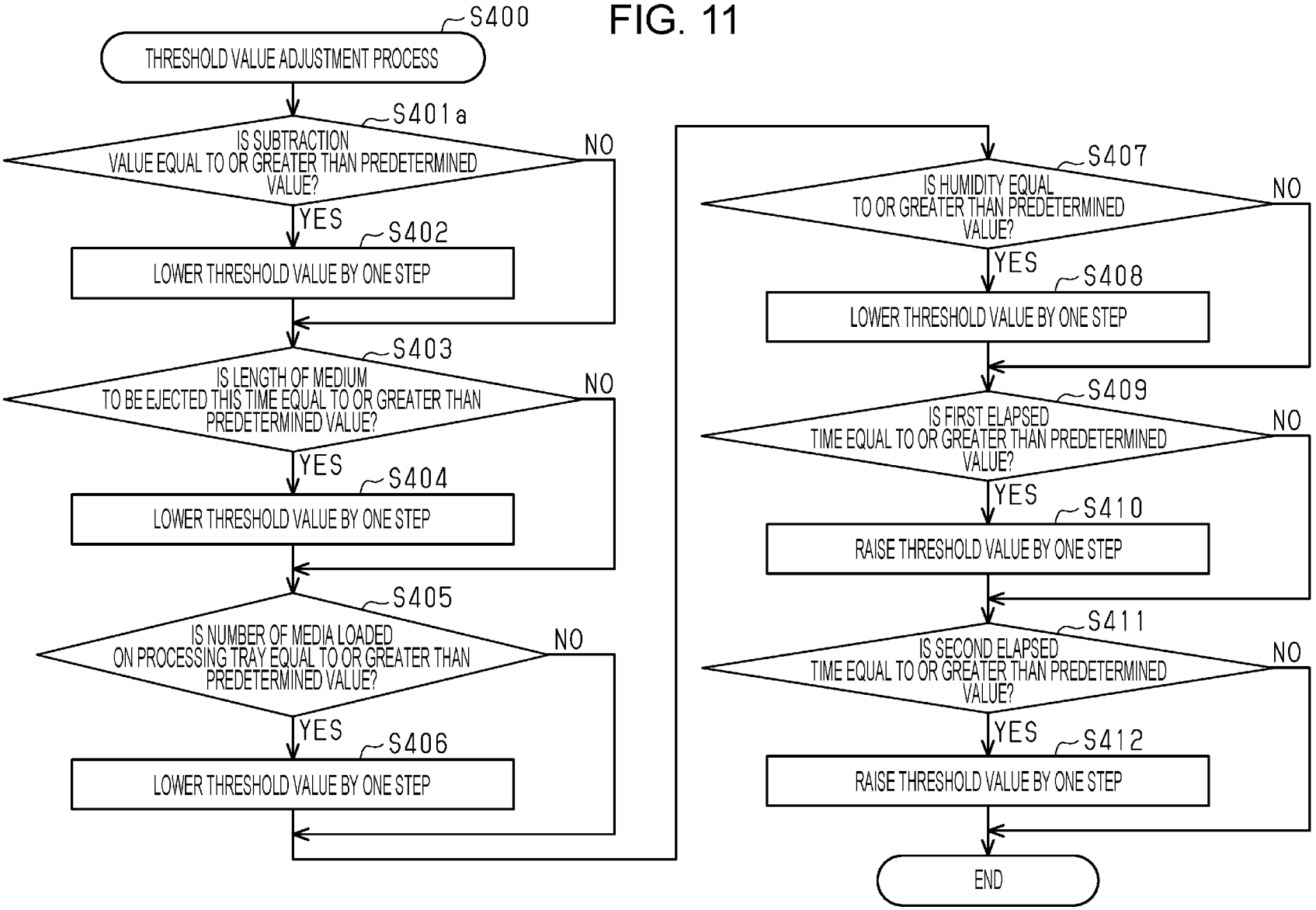
FIG. 11 is a flowchart illustrating a threshold value adjustment process according to the first embodiment.

As illustrated in FIG. 11, regarding the flow of the threshold value adjustment processing subroutine, the control executed by the control section 90 in each step will be described in order.

In step S401*a*, the control section 90 determines whether or not the subtraction value is equal to or greater than a predetermined value. When the subtraction value is equal to or greater than a predetermined value, step S401*a* becomes YES, and the control section 90 shifts the process to step S402. Then, in step S402, the control section 90 lowers the threshold value by one step and shifts the process to step S403. When the subtraction value is less than a predetermined value, step S401*a* becomes NO, and the control section 90 shifts the process to step S403.

For example, when the first upper surface recording density is 100 and the first lower surface recording density is 10, the value of the first upper surface recording density is 100, and the value of the first lower surface recording density is 10. At this time, (subtraction value)=(first upper surface recording density)−(first lower surface recording density)=100−10=90. When the predetermined value is 50, (subtraction value) (predetermined value), and thus, the control section 90 determines that the subtraction value is equal to or greater than the predetermined value. As the tip end of the medium M1 to be ejected this time is more curled downward, the angle at which the tip end part M1*a* of the medium M1 to be ejected this time comes into contact with the medium M2 ejected previously becomes an obtuse angle. In other words, as the subtraction value increases, the lower surface of the medium M1 to be ejected this time is strongly rubbed against the upper surface of the medium M2 ejected previously and loaded. Accordingly, the frictional force F1 increases, and thus, the slidability decreases. Therefore, when the subtraction value is equal to or greater than a predetermined value, the control section 90 lowers the threshold value for specifying the first position WP1 as the standby position WP of the side end aligning member by one step.

When a second predetermined value having a value larger than the predetermined value is provided and the subtraction value is equal to or larger than the second predetermined value, the control section 90 may lower the threshold value by two steps, or more predetermined values may be provided. Further, the control section 90 may raise the threshold value when the subtraction value is less than a predetermined value. When the tip end of the medium M1 to be ejected this time is more curled upward, the angle at which the tip end part M1*a* of the medium M1 to be ejected this time comes into contact with the medium M2 ejected previously becomes an acute angle. Accordingly, the frictional force F1 decreases, and thus, the medium M1 to be ejected this time is unlikely to buckle.

In step S403, the control section 90 determines whether or not the medium length B of the medium M1 to be ejected this time is equal to or greater than a predetermined value. When the medium length B of the medium M1 to be ejected this time is equal to or greater than a predetermined value, step S403 becomes YES, and the control section 90 shifts the process to step S404. Then, in step S404, the control section 90 lowers the threshold value by one step and shifts the process to step S405. When the medium length B of the medium M1 to be ejected this time is less than a predetermined value, step S403 becomes NO, and the control section 90 shifts the process to step S405.

For example, when the medium M1 to be ejected this time is a medium M having an A3 size, the medium length B is 420 mm, and the value of the medium length B is 420. When the predetermined value is 350, (medium length B) (predetermined value), and thus, the control section 90 determines that the medium length B of the medium M1 to be ejected this time is equal to or greater than the predetermined value. As the medium length B of the medium M1 to be ejected this time increases, the bending strength decreases, and thus, the buckling of the medium M1 to be ejected this time becomes easy. Therefore, when the medium length B of the medium M1 to be ejected this time is equal to or greater than a predetermined value, the control section 90 lowers the threshold value for specifying the first position WP1 as the standby position WP of the side end aligning member by one step.

A predetermined value may be provided for the width of the medium M1 to be ejected this time. As the width of the medium M1 to be ejected this time decreases, the bending strength decreases, and thus, the buckling of the medium M1 to be ejected this time becomes easy. Therefore, when the width of the medium M1 to be ejected this time is equal to or less than a predetermined value, the control section 90 may lower the threshold value for specifying the first position WP1 as the standby position WP of the side end aligning member.

A predetermined value may be provided for the basis weight of the medium M or the type of the medium M. For example, when the basis weight of the medium M1 to be ejected this time is small, the bending strength decreases, and thus, buckling of the medium M1 to be ejected this time becomes easy. Therefore, when the basis weight of the medium M1 to be ejected this time is small, the control section 90 may lower the threshold value for specifying the first position WP1 as the standby position WP of the side end aligning member. For example, when the medium M1 to be ejected this time is lateral, the bending strength is small, and thus, buckling of the medium M1 to be ejected this time becomes easy. Therefore, when the medium M1 to be ejected this time is lateral, the control section 90 may lower the threshold value for specifying the first position WP1 as the standby position WP of the side end aligning member. In addition, predetermined values may be provided for other factors that affect the bending strength of the medium M.

In step S405, the control section 90 determines whether or not the number of media M on the processing tray 21 is equal to or greater than a predetermined value. When the number of media Ms loaded on the processing tray 21 is equal to or greater than a predetermined value, step S405 becomes YES, and the control section 90 shifts the process to step S406. Then, in step S406, the control section 90 lowers the threshold value by one step and shifts the process to step S407. When the number of media Ms loaded on the processing tray 21 is less than a predetermined value, step S405 becomes NO, and the control section 90 shifts the process to step S407.

For example, when the number of media Ms loaded on the processing tray 21 is 40, the value of the number of media Ms loaded on the processing tray 21 is 40. When the predetermined value is 10, (the number of media Ms loaded on the processing tray 21) (predetermined value). Therefore, the control section 90 determines that the number of media Ms loaded on the processing tray 21 is equal to or greater than a predetermined value. As the number of media Ms loaded on the processing tray 21 increases, the distance between the upper surface of the medium M2 ejected previously and the lower surface of the medium M1 to be ejected this time is short, the frictional force F1 is large, and thus, buckling of the medium M1 to be ejected this time becomes easy. Therefore, when the number of media Ms loaded on the processing tray 21 is equal to or greater than a predetermined value, the control section 90 lowers the threshold value for specifying the first position WP1 as the standby position WP of the side end aligning member by one step.

The predetermined value may be changed according to the basis weight of the medium Ms loaded on the processing tray 21. As the basis weight of medium Ms loaded on the processing tray 21 increases, the loading height increases, and thus, the distance between the upper surface of the medium M2 ejected previously and the lower surface of the medium M1 to be ejected this time becomes short. Then, buckling of the medium M1 to be ejected this time becomes easy. Further, the predetermined value may be changed according to the type of the medium Ms loaded on the processing tray 21 or recording density. Depending on the type of medium Ms loaded on the processing tray 21 or the recording density, waviness or curl on the medium surface occurs, and there is a case where the loading height increases.

In step S407, the control section 90 determines whether or not the humidity of the environment in which the medium M1 to be ejected this time is recorded is equal to or greater than a predetermined value. When the humidity is equal to or greater than the predetermined value, step S407 becomes YES, and the control section 90 shifts the process to step S408. Then, in step S408, the control section 90 lowers the threshold value by one step and shifts the process to step S409. When the humidity is less than a predetermined value, step S407 becomes NO, and the control section 90 shifts the process to step S409.

In step S409, the control section 90 determines whether or not a first predetermined time is equal to or greater than a predetermined value. When the first predetermined time is equal to or greater than the predetermined value, step S409 becomes YES, and the control section 90 shifts the process to step S410. Then, in step S410, the control section 90 raises the threshold value by one step and shifts the process to step S411. When the first predetermined time is less than a predetermined value, step S409 becomes NO, and the control section 90 shifts the process to step S411.

In step S411, the control section 90 determines whether or not a second predetermined time is equal to or greater than a predetermined value. When the second predetermined time is equal to or greater than the predetermined value, step S411 becomes YES, and the control section 90 shifts the process to step S412. Then, in step S412, the control section 90 raises the threshold value by one step and ends the threshold value adjustment processing subroutine. When a second predetermined time is less than the predetermined value, step S411 becomes NO, and the control section 90 ends the threshold value adjustment processing subroutine.

Regarding Control Parameter Determination Processing Subroutine

Figure 12:
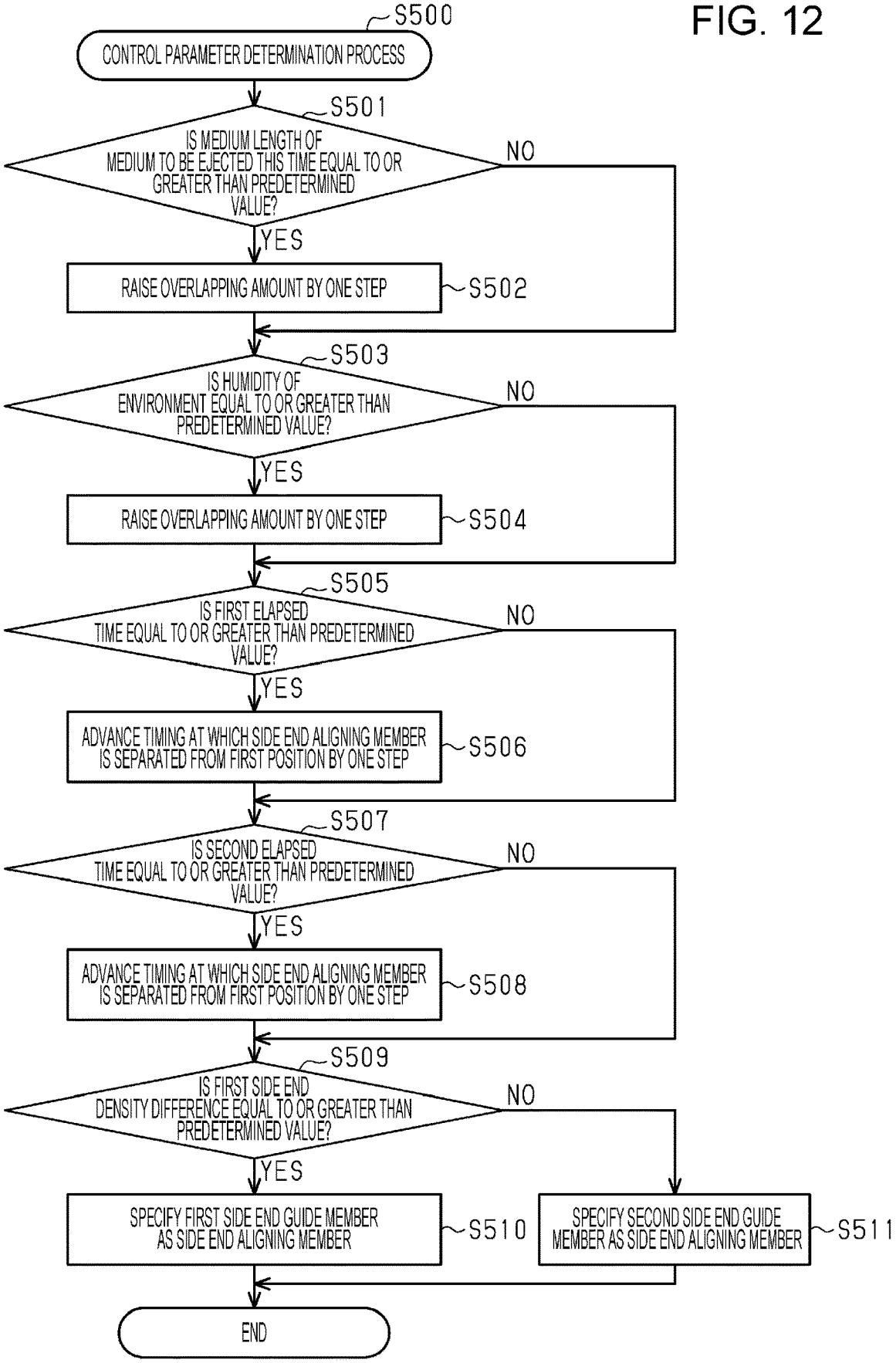
FIG. 12 is a flowchart illustrating a control parameter determination process.

As illustrated in FIG. 12, regarding the flow of the control parameter determination processing subroutine, the control executed by the control section 90 in each step will be described in order.

In step S501, the control section 90 determines whether or not the medium length B of the medium M1 to be ejected this time is equal to or greater than a predetermined value. When the medium length B of the medium M1 to be ejected this time is equal to or greater than a predetermined value, step S501 becomes YES, and the control section 90 shifts the process to step S502. Then, in step S502, the control section 90 raises the overlapping amounts L1 and L2 by one step and shifts the process to step S503. When the medium length B of the medium M1 to be ejected this time is less than a predetermined value, step S501 becomes NO, and the control section 90 shifts the process to step S502.

In step S503, the control section 90 determines whether or not the humidity of the environment in which the medium M1 to be ejected this time is recorded is equal to or greater than a predetermined value. When the humidity is equal to or greater than the predetermined value, step S503 becomes YES, and the control section 90 shifts the process to step S504. Then, in step S504, the control section 90 raises the overlapping amounts L1 and L2 by one step and shifts the process to step S505. When the humidity is less than a predetermined value, step S503 becomes NO, and the control section 90 shifts the process to step S505.

In step S505, the control section 90 determines whether or not the first predetermined time is equal to or greater than a predetermined value. When the first predetermined time is equal to or greater than the predetermined value, step S505 becomes YES, and the control section 90 shifts the process to step S506. Then, in step S506, the control section 90 advances the timing at which the side end aligning member is separated from the first position WP1 by one step, and shifts the process to step S507. When the first predetermined time is less than a predetermined value, step S505 becomes NO, and the control section 90 shifts the process to step S507.

In step S507, the control section 90 determines whether or not the second predetermined time is equal to or greater than a predetermined value. When the second predetermined time is equal to or greater than the predetermined value, step S507 becomes YES, and the control section 90 shifts the process to step S508. Then, in step S508, the control section 90 advances the timing at which the side end aligning member is separated from the first position WP1 by one step, and shifts the process to step S509. When the first predetermined time is less than a predetermined value, step S507 becomes NO, and the control section 90 shifts the process to step S509.

In step S509, the control section 90 determines whether or not the first side end density difference is equal to or greater than a predetermined value. When the first side end density difference is equal to or greater than the predetermined value, step S509 becomes YES, and the control section 90 shifts the process to step S510. Then, in step S510, the control section 90 specifies the first side end guide member 41 as the side end aligning member, and ends the control parameter determination processing subroutine. When the first side end density difference is less than the predetermined value, step S509 becomes NO, and the control section 90 shifts the process to step S511. Then, in step S511, the control section 90 specifies the second side end guide member 42 as the side end aligning member, and ends the control parameter determination processing subroutine.

For example, when the predetermined value is set to "zero" and the first side end density difference is equal to or greater than the predetermined value, in the medium M1 to be ejected this time, the recording density on the first side end M1*c* side is greater than the recording density on the second side end M1*d* side, and thus, the medium surface on the first side end M1*c* side is wetter than the medium surface on the second side end M1*d* side. Therefore, the first side end guide member 41 is specified as the side end aligning member. Then, the contact between the medium surfaces on the first side end M1*c* side, which is the side where the first side end guide member 41 is wet, is suppressed.

Further, two predetermined values may be provided with "zero" in between. For example, the control section 90 may specify the first side end guide member 41 as the side end aligning member when the first side end density difference is equal to or greater than a first predetermined value, and specify the second side end guide member 42 as the side end aligning member when the first side end density difference is less than a second predetermined value. Then, when the first side end density difference is less than the first predetermined value and equal to or greater than the second predetermined value, the control section 90 may specify the guide member having higher productivity as the side end aligning member. In other words, when the first side end density difference is close to "zero", the difference in suppressing buckling is small regardless of which guide member is specified as the side end aligning member, and thus, the control section 90 specifies the guide member having higher productivity as the side end aligning member. For example, when the side end aligning member is not changed from the first side end guide member 41 to the second side end guide member 42 in the middle of processing in the unit of number of copies, it is not necessary to change the position of the medium Ms loaded on the processing tray 21 for aligning the side end of the next medium M, and thus, the productivity increases. For example, when the side end aligning member is changed from the first side end guide member 41 to the second side end guide member 42 at the time of processing the first medium M in the unit of number of copies, the shift processing performed before the ejection of the medium bundle is not required for the medium bundle, and thus, the productivity increases. In other words, when the frictional force F1 is close to equal, the control section 90 properly uses the first side end guide member 41 as the side end aligning member and the second side end guide member 42 as the side end aligning member according to the situation, and accordingly, it is possible to improve the productivity of the medium loading device 11.

The control section 90 may determine whether or not the second side end density difference is equal to or greater than a predetermined value, and may determine whether or not both the first side end density difference and the second side end density difference are equal to or greater than a predetermined value. In addition, the control section 90 may determine whether or not both the first side end density difference and the second side end density difference are equal to or greater than a predetermined value, and when both are equal to or greater than a predetermined value, the control section 90, for example, may determine by the larger density difference between the first side end density difference and the second side end density difference.

Regarding Medium Aligning Operation Subroutine

Figure 13:
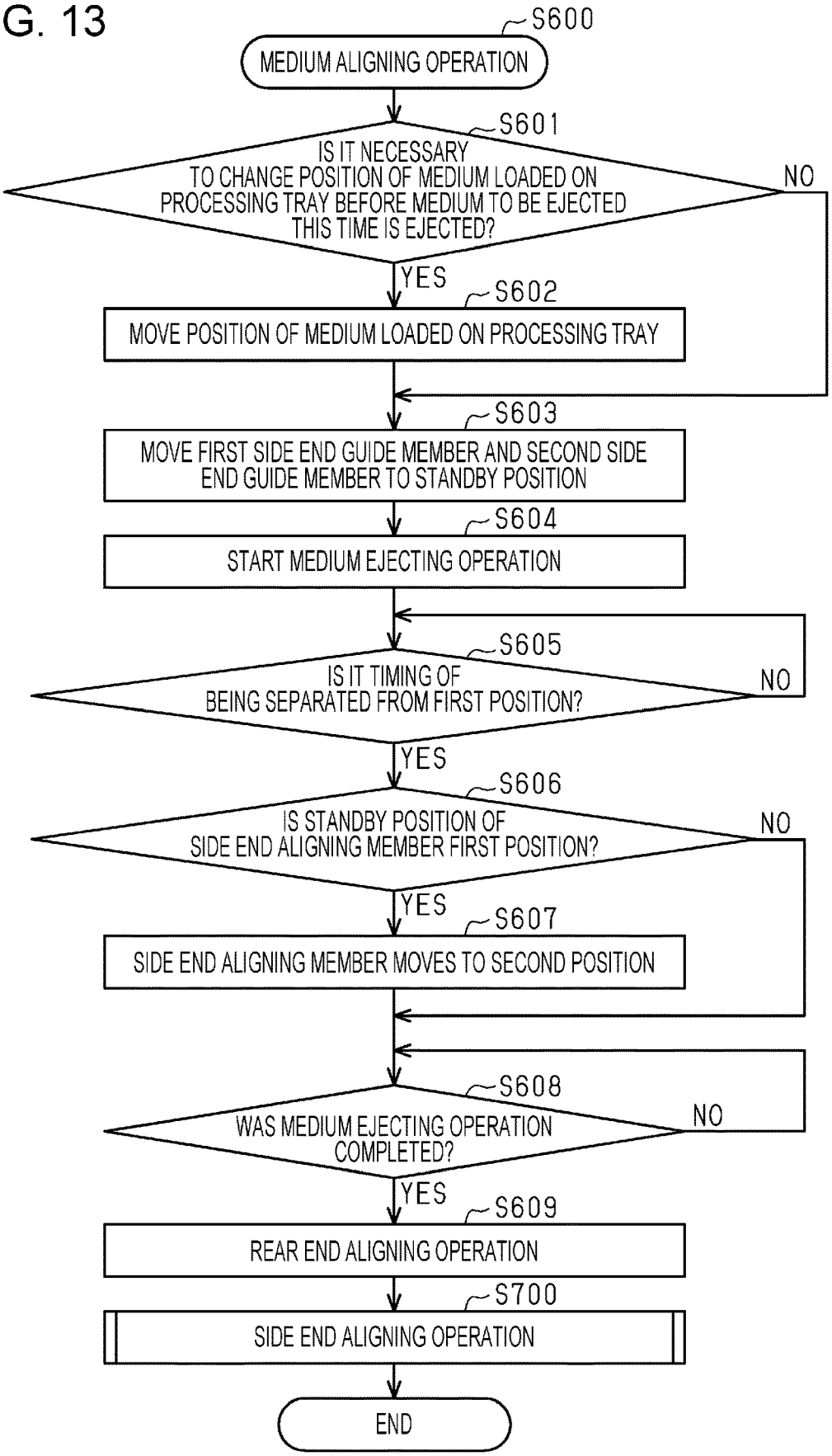
FIG. 13 is a flowchart illustrating the medium aligning operation.

As illustrated in FIG. 13, regarding the flow of the medium aligning operation subroutine, the control executed by the control section 90 in each step will be described in order.

In step S601, the control section 90 determines whether or not it is necessary to change the position of the medium Ms loaded on the processing tray 21 before the medium M1 to be ejected this time is ejected. When the position change is required, step S601 becomes YES, and the control section 90 shifts the process to step S602. Then, in step S602, the control section 90 moves the position of the medium Ms loaded on the processing tray 21 to shift the process to step S603. When the position change is not required, step S601 becomes NO, and the control section 90 shifts the process to step S603.

When the side end aligning operation of the medium M2 ejected previously ends, the aligning surface 41*a* of the first side end guide member 41 abuts against the first side end Msc, and the aligning surface 42*a* of the second side end guide member 42 abuts against the second side end Msd. In this state, when the overlapping amounts L1 and L2 when the medium M1 to be ejected this time is ejected and the overlapping amounts L1 and L2 set when the flowchart illustrated in FIG. 12 ends are different, the control section 90 moves the position of the medium Ms loaded on the processing tray 21. In other words, the shift processing is performed. More specifically, the first side end guide member 41 and the second side end guide member 42 are moved at the same speed, at the same timing, and in the same direction in the width direction X by the same distance. Accordingly, the overlapping amounts L1 and L2 when the medium M1 to be ejected this time is ejected can be set to the overlapping amounts L1 and L2 set when the flowchart illustrated in FIG. 12 ends.

In step S603, the control section 90 moves the first side end guide member 41 and the second side end guide member 42 to the standby position WP. Then, in step S604, the control section 90 starts the medium ejecting operation. In other words, the tip end part M1*a* of the medium M1 to be ejected this time is ejected from the ejecting section 71, and the ejecting operation is started. Then, in step S605, the control section 90 determines whether or not it is the timing when the side end aligning member is separated from the first position WP1. More specifically, the side end aligning member does not move until the timing when the side end aligning member is separated from the first position WP1. In addition, the timing at which the side end aligning member is separated from the first position WP1 is the timing set when the flowchart illustrated in FIG. 12 ends. At the timing at which the side end aligning member is separated from the first position WP1, the step S606 becomes YES, and the control section 90 shifts the process to the step S606.

In step S606, the control section 90 determines whether or not the standby position WP of the side end aligning member is the first position WP1. When the standby position WP of the side end aligning member is the first position WP1, step S606 becomes YES, and the control section 90 shifts the process to step S607. Then, in step S607, the control section 90 moves the side end aligning member to the second position WP2, and shifts the process to step S608. When the standby position WP of the side end aligning member is the second position WP2, step S606 becomes NO, and the control section 90 shifts the process to step S608.

In step S608, the control section 90 determines whether or not the medium ejecting operation was completed. More specifically, the control section 90 determines whether or not the rear end of the medium M1 to be ejected this time is ejected from the ejecting section 71. When the medium ejecting operation ends, step S608 becomes YES, and the control section 90 shifts the process to step S609.

In step S609, the control section 90 performs a rear end aligning operation. When the rear end aligning operation ends, in step S700, the control section 90 executes the subroutine of the side end aligning operation. The subroutine of the side end aligning operation will be described later. When the side end aligning operation subroutine ends, the control section 90 ends the medium aligning operation subroutine.

Figure 14:
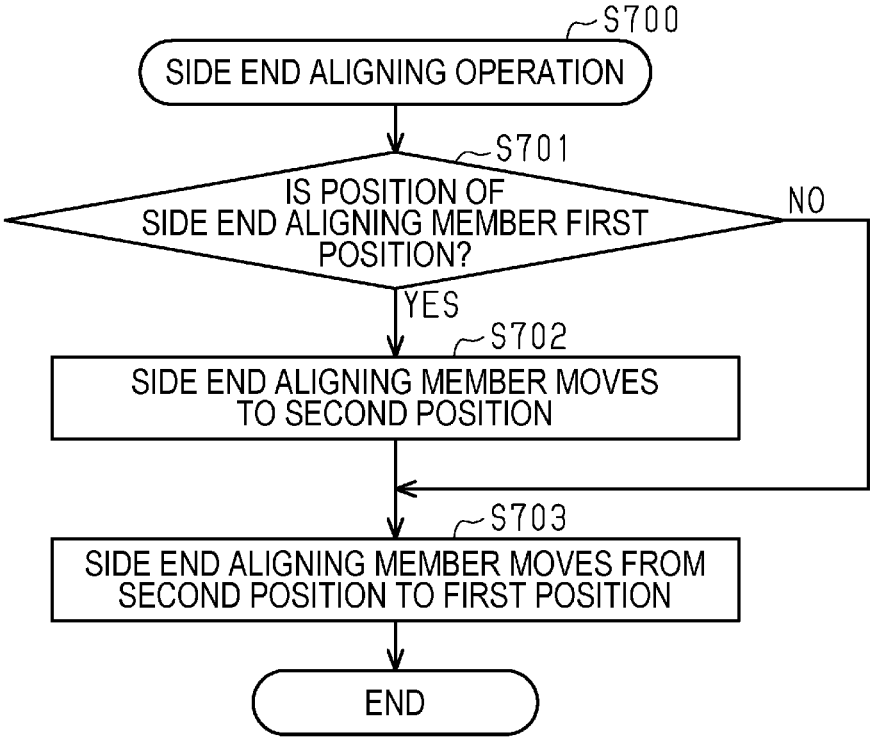
FIG. 14 is a flowchart illustrating a side end aligning operation.

As illustrated in FIG. 14, regarding the flow of the side end aligning operation subroutine performed in step S700 of FIG. 13, the control executed by the control section 90 in each step will be described in order.

In step S701, the control section 90 determines whether or not the position of the side end aligning member is the first position WP1. When the position of the side end aligning member is the first position WP1, step S701 becomes YES, and the control section 90 shifts the process to step S702. Then, in step S702, the control section 90 moves the side end aligning member to the second position WP2, and shifts the process to step S703. When the position of the side end aligning member is the second position WP2, step S701 becomes NO, and the control section 90 shifts the process to step S703.

When buckling of the medium M1 to be ejected this time becomes easy, there is a case where the side end aligning member is positioned at the first position WP1 until the medium ejecting operation ends. In other words, there is a case where the position of the side end aligning member when the medium ejecting operation ends is the first position WP1. At this time, the control section 90 once moves the side end aligning member to the second position WP2.

In step S703, the control section 90 moves the side end aligning member from the second position WP2 to the first position WP1. Accordingly, the side ends M1*c* and M1*d* of the medium M1 to be ejected this time are aligned. More specifically, when the first side end guide member 41 is specified as the side end aligning member, the first side end guide member 41 aligns the first side end M1*c* of the medium M1 to be ejected this time with the first side end Msc of the medium Ms loaded on the processing tray 21. When the second side end guide member 42 is specified as the side end aligning member, the second side end guide member 42 aligns the second side end M1*d* of the medium M1 to be ejected this time with the second side end Msd of the medium Ms loaded on the processing tray 21. When the side end aligning member moves from the second position WP2 to the first position WP1, the control section 90 ends the side end aligning operation subroutine.

Action of Embodiment

The action of the present embodiment will be described.

In the present embodiment, under the standard recording conditions, the largest total value at which buckling does not occur is set as the threshold value. The largest total value at which buckling does not occur is determined experimentally, for example. In addition, the standard recording condition may be an average recording condition or the most commonly used recording condition. The method of determining the standard recording conditions is not limited.

An example of the standard recording conditions is described below. In the medium M, a vertical paper sheet having A4 size and 80 gsm is used in vertical feed. Images of standard resolution are recorded on both surfaces of the medium M, and there is no difference in recording density in the width direction X. The same image is recorded on any medium M. The temperature and humidity of the environment in which the medium M is recorded is 22 degrees and 65%. The number of media Ms loaded on the processing tray 21 when the medium M is ejected is 5. When the above-described conditions are standard recording conditions, and when the largest total value at which buckling does not occur is 80, the threshold value of the total value is set to 80. In other words, the threshold value before being adjusted based on the second information is 80. In addition, "gsm" is a unit of basis weight of medium M. There are vertical and horizontal directions in the paper grain direction, and the paper grain direction is an example of the type of medium M. Further, the vertical feed means a feeding direction in which the long side of the paper sheet is parallel to the transport direction.

An example of actual recording conditions is described below. In the medium M, a vertical paper sheet having A3 size and 80 gsm is used in vertical feed. High-resolution images are recorded on both surfaces of the medium M, and the upper surface recording density is 50% and the lower surface recording density is 20%. There is a difference in recording density in the width direction X, and the first side end density difference is 20. The same image is recorded on any medium M. The temperature and humidity of the environment in which the medium M is recorded is 22 degrees and 85%. The number of media Ms loaded on the processing tray 21 when the medium M is ejected is 20. When the above-described conditions are the actual recording conditions, the total value as the value based on the first information is (total value)=(first lower surface recording density)+(second upper surface recording density)=20+50=70.

The total value is 70, and the threshold value of the total value before being adjusted based on the second information is 80. In other words, when the threshold value is not adjusted based on the second information, (total value)< (threshold value). Since the total value is less than the threshold value, the second position WP2 is specified as the standby position WP when the threshold value is not adjusted based on the second information.

The threshold value is adjusted based on the second information. In the present embodiment, the threshold value is adjusted when the value based on the second information is equal to or greater than a predetermined value. The threshold value may be adjusted when the value based on the second information is equal to or less than a predetermined value. In other words, the threshold value is adjusted when the value based on the second information deviates from a predetermined range. When the value based on the second information deviates from the predetermined range, there is a large discrepancy between the frictional force F1 under the standard recording conditions assumed from the value based on the first information and the frictional force F1 under the actual recording conditions. Otherwise, there is a large discrepancy between the drag force F2 under the standard recording conditions and the drag force F2 under the actual recording conditions. Therefore, the control section 90 changes the control to suit the actual recording conditions by adjusting the threshold value when the value based on the second information deviates from the predetermined range.

When the control section 90 calculates the subtraction value obtained by subtracting the first lower surface recording density from the first upper surface recording density, (subtraction value)=(first upper surface recording density)−(first lower surface recording density)=50−20=30. For example, when the predetermined value of the subtraction value as the second information is 25, and the subtraction value exceeds 25, there is a large discrepancy between the frictional force F1 under the standard recording conditions assumed from the value based on the first information and the frictional force F1 under the actual recording conditions, and thus, the threshold value is adjusted. Since (subtraction value) (predetermined value), the control section 90 lowers the threshold value by one step. When the value for one step of the threshold value is 15, (threshold value)=80-15=65. In addition, the method of determining the value for one step is not limited.

The value of the medium length B of the medium M1 to be ejected this time as the second information is 420. Assuming that the predetermined value of the medium length B of the medium M1 to be ejected this time is 350, (medium length B) (predetermined value), and thus, the control section 90 lowers the threshold value by one step. When the value for one step of the threshold value is 15, (threshold value)=65-15=50. In addition, the control section 90 may adjust the threshold value based on the type of the medium M1 to be ejected this time as the second information and the basis weight of the medium M1 to be ejected this time as the second information.

The value of the number of media Ms loaded on the processing tray 21 as the second information is 20. Assuming that the predetermined value of the number of media Ms loaded on the processing tray 21 is 10, (number of media Ms loaded on the processing tray 21) (predetermined value), the control section 90 lowers the threshold value by one step. When the value for one step of the threshold value is 15, (threshold value)=50−15=35.

The value of the humidity of the environment in which the medium M1 to be ejected this time as the second information is recorded is 85. Assuming that the predetermined value of the humidity of the environment in which the medium M is recorded is 75, (humidity of the environment in which the medium M1 to be ejected this time is recorded) (predetermined value), the control section 90 lowers the threshold value by one step. When the value for one step of the threshold value is 15, (threshold value)=35−15=20. In addition, the control section 90 may adjust the threshold value based on the temperature of the environment in which the medium M as the second information is recorded.

Since the recording time becomes long when a high-resolution image is recorded on both surfaces, the first elapsed time as the second information from the recording of the medium M1 to be ejected this time to the ejection is longer than the first elapsed time in the standard recording condition, and satisfies (first elapsed time) (predetermined value). The control section 90 raises the threshold value by one step. When the value for one step of the threshold value is 15, (threshold value)=20+15=35.

Since the high-resolution image is recorded on both surfaces, the second elapsed time as the second information from the recording of the medium M2 ejected previously to the ejection of the medium M1 to be ejected this time is longer than the second elapsed time in the standard recording condition, and satisfies (second elapsed time) (predetermined value). The control section 90 raises the threshold value by one step. When the value for one step of the threshold value is 15, (threshold value)=35+15=50.

In this manner, the threshold value is adjusted based on the second information. The total value as a value based on the first information is 70, and the threshold value after adjustment based on the second information is 50. In other words, after the threshold value is adjusted based on the second information, (total value)>(threshold value). Since the total value is equal to or greater than the threshold value, the first position WP1 is specified as the standby position WP when the threshold value is adjusted based on the second information. In this example, when the threshold value is not adjusted based on the second information, the second position WP2 is specified as the standby position WP, and when the threshold value is adjusted based on the second information, the first position WP1 is specified as the standby position WP.

The total value as the value based on the first information is the information relating to the frictional force F1 and is a factor of the frictional force F1. Therefore, the total value is used for controlling the medium aligning operation as a factor of the ease of buckling in the medium M1 to be ejected this time. However, in addition to the total value, there are other factors that make it easier to buckle. The ease of buckling of the medium M1 to be ejected this time is caused by the frictional force F1 and the drag force F2.

Therefore, the information relating to the frictional force F1 other than the first information and the information relating to the drag force F2 are used as the second information for controlling the medium aligning operation, and accordingly, a more appropriate standby position WP can be selected.

The control parameters are determined based on the second information. In the present embodiment, the control parameter is changed from the reference value when the value based on the second information is equal to or greater than a predetermined value. The control parameter may be changed from the reference value when the value based on the second information is equal to or less than a predetermined value. In other words, when the value based on the second information deviates from the predetermined range, the control parameter is changed from the reference value. When the value based on the second information deviates from the predetermined range, there is a large discrepancy between the frictional force F1 under the standard recording conditions assumed from the value based on the first information and the frictional force F1 under the actual recording conditions. Otherwise, there is a large discrepancy between the drag force F2 under the standard recording conditions and the drag force F2 under the actual recording conditions. Therefore, the control section 90 changes the control to suit the actual recording conditions by changing the control parameter when the value based on the second information deviates from the predetermined range.

Since (medium length B) (predetermined value), the control section 90 raises the overlapping amounts L1 and L2, which are control parameters, by one step based on the medium length B of the medium M1 to be ejected this time as the second information. In other words, the control section 90 performs control such that the medium M1 to be ejected this time and the side end aligning member at the first position WP1 overlap each other more. In addition, the control section 90 may change the timing at which the side end aligning member is separated from the first position WP1 based on the medium length B of the medium M1 to be ejected this time. Further, the control section 90 may change the overlapping amounts L1 and L2 based on the type of the medium M1 to be ejected this time as the second information and the basis weight of the medium M1 to be ejected this time as the second information, and may change the timing at which the side end aligning member is separated from the first position WP1.

Since (humidity of environment) (predetermined value), the control section 90 further raises the overlapping amounts L1 and L2, which are control parameters, by one step based on the humidity of the environment in which the medium M1 to be ejected this time as the second information is recorded. In other words, the control section 90 performs control such that the medium M1 to be ejected this time and the side end aligning member at the first position WP1 further overlap each other. In addition, the control section 90 may change the timing at which the side end aligning member is separated from the first position WP1 based on the humidity of the environment in which the medium M1 to be ejected this time is recorded. Further, the control section 90 may change the overlapping amounts L1 and L2 based on the temperature of the environment in which the medium M1 to be ejected this time as the second information is recorded, and may change the timing at which the side end aligning member is separated from the first position WP1.

It is assumed that (first elapsed time) (predetermined value) is satisfied. The control section 90 advances the timing at which the side end aligning member is separated from the first position WP1 by one step based on the first elapsed time as the second information. In other words, the control section 90 changes the control such that the side end aligning operation ends earlier. In addition, the control section 90 may change the overlapping amounts L1 and L2 based on the first elapsed time.

It is assumed that (second elapsed time) (predetermined value) is satisfied. The control section 90 further advances the timing at which the side end aligning member is separated from the first position WP1 by one step based on the second elapsed time as the second information. In other words, the control section 90 changes the control such that the side end aligning operation ends earlier. In addition, the control section 90 may change the overlapping amounts L1 and L2 based on the second elapsed time.

The control section 90 may determine the control parameter based on the subtraction value as the second information. In addition, the control section 90 may determine the control parameter based on the number of media Ms loaded on the processing tray 21, which is the second information.

In the present embodiment, the "selection to specify either the first side end guide member 41 or the second side end guide member 42 as the side end aligning member" as the control parameter is determined based on the first side end density difference as the second information. The first side end density difference as the second information is 20. Assuming that the predetermined value in the first side end density difference is "zero", (first side end density difference) (predetermined value), and thus, the control section 90 specifies the first side end guide member 41 as a side end aligning member. In other words, the control section 90 specifies the aligning member on the side end side where the medium M1 to be ejected this time is wet as the side end aligning member, and performs control such that the medium M1 to be ejected this time and the side end aligning member at the first position WP1 on the side end side on which the medium M1 to be ejected this time is wet, overlap each other. In addition, the "selection for specifying either the first side end guide member 41 or the second side end guide member 42 as the side end aligning member" may be determined based on the second side end density difference as the second information, and may be determined based on both the first side end density difference and the second side end density difference.

Effect of Embodiment

The effect of the present embodiment will be described.

In the medium loading device 11 and the image forming system 200 of the present embodiment, the following effects can be obtained.

(1) When there is a large discrepancy between the frictional force F1 under the standard recording conditions assumed from the value based on the first information and the frictional force F1 under the actual recording conditions, the control section 90 adjusts the threshold value based on the second information. In addition, when there is a large discrepancy between the drag force F2 under the standard recording conditions and the drag force F2 under the actual recording conditions, the control section 90 adjusts the threshold value based on the second information. By adjusting the threshold value based on the second information, the first position WP1 is more likely to be specified as the standby position WP when buckling of the medium M is more likely to occur than in a case where the threshold value is not adjusted. Further, when buckling of the medium M is unlikely to occur, it is unlikely to specify the first position WP1 as the standby position WP. In other words, buckling of the medium M can be suppressed even when the slidability of the medium M is lower than expected from the recording density. In addition, when the slidability of the medium M is not as low as expected from the recording density, it is possible to suppress the decrease in productivity of the medium loading device 11. In other words, as compared with a case where the control section 90 controls the side end aligning member only with the first information relating to the recording density of at least one medium among the medium M1 to be ejected this time and the medium M2 ejected previously, it is possible to improve the productivity of the medium loading device 11 while suppressing buckling of the medium M.

(2) When there is a large discrepancy between the frictional force F1 under the standard recording conditions assumed from the value based on the first information and the frictional force F1 under the actual recording conditions, the control section 90 determines the control parameter when the side end aligning member stands by at the first position WP1, based on the second information. Then, when the first position WP1 is specified as the standby position WP, the control section 90 controls the side end aligning member to stand by at the first position WP1 with the control parameter. In addition, when there is a large discrepancy between the drag force F2 under the standard recording conditions and the drag force F2 under the actual recording conditions, the control section 90 determines the control parameter when the side end aligning member stands by at the first position WP1, based on the second information. Then, when the first position WP1 is specified as the standby position WP, the control section 90 controls the side end aligning member to stand by at the first position WP1 with the control parameter. More specifically, position of the first position WP1 in the width direction X and the time for the side end aligning member to stand by at the first position WP1 are changed within a range in which the influence on buckling or the influence on productivity is small. Accordingly, the movement required for the movement of the side end aligning member when the first position WP1 is specified as the standby position WP increases or becomes larger. In addition, unnecessary movement in the movement of the side end aligning member when the first position WP1 is specified as the standby position WP is eliminated or decreases. In other words, buckling of the medium M can be suppressed even when the slidability of the medium M is lower than expected from the recording density. In addition, when the slidability of the medium M is not as low as expected from the recording density, it is possible to suppress the decrease in productivity of the medium loading device 11. In other words, as compared with a case where the control section 90 controls the side end aligning member only with the first information relating to the recording density of at least one medium among the medium M1 to be ejected this time and the medium M2 ejected previously, it is possible to improve the productivity of the medium loading device 11 while suppressing buckling of the medium M.

(3) The second information includes the subtraction value obtained by subtracting the first lower surface recording density from the first upper surface recording density. As the subtraction value increases, the tip end part M1*a* of the medium M1 to be ejected this time due to the difference in moisture content between the upper surface and the lower surface of the medium M1 to be ejected this time curls downward. In other words, as the subtraction value increases, the angle at which the tip end part M1*a* of the medium M1 to be ejected this time comes into contact with the medium M2 ejected previously becomes an obtuse angle, and thus, the lower surface of the medium M1 to be ejected this time and the upper surface of the medium M2 ejected previously come into strong contact with each other. Accordingly, the frictional force F1 increases, and thus, the slidability decreases. When the subtraction value is equal to or greater than the predetermined value, the control section 90 lowers the threshold value more than when the subtraction value is less than the predetermined value. When the subtraction value is less than the predetermined value, the control section 90 may raise the threshold value more than when the subtraction value is equal to or greater than the predetermined value. When the frictional force F1 increases as the angle when the tip end part M1*a* of the medium M1 to be ejected this time comes into contact with the medium M2 ejected previously becomes an obtuse angle, it is possible to suppress buckling of the medium M1 to be ejected this time. Further, when the frictional force F1 decreases as the angle when the tip end part M1*a* of the medium M1 to be ejected this time comes into contact with the medium M2 ejected previously becomes an acute angle, it is possible to suppress the decrease in the productivity of the medium loading device 11.

(4) The second information includes at least one of the size of the medium M1 to be ejected this time, the basis weight of the medium M1 to be ejected this time, and the type of the medium M1 to be ejected this time. Depending on the size of the medium M1 to be ejected this time, the basis weight of the medium M1 to be ejected this time, and the type of the medium M1 to be ejected this time, the drag force F2 that resists against buckling in the medium M1 to be ejected this time changes. In other words, depending on the size of the medium M1 to be ejected this time, the basis weight of the medium M1 to be ejected this time, and the type of the medium M1 to be ejected this time, there is a case where there is a large discrepancy between the drag force F2 in the standard medium M and the drag force F2 in the medium M1 to be ejected this time. The control section 90 may adjust the threshold value based on at least one of the size of the medium M1 to be ejected this time, the basis weight of the medium M1 to be ejected this time, and the type of the medium M1 to be ejected this time. The control section 90 may determine the control parameter when the side end aligning member stands by at the first position WP1 based on at least one of the size of the medium M1 to be ejected this time, the basis weight of the medium M1 to be ejected this time, and the type of the medium M1 to be ejected this time. Then, when the first position WP1 is specified as the standby position WP, the control section 90 may control the side end aligning member to stand by at the first position WP1 with the control parameter. Accordingly, when the drag force F2 is small, it is possible to suppress buckling of the medium M1 to be ejected this time. Further, when the drag force F2 in the medium M1 to be ejected this time is sufficiently greater than the frictional force F1, it is possible to suppress the decrease in the productivity of the medium loading device 11.

(5) The second information includes at least one of the temperature and humidity of the environment in which the medium M1 to be ejected this time is recorded. When the humidity of the environment in which the medium M1 to be ejected this time is recorded is high, it takes time for the medium surface to dry, and when the humidity of the environment in which the medium M1 to be ejected this time is recorded is low, it does not take time for the medium surface to dry. Further, when the temperature of the environment in which the medium M1 to be ejected this time is recorded is low, improvement in the water containing state due to the drying process is not observed, and it takes time for the medium surface to dry. When the temperature of the environment in which the medium M1 to be ejected this time is recorded is high, it does not take time for the medium surface to dry. The control section 90 may adjust the threshold value based on at least one of the temperature and humidity of the environment in which the medium M1 to be ejected this time is recorded. The control section 90 may determine the control parameter when the side end aligning member stands by at the first position WP1 based on at least one of the temperature and the humidity of the environment in which the medium M1 to be ejected this time is recorded. Then, when the first position WP1 is specified as the standby position WP, the control section 90 may control the side end aligning member to stand by at the first position WP1 with the control parameter. Accordingly, when the medium M1 to be ejected this time and the medium M2 ejected previously are not dried, it is possible to suppress buckling of the medium M1 to be ejected this time. Further, when the medium M1 to be ejected this time and the medium M2 ejected previously are dried and the water content is sufficiently small, it is possible to suppress the decrease in the productivity of the medium loading device 11.

(6) The second information includes the number of media Ms loaded on the processing tray 21 when the medium M1 to be ejected this time is ejected. When the number of media Ms loaded on the processing tray 21 is large, the distance between the upper surface of the medium M2 ejected previously and the lower surface of the medium M1 to be ejected this time is short, and the frictional force F1 is large. In addition, when the number of media Ms loaded on the processing tray 21 is small, the distance between the upper surface of the medium M2 ejected previously and the lower surface of the medium M1 to be ejected this time is far, and the frictional force F1 is small. The control section 90 may adjust the threshold value based on the number of media Ms loaded on the processing tray 21 when the medium M1 to be ejected this time is ejected. The control section 90 may determine the control parameter when the side end aligning member stands by at the first position WP1 based on the number of media Ms loaded on the processing tray 21 when the medium M1 to be ejected this time is ejected. Then, when the first position WP1 is specified as the standby position WP, the control section 90 may control the side end aligning member to stand by at the first position WP1 with the control parameter. Accordingly, when the frictional force F1 increases as the number of media Ms loaded on the processing tray 21 increases, it is possible to suppress buckling of the medium M1 to be ejected this time. Further, when the frictional force F1 decreases as the number of media Ms loaded on the processing tray 21 decreases, it is possible to suppress the decrease in the productivity of the medium loading device 11.

(7) The second information includes the first elapsed time from the recording of the medium M1 to be ejected this time to the ejection. When the first elapsed time is short, the medium surface of the medium M1 to be ejected this time was not dried. When the first elapsed time is long, the medium surface of the medium M1 to be ejected this time is dried. The control section 90 may adjust the threshold value based on the first elapsed time. The control section 90 may determine the control parameters when the side end aligning member is made to stand by at the first position WP1 based on the first elapsed time. Then, when the first position WP1 is specified as the standby position WP, the control section 90 may control the side end aligning member to stand by at the first position WP1 with the control parameter. Accordingly, when the medium M1 to be ejected this time is not dried, it is possible to suppress buckling of the medium M1 to be ejected this time. Further, when the medium M1 to be ejected this time is dried and the water content is sufficiently small, it is possible to suppress the decrease in the productivity of the medium loading device 11.

(8) The second information includes the second elapsed time from the recording of the medium M2 ejected previously to the ejection of the medium M1 to be ejected this time. When the second elapsed time is short, the medium surface of the medium M2 ejected previously was not dried. When the second elapsed time is long, the medium surface of the medium M2 ejected previously is dried. The control section 90 may adjust the threshold value based on the second elapsed time. The control section 90 may determine the control parameters when the side end aligning member is made to stand by at the first position WP1 based on the second elapsed time. Then, when the first position WP1 is specified as the standby position WP, the control section 90 may control the side end aligning member to stand by at the first position WP1 with the control parameter. Accordingly, when the medium M2 ejected previously is not dried, it is possible to suppress buckling of the medium M1 to be ejected this time. Further, when the medium M2 ejected previously is dried and the water content is sufficiently small, it is possible to suppress the decrease in the productivity of the medium loading device 11.

(9) The control parameters for making the side end aligning member stand by at the first position WP1 when the first position WP1 is specified as the standby position WP include the overlapping amounts L1 and L2. When the overlapping amounts L1 and L2 are large, the contact between the medium M1 to be ejected this time and the medium M2 ejected previously can be further suppressed. In other words, the control section 90 determines the overlapping amounts L1 and L2 based on the second information and controls the side end aligning member with the overlapping amounts L1 and L2 when the first position WP1 is specified as the standby position WP, and accordingly, it is possible to further suppress buckling of the medium M1 to be ejected this time. In addition, when the overlapping amounts L1 and L2 are reduced, the moving distance to the second position WP2 decreases even when the timing at which the side end aligning member is separated from the first position WP1 and starts moving toward the second position WP2 is the same. Therefore, after the rear end of the medium M1 to be ejected this time is ejected from the ejecting section 71, it is possible to shorten the time until the first side end M1*c* of the medium M1 to be ejected this time is aligned with the first side end Msc of the medium Ms loaded on the processing tray 21. In other words, the control section 90 determines the overlapping amounts L1 and L2 based on the second information and controls the side end aligning member with the overlapping amounts L1 and L2 when the first position WP1 is specified as the standby position WP, and accordingly, it is possible to suppress the decrease in the productivity of the medium loading device 11.

(10) The control parameters for making the side end aligning member stand by at the first position WP1 when the first position WP1 is specified as the standby position WP include the timing when the side end aligning member moves from the first position WP1. When this timing is advanced, the side end aligning operation can be started at the same time when the rear end of the medium M1 to be ejected this time is ejected from the ejecting section 71. In other words, the control section 90 determines the timing based on the second information and controls the side end aligning member with the timing when the first position WP1 is specified as the standby position WP, and accordingly, it is possible to further suppress the decrease in the productivity of the medium loading device 11. When this timing is delayed, the contact between the medium M1 to be ejected this time and the medium M2 ejected previously can be suppressed until the rear end of the medium M1 to be ejected this time is ejected from the ejecting section 71. In other words, the control section 90 determines the timing based on the second information and controls the side end aligning member with the timing when the first position WP1 is specified as the standby position WP, and accordingly, it is possible to further suppress buckling of the medium M1 to be ejected this time.

(11) The second information includes at least one of the first lower surface width direction recording density distribution and the second upper surface width direction recording density distribution. In addition, the control parameters for making the side end aligning member stand by at the first position WP1 when the first position WP1 is specified as the standby position WP include the selection for specifying either the first side end guide member 41 or the second side end guide member 42 as the side end aligning member. On the lower surface of the medium M1 to be ejected this time, according to the first lower surface width direction recording density distribution, which is the second information, the control section 90 can determine which the frictional force F1 is greater among the frictional force F1 of the medium surface on the first side end M1*c* side and the frictional force F1 of the medium surface on the second side end M1*d* side. In addition, on the upper surface of the medium M1 to be ejected this time, according to the first upper surface width direction recording density distribution, which is the second information, the control section 90 can determine which the frictional force F1 is greater among the frictional force F1 of the medium surface on the first side end M1*c* side and the frictional force F1 of the medium surface on the second side end M1*d* side. In addition, the control section 90 specifies the side end guide member on the side where the frictional force F1 is large as the side end aligning member, and controls the side end guide member on the side where the frictional force F1 is large as the side end aligning member. Accordingly, the contact with the medium surface on the side end side having a large frictional force F1 is suppressed, and thus, buckling of the medium M1 to be ejected this time can be suppressed more effectively. In addition, when the frictional force F1 is close to equal, the control section 90 properly uses the first side end guide member 41 as the side end aligning member and the second side end guide member 42 as the side end aligning member according to the situation, and accordingly, it is possible to improve the productivity of the medium loading device 11.

Second Embodiment

Hereinafter, a second embodiment will be described with reference to the accompanying drawings. Since the second embodiment is substantially the same as that of the first embodiment, the same configurations will be given the same reference numerals, and duplicate description thereof will be omitted.

Regarding First Information and Second Information

In the present embodiment, the first information is the first upper surface recording density and the first lower surface recording density. In addition, the value based on the first information is the subtraction value obtained by subtracting the first lower surface recording density from the first upper surface recording density, and is a value based on the information relating to the recording density of the medium M1 to be ejected this time. The control section 90 calculates the subtraction value obtained by subtracting the first lower surface recording density from the first upper surface recording density, and controls the side end aligning operation using the subtraction value. In addition, the "threshold value" is, in the present embodiment, a threshold value in the subtraction value.

The medium M1 to be ejected this time is ejected while the lower surface of the tip end part M1*a* of the medium M1 to be ejected this time rubs the upper surface of the medium M2 ejected previously. As the subtraction value increases, the tip end part M1*a* of the medium M1 to be ejected this time more curls downward. The subtraction value is information indicating the ease of curling downward of the medium M1. In other words, as the subtraction value increases, the angle at which the tip end part M1*a* of the medium M1 to be ejected this time comes into contact with the medium M2 ejected previously becomes an obtuse angle, and thus, the lower surface of the medium M1 to be ejected this time and the upper surface of the medium M2 ejected previously come into strong contact with each other. Accordingly, the frictional force F1 becomes large and buckling becomes easy. The subtraction value as the value based on the first information is the information relating to the frictional force F1 and is a factor of the frictional force F1. Therefore, in the present embodiment, the subtraction value is used for controlling the medium aligning operation as a factor of the ease of buckling in the medium M1 to be ejected this time.

The second control section 190 may calculate the subtraction value. Then, when the medium M1 to be ejected this time is ejected from the recording device 111 to the medium loading device 11, the second control section 190 may notify the control section 90 of the subtraction value as the information relating to the medium M1 to be ejected this time.

The second information may include the total value obtained by adding the first lower surface recording density and the second upper surface recording density. The control section 90 may calculate the total value as the second information and adjust the threshold value based on the total value. Then, the control section 90 may determine the control parameters when the side end aligning member is made to stand by at the first position WP1 based on the total value which is the second information. Then, when the first position WP1 is specified as the standby position WP, the control section 90 may control the side end aligning member to stand by at the first position WP1 with the control parameter with which the side end aligning member is determined based on the total value. The total value is information relating to the frictional force F1 and is a factor of the frictional force F1. Since the frictional force F1 increases when the total value increases, the control section 90 may lower the threshold value when the total value is equal to or greater than a predetermined value.

The second control section 190 may calculate the total value as the second information. Then, when the medium M1 to be ejected this time is ejected from the recording device 111 to the medium loading device 11, the second control section 190 may notify the control section 90 of the total value as the information relating to the medium M1 to be ejected this time.

Regarding Control Method of Medium Aligning Operation

Figure 15:
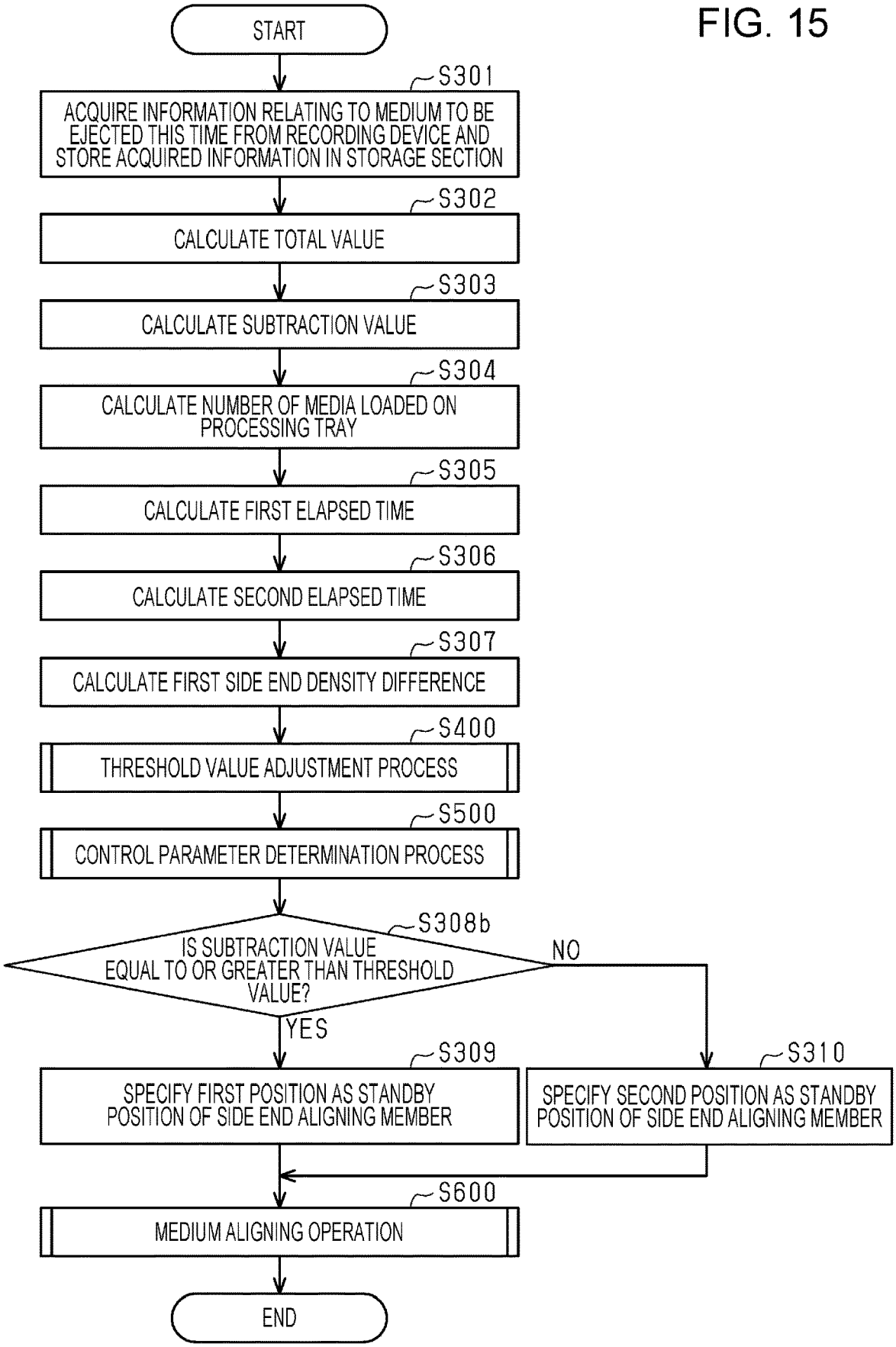
FIG. 15 is a flowchart illustrating a control method of a medium aligning operation according to a second embodiment.

As illustrated in FIG. 15, regarding the flow of the control method of the medium aligning operation, the control executed by the control section 90 in each step will be described. In addition, since this flow is substantially the same as that of the first embodiment, the same steps will be given the same reference numerals, and description of duplicate steps will be omitted.

When the control parameter determination processing subroutine ends, in step S308*b*, the control section 90 determines whether or not the subtraction value is equal to or greater than the threshold value. When the subtraction value is equal to or greater than the threshold value, step S308*a* becomes YES, and the control section 90 shifts the process to step S309.

In step S309, the control section 90 specifies the first position WP1 as the standby position WP of the side end aligning member. In addition, which of the first side end guide member 41 and the second side end guide member 42 is specified as the side end aligning member in step S509. When the subtraction value is less than the threshold value, step S308*b* becomes NO, and the control section 90 shifts the process to step S310. Then, in step S310, the control section 90 specifies the second position WP2 as the standby position WP of the side end aligning member.

The first upper surface recording density and the first lower surface recording density may be the recording density of the entire medium surface, or may be the recording density of a part of the medium surface. For example, the first upper surface recording density and the first lower surface recording density may be the recording density of the tip end part M1*a* of the medium M1 to be ejected this time. The control section 90 can estimate the curl state of the tip end part M1*a* of the medium M1 to be ejected this time.

Regarding Threshold Value Adjustment Processing Subroutine

Figure 16:
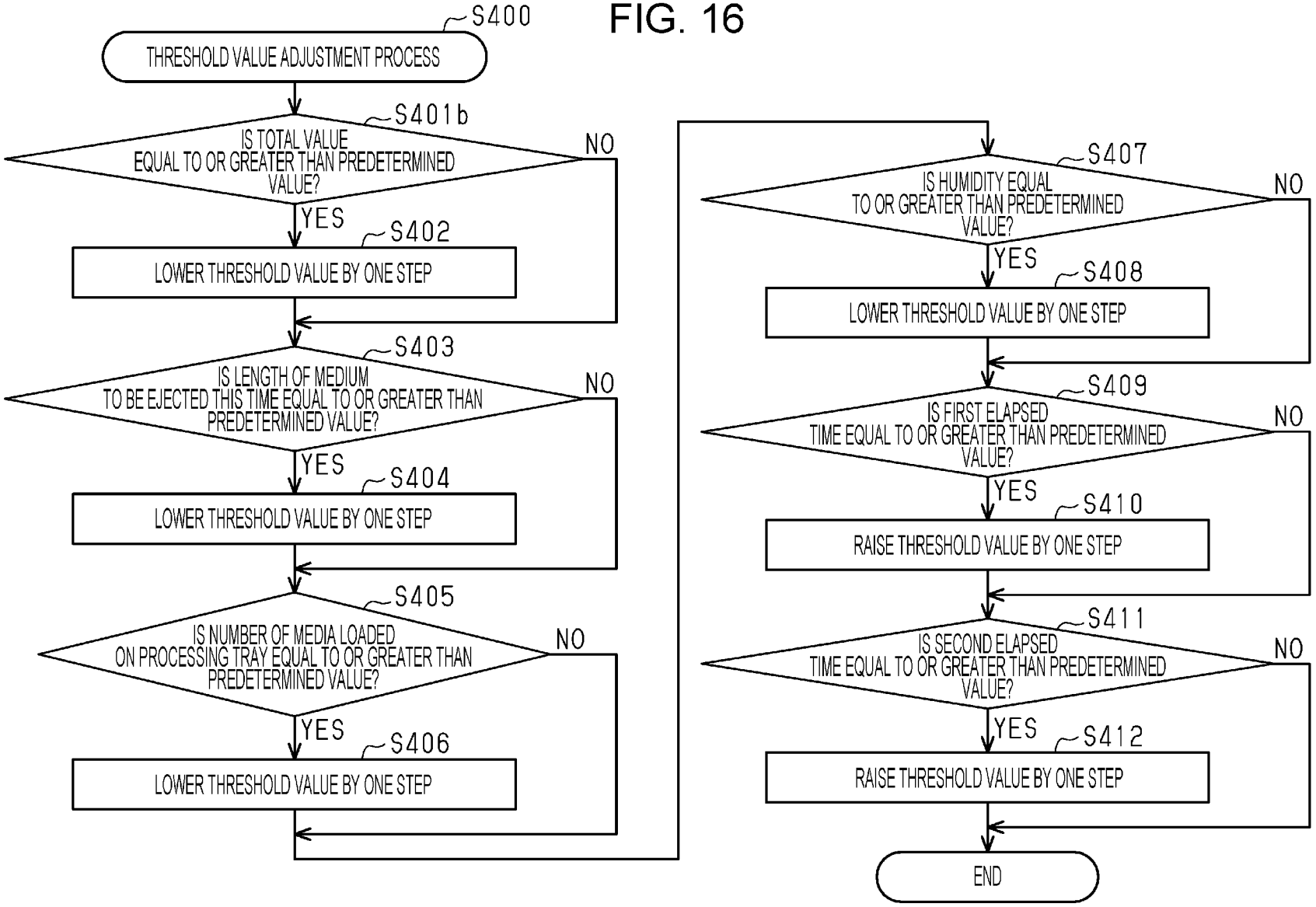
FIG. 16 is a flowchart illustrating a threshold value adjustment process according to the second embodiment.

As illustrated in FIG. 16, regarding the flow of the threshold value adjustment processing subroutine, the control executed by the control section 90 in each step will be described. In addition, since this flow is substantially the same as that of the first embodiment, the same steps will be given the same reference numerals, and description of duplicate steps will be omitted.

In step S401*b*, the control section 90 determines whether or not the total value is equal to or greater than a predetermined value. When the total value is equal to or greater than a predetermined value, step S401*b* becomes YES, and the control section 90 shifts the process to step S402. Then, in step S402, the control section 90 lowers the threshold value by one step and shifts the process to step S403. When the total value is less than a predetermined value, step S401*b* becomes NO, and the control section 90 shifts the process to step S403.

Action of Embodiment

The action of the present embodiment will be described. Since the second embodiment is almost the same as the first embodiment, duplicate description thereof will be omitted in terms of action.

In the present embodiment, under the standard recording conditions, the largest subtraction value at which buckling does not occur is set as the threshold value. The largest subtraction value at which buckling does not occur is determined experimentally, for example. In addition, the standard recording condition may be an average recording condition or the most commonly used recording condition. The method of determining the standard recording conditions is not limited.

An example of the standard recording conditions is described below. In the medium M, a vertical paper sheet having A4 size and 80 gsm is used in vertical feed. Images of standard resolution are recorded on both surfaces of the medium M, and there is no difference in recording density in the width direction X. The same image is recorded on any medium M. The temperature and humidity of the environment in which the medium M is recorded is 22 degrees and 65%. The number of media Ms loaded on the processing tray 21 when the medium M is ejected is 5. When the above-described conditions are standard recording conditions, and when the largest subtraction value at which buckling does not occur is 25, the threshold value of the subtraction value is set to 25. In other words, the threshold value before being adjusted based on the second information is 25.

An example of actual recording conditions is described below. In the medium M, a vertical paper sheet having A3 size and 80 gsm is used in vertical feed. High-resolution images are recorded on both surfaces of the medium M, and the upper surface recording density is 50% and the lower surface recording density is 35%. There is a difference in recording density in the width direction X, and the first side end density difference is 20. The same image is recorded on any medium M. The temperature and humidity of the environment in which the medium M is recorded is 22 degrees and 85%. The number of media Ms loaded on the processing tray 21 when the medium M is ejected is 20. When the above-described conditions are the actual recording conditions, the subtraction value as the value based on the first information is (subtraction value)=(first upper surface recording density)+(first lower surface recording density)=50−35=15.

The subtraction value is 15, and the threshold value of the subtraction value before being adjusted based on the second information is 25. In other words, when the threshold value of the subtraction value is not adjusted based on the second information, (subtraction value)<(threshold value). Since the total value is less than the threshold value, the second position WP2 is specified as the standby position WP when the threshold value is not adjusted based on the second information.

The threshold value is adjusted based on the second information. When the control section 90 calculates the total value obtained by adding the first lower surface recording density and the second upper surface recording density, (total value)=(first lower surface recording density)+(second upper surface recording density)=50+35=85. Assuming that the predetermined value of the total value which is the second information is 80, (total value) (predetermined value), and thus, the control section 90 lowers the threshold value by one step. When the value for one step of the threshold value is 15, (threshold value)=25−15=10.

Although the numerical values used in the description are different in the following description of the action in the second embodiment, the description thereof will be omitted because the description is the same as the description of the action in the first embodiment.

Effect of Embodiment

The effect of this embodiment will be described.

In the medium loading device 11 and the image forming system 200 of the present embodiment, the same effects as those of the (1), (2), and (4) to (11) in the first embodiment can be obtained.

(12) The second information may include the total value obtained by adding the first lower surface recording density and the second upper surface recording density. As the total value increases, the medium surfaces slide in a wetter state. In other words, as the total value increases, the slidability between the medium M1 to be ejected this time and the medium M2 ejected previously decreases, and thus, the frictional force F1 becomes large. When the total value is equal to or greater than the predetermined value, the control section 90 lowers the threshold value more than when the total value is less than the predetermined value. When the total value is less than the predetermined value, the control section 90 may raise the threshold value more than when the total value is equal to or greater than the predetermined value. When the frictional force F1 increases as the slidability of the tip end part M1*a* of the medium M1 to be ejected this time and the medium M2 ejected previously decreases, it is possible to suppress buckling of the medium M1 to be ejected this time. Further, when the slidability of the tip end part M1*a* of the medium M1 to be ejected this time and the medium M2 ejected previously does not decrease, it is possible to suppress the decrease in the productivity of the medium loading device 11.

Modification Example of Embodiment

The present embodiment can be modified and implemented as follows. The present embodiment and the following modification examples can be implemented in combination with each other within a technically consistent range.

In the first embodiment, when the medium M2 ejected previously is recorded only on the lower surface and the medium M1 to be ejected this time is also recorded only on the lower surface, the upper surface of the medium M2 ejected previously is not wet, and the lower surface of the medium M1 to be ejected this time is wet. In such a case, the first lower surface recording density may be used as the first information, and the value may be used as a value based on the first information. In other words, the control section 90 may determine whether or not the value based on the first information relating to the recording density of only the medium M1 to be ejected this time is equal to or greater than the threshold value.

In the first embodiment, when the medium M2 ejected previously is recorded only on the upper surface and the medium M1 to be ejected this time is also recorded only on the upper surface, the upper surface of the medium M2 ejected previously is wet, and the lower surface of the medium M1 to be ejected this time is not wet. In such a case, the second upper surface recording density may be used as the first information, and the value may be used as a value based on the first information. In other words, the control section 90 may determine whether or not the value based on the first information relating to the recording density of only the medium M2 ejected previously is equal to or greater than the threshold value.

The first information may be the second upper surface recording density and second lower surface recording density. In addition, the value based on the first information may be the subtraction value obtained by subtracting the second upper surface recording density from the second lower surface recording density, and may be a value based on the information relating to the recording density of the medium M2 ejected previously. The medium M1 to be ejected this time is ejected while the tip end part M1*a* of the lower surface of the medium M1 to be ejected this time rubs the upper surface of the medium M2 ejected previously. As the subtraction value increases, the tip end part of the medium M2 ejected previously curls and floats upward, and thus, the angle at which the tip end part M1*a* of the lower surface of the medium M1 to be ejected this time comes into contact with the upper surface of the medium M2 ejected previously becomes an obtuse angle. Accordingly, the frictional force F1 increases, and thus, the medium M1 to be ejected this time is likely to buckle. The subtraction value obtained by subtracting the second upper surface recording density from the second lower surface recording density as the value based on the first information is the information relating to the frictional force F1 and is a factor of the frictional force F1. Therefore, the subtraction value obtained by subtracting the second upper surface recording density from the second lower surface recording density may be used for controlling the medium aligning operation as a factor of the ease of buckling in the medium M1 to be ejected this time.

The first information may be the first upper surface recording density, the first lower surface recording density, the second upper surface recording density, and the second lower surface recording density. In addition, the values based on the first information may be a value that substitutes the frictional force F1 calculated based on the four states, such as a water containing state of the lower surface of the medium M1 to be ejected this time, the water containing state of the upper surface of the medium M1 to be ejected this time, the curl state of the medium M1 to be ejected this time, and the curl state of the medium M2 ejected previously. Technical Ideas Grasped from Embodiments and Modification Examples and Action Effects Hereinafter, the technical idea grasped from the embodiment and the modification examples described above and the action effects thereof will be described.

(A) There is provided a medium loading device including: an ejecting section that performs recording by discharging a liquid, and repeats ejection of a medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

According to this configuration, the threshold value is adjusted based on the second information relating to at least one medium among the media recorded before the ejection at this time. When the value based on the first information relating to the recording density of at least one medium among the medium to be ejected this time and the medium ejected previously is equal to or greater than the threshold value, the first position that overlaps the medium to be ejected this time in the width direction is specified as the standby position. When the value based on the first information is less than the threshold value, the second position that does not overlap the medium to be ejected this time in the width direction is specified as the standby position. By adjusting the threshold value based on the second information, the first position is more likely to be specified as the standby position when buckling of the medium is more likely to occur than in a case where the threshold value is not adjusted. Further, when buckling of the medium is unlikely to occur, it is unlikely to specify the first position as the standby position. In other words, buckling of the medium can be suppressed even when the slidability of the medium is lower than expected from the recording density. In addition, when the slidability of the medium is not as low as expected from the recording density, it is possible to suppress the decrease in productivity of the medium loading device. In other words, as compared with a case where the control section controls the side end aligning member only with the first information relating to the recording density of at least one medium among the medium to be ejected this time and the medium ejected previously, it is possible to improve the productivity of the medium loading device while suppressing buckling of the medium.

(B) There is provided a medium loading device including: an ejecting section that performs recording by discharging a liquid, and repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section determines a control parameter for controlling at least one of a position of the first position in the width direction and a time during which the side end aligning member stands by at the first position, based on second information relating to at least one of the media recorded before the ejection at this time, and controls the side end aligning member with the control parameter determined based on the second information.

According to this configuration, the control parameter is determined based on the second information relating to at least one medium among the media recorded before the ejection at this time. Whether the standby position is set to the first position or the second position is specified based on the first information relating to the recording density among the information relating to the medium. Further, the movement of the side end aligning member when the first position is specified as the standby position is controlled based on the control parameter determined based on the second information which is the information other than the first information among the information relating to the medium. More specifically, position of the first position in the width direction and the time for the side end aligning member to stand by at the first position are changed within a range in which the influence on buckling or the influence on productivity is small. Therefore, the movement required for the movement of the side end aligning member when the first position is specified as the standby position increases or becomes larger. In addition, unnecessary movement in the movement of the side end aligning member when the first position is specified as the standby position is eliminated or decreases. In other words, buckling of the medium can be suppressed even when the slidability of the medium is lower than expected from the recording density. In addition, when the slidability of the medium is not as low as expected from the recording density, it is possible to suppress the decrease in productivity of the medium loading device. In other words, as compared with a case where the control section controls the side end aligning member only with the first information relating to the recording density of at least one medium among the medium to be ejected this time and the medium ejected previously, it is possible to improve the productivity of the medium loading device while suppressing buckling of the medium.

(C) In the medium loading device, the value based on the first information may be a total value obtained by adding first lower surface recording density which is recording density on a lower surface of the medium to be ejected this time and second upper surface recording density which is recording density on an upper surface of the medium ejected previously.

According to this configuration, as the total value increases, the medium surfaces slide together in a wet state, and as the total value decreases, the medium surfaces slide in a dry state. In other words, as the total value increases, the slidability between the medium to be ejected this time and the medium ejected previously decreases, and thus, the frictional force becomes large and buckling becomes easy. In addition, as the total value decreases, the slidability between the medium to be ejected this time and the medium ejected previously does not decrease, and thus, the frictional force becomes small and buckling becomes difficult. Since the total value is a factor of the ease of buckling in the medium to be ejected this time, buckling of the medium to be ejected this time is suppressed by using the total value as a value based on the first information for controlling the medium aligning operation.

(D) In the medium loading device, the second information may include a subtraction value obtained by subtracting the first lower surface recording density from first upper surface recording density which is recording density on the upper surface of the medium to be ejected this time, and when the subtraction value is equal to or greater than a predetermined value, the control section may lower the threshold value as compared with a case where the subtraction value is less than the predetermined value.

According to the configuration, as the subtraction value increases, the tip end part of the medium to be ejected this time due to the difference in moisture content between the upper surface and the lower surface of the medium curls downward. In other words, as the subtraction value increases, the angle at which the tip end part of the medium to be ejected this time comes into contact with the medium ejected previously becomes an obtuse angle, and thus, the lower surface of the medium to be ejected this time and the upper surface of the medium ejected previously come into strong contact with each other. Accordingly, the frictional force increases, and thus, the slidability decreases. When the subtraction value is equal to or greater than the predetermined value, the control section lowers the threshold value more than when the subtraction value is less than the predetermined value. When the frictional force increases as the angle when the tip end part of the medium to be ejected this time comes into contact with the medium ejected previously becomes an obtuse angle, it is possible to suppress buckling of the medium to be ejected this time.

(E) In the medium loading device, the value based on the first information may be a subtraction value obtained by subtracting first lower surface recording density which is recording density on a lower surface of the medium to be ejected this time from first upper surface recording density which is recording density on an upper surface of the medium to be ejected this time.

According to the configuration, as the subtraction value increases, the tip end part of the medium to be ejected this time due to the difference in moisture content between the upper surface and the lower surface of the medium curls downward. In other words, as the subtraction value increases, the angle at which the tip end part of the medium to be ejected this time comes into contact with the medium ejected previously becomes an obtuse angle, and thus, the lower surface of the medium to be ejected this time and the upper surface of the medium ejected previously come into strong contact with each other. Then, since the frictional force becomes large, buckling becomes easy. In addition, as the subtraction value decreases, the tip end part of the medium to be ejected this time due to the difference in moisture content between the upper surface and the lower surface of the medium curls upward. In other words, as the subtraction value decreases, the angle at which the tip end part of the medium to be ejected this time comes into contact with the medium ejected previously becomes an acute angle, and thus, the lower surface of the medium to be ejected this time and the upper surface of the medium ejected previously come into weak contact with each other. Accordingly, the frictional force becomes smaller, and thus, the buckling becomes difficult. Since the subtraction value is a factor of the ease of buckling in the medium to be ejected this time, buckling of the medium to be ejected this time is suppressed by using the subtraction value as a value based on the first information for controlling the medium aligning operation.

(F) In the medium loading device, the second information may include a total value obtained by adding the first lower surface recording density and second upper surface recording density which is recording density on an upper surface of the medium ejected previously, and when the total value is equal to or greater than a predetermined value, the control section may lower the threshold value as compared with a case where the total value is less than the predetermined value.

According to the configuration, as the total value increases, the medium surfaces slide in a wetter state. In other words, as the total value increases, the slidability between the medium to be ejected this time and the medium ejected previously decreases, and thus, the frictional force becomes large. When the total value is equal to or greater than the predetermined value, the control section lowers the threshold value more than when the total value is less than the predetermined value. When the frictional force increases as the slidability of the medium to be ejected this time and the medium ejected previously decreases, it is possible to suppress buckling of the medium to be ejected this time.

(G) In the medium loading device, the second information may include at least one of a size of the medium to be ejected this time, a basis weight of the medium to be ejected this time, and a type of the medium to be ejected this time.

According to the configuration, depending on the size of the medium to be ejected this time, the basis weight of the medium to be ejected this time, and the type of the medium to be ejected this time, the drag force that resists against buckling in the medium to be ejected this time changes. In other words, depending on the size of the medium to be ejected this time, the basis weight of the medium to be ejected this time, and the type of the medium to be ejected this time, there is a case where there is a large discrepancy between the drag force in the standard medium and the drag force in the medium to be ejected this time. The control section may adjust the threshold value based on at least one of the size of the medium to be ejected this time, the basis weight of the medium to be ejected this time, and the type of the medium to be ejected this time. The control section may determine the control parameter when the side end aligning member stands by at the first position based on at least one of the size of the medium to be ejected this time, the basis weight of the medium to be ejected this time, and the type of the medium to be ejected this time. Then, when the first position is specified as the standby position, the control section may control the side end aligning member to stand by at the first position with the control parameter. Accordingly, when the drag force is small, it is possible to suppress buckling of the medium to be ejected this time. Further, when the drag force in the medium to be ejected this time is sufficiently greater than the frictional force, it is possible to suppress the decrease in the productivity of the medium loading device.

(H) In the medium loading device, the second information may include at least one of a temperature and a humidity of an environment in which the medium to be ejected this time is recorded.

According to the configuration, when the humidity of the environment in which the medium to be ejected this time is recorded is high, it takes time for the medium surface to dry, and when the humidity of the environment in which the medium to be ejected this time is recorded is low, it does not take time for the medium surface to dry. Further, when the temperature of the environment in which the medium to be ejected this time is recorded is low, improvement in the water containing state due to the drying process is not observed, and it takes time for the medium surface to dry. When the temperature of the environment in which the medium to be ejected this time is recorded is high, it does not take time for the medium surface to dry. The control section may adjust the threshold value based on at least one of the temperature and humidity of the environment in which the medium to be ejected this time is recorded. The control section may determine the control parameter when the side end aligning member stands by at the first position based on at least one of the temperature and the humidity of the environment in which the medium to be ejected this time is recorded. Then, when the first position is specified as the standby position, the control section may control the side end aligning member to stand by at the first position with the control parameter. Accordingly, when the medium to be ejected this time and the medium ejected previously are not dried, it is possible to suppress buckling of the medium to be ejected this time. Further, when the medium to be ejected this time and the medium ejected previously are dried and the water content is sufficiently small, it is possible to suppress the decrease in the productivity of the medium loading device.

(I) In the medium loading device, the second information may include the number of the media loaded on the processing tray when the medium to be ejected this time is ejected.

According to the configuration, when the number of media loaded on the processing tray is large, the distance between the upper surface of the medium ejected previously and the lower surface of the medium to be ejected this time is short, and the frictional force is large. In addition, when the number of media loaded on the processing tray is small, the distance between the upper surface of the medium ejected previously and the lower surface of the medium to be ejected this time is far, and the frictional force is small. The control section may adjust the threshold value based on the number of media loaded on the processing tray when the medium to be ejected this time is ejected. The control section may determine the control parameter when the side end aligning member stands by at the first position based on the number of media loaded on the processing tray when the medium to be ejected this time is ejected. Then, when the first position is specified as the standby position, the control section may control the side end aligning member to stand by at the first position with the control parameter. Accordingly, when the frictional force increases as the number of media loaded on the processing tray increases, it is possible to suppress buckling of the medium to be ejected this time. Further, when the frictional force decreases as the number of media loaded on the processing tray decreases, it is possible to suppress the decrease in the productivity of the medium loading device.

(J) In the medium loading device, the second information may include a first elapsed time from recording of the medium to be ejected this time to ejection of the medium to be ejected this time.

According to the configuration, when the first elapsed time is short, the medium surface of the medium to be ejected this time was not dried. When the first elapsed time is long, the medium surface of the medium to be ejected this time is dried. The control section may adjust the threshold value based on the first elapsed time. The control section may determine the control parameters when the side end aligning member is made to stand by at the first position based on the first elapsed time. Then, when the first position is specified as the standby position, the control section may control the side end aligning member to stand by at the first position with the control parameter. Accordingly, when the medium to be ejected this time is not dried, it is possible to suppress buckling of the medium to be ejected this time. Further, when the medium to be ejected this time is dried and the water content is sufficiently small, it is possible to suppress the decrease in the productivity of the medium loading device.

(K) In the medium loading device, the second information may include a second elapsed time from recording of the medium ejected previously to ejection of the medium to be ejected this time.

According to the configuration, when the second elapsed time is short, the medium surface of the medium ejected previously was not dried. When the second elapsed time is long, the medium surface of the medium ejected previously is dried. The control section may adjust the threshold value based on the second elapsed time. The control section may determine the control parameters when the side end aligning member is made to stand by at the first position based on the second elapsed time. Then, when the first position is specified as the standby position, the control section may control the side end aligning member to stand by at the first position with the control parameter. Accordingly, when the medium to be ejected this time is not dried, it is possible to suppress buckling of the medium to be ejected this time. Further, when the medium to be ejected this time is dried and the water content is sufficiently small, it is possible to suppress the decrease in the productivity of the medium loading device.

(L) In the medium loading device, a distance in the width direction between an aligning surface of the side end aligning member at the first position and an assumed side end of the medium when the medium to be ejected this time is ejected from the ejecting section may be defined by an overlapping amount, and the control section may determine the overlapping amount based on the second information relating to at least one medium among the media recorded before the ejection at this time, and control the side end aligning member by the overlapping amount determined based on the second information.

According to the configuration, when the overlapping amount is large, the contact between the medium to be ejected this time and the medium ejected previously can be further suppressed. In other words, the control section determines the overlapping amount based on the second information and controls the side end aligning member with the overlapping amount when the first position is specified as the standby position, and accordingly, it is possible to further suppress buckling of the medium to be ejected this time. In addition, when the overlapping amount is reduced, the moving distance to the second position decreases even when the timing at which the side end aligning member is separated from the first position and starts moving toward the second position is the same. Therefore, after the rear end of the medium to be ejected this time is ejected from the ejecting section, it is possible to shorten the time until the first side end of the medium to be ejected this time is aligned with the first side end of the medium loaded on the processing tray. In other words, the control section determines the overlapping amount based on the second information and controls the side end aligning member with the overlapping amount when the first position is specified as the standby position, and accordingly, it is possible to suppress the decrease in the productivity of the medium loading device.

(M) In the medium loading device, when the side end aligning member moves to the first position when the medium to be ejected this time is ejected, after the side end aligning member moves toward the second position away from the first position, the side end aligning member may align the side end of the medium to be ejected this time with the side end of the medium loaded on the processing tray, and the control section may determine a timing at which the side end aligning member moves from the first position based on the second information relating to at least one medium among the media recorded before the ejection at this time, and control the side end aligning member at the timing determined based on the second information.

According to the configuration, when this timing is advanced, the side end aligning operation can be started at the same time when the rear end of the medium to be ejected this time is ejected from the ejecting section. In other words, the control section determines the timing based on the second information and controls the side end aligning member with the timing when the first position is specified as the standby position, and accordingly, it is possible to further suppress the decrease in the productivity of the medium loading device. When this timing is delayed, the contact between the medium to be ejected this time and the medium ejected previously can be suppressed until the rear end of the medium to be ejected this time is ejected from the ejecting section. In other words, the control section determines the timing based on the second information and controls the side end aligning member with the timing when the first position is specified as the standby position, and accordingly, it is possible to further suppress buckling of the medium to be ejected this time.

(N) In the above-described medium loading device, a first side end guide member disposed below one side in the width direction of the medium to be ejected this time and moving in the width direction; and a second side end guide member which is disposed below the other side in the width direction of the medium to be ejected this time and moves in the width direction may be provided, the first side end guide member may be positioned as the side end aligning member at the standby position when the medium to be ejected this time is ejected, and then may be configured to align the first side end on one side of the medium with the first side end of one side of the medium loaded on the processing tray, the second side end guide member may be positioned as the side end aligning member at the standby position when the medium to be ejected this time is ejected, and then may be configured to align the second side end on the other side of the medium with the second side end of the other side of the medium loaded on the processing tray, the second information may include at least one of the first lower surface width direction recording density distribution which is the recording density distribution in the width direction of the lower surface of the medium to be ejected this time, and the second upper surface width direction recording density distribution which is the recording density distribution in the width direction of the upper surface of the medium ejected previously, the control section may specify either the first side end guide member or the second side end guide member as the side end aligning member, and the control section may determine the selection for specifying either the first side end guide member or the second side end guide member based on the second information relating to at least one medium among the media recorded before the ejection at this time, and may control the side end aligning member by the selection determined based on the second information.

According to the configuration, on the lower surface of the medium to be ejected this time, according to the first lower surface width direction recording density distribution, which is the second information, the control section can determine which the frictional force is greater among the frictional force of the medium surface on the first side end side and the frictional force of the medium surface on the second side end side. In addition, on the upper surface of the medium to be ejected this time, according to the first upper surface width direction recording density distribution, which is the second information, the control section can determine which the frictional force is greater among the frictional force of the medium surface on the first side end side and the frictional force of the medium surface on the second side end side. In addition, the control section specifies the side end guide member on the side where the frictional force is large as the side end aligning member, and controls the side end guide member on the side where the frictional force is large as the side end aligning member. Accordingly, the contact with the medium surface on the side end side having a large frictional force is suppressed, and thus, buckling of the medium to be ejected this time can be suppressed more effectively. In addition, when the deviation of the recording density is small, that is, when the frictional force is close to equal, the control section properly uses the first side end guide member as the side end aligning member and the second side end guide member as the side end aligning member according to the situation, and accordingly, it is possible to improve the productivity of the medium loading device.

(O) There is provided an image forming system including: a recording section that performs recording by discharging a liquid on a medium; an ejecting section that repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

According to this configuration, the same action effects as those in (A) can be obtained in the image forming system.

(P) There is provided an image forming system including: a recording section that performs recording by discharging a liquid on a medium; an ejecting section that repeats ejection of the medium recorded by the recording section; a processing tray for loading the media in order of being ejected by the ejecting section; a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, in which, when a value based on first information relating to recording density of at least one medium of the medium to be ejected this time and the medium ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section determines a control parameter for controlling at least one of a position of the first position in the width direction and a time during which the side end aligning member stands by at the first position, based on second information relating to at least one of the media recorded before the ejection at this time, and controls the side end aligning member with the control parameter determined based on the second information.

According to this configuration, the same action effects as those in (B) can be obtained in the image forming system.

What is claimed is:

1. A medium loading device comprising:

an ejecting section that ejects a recorded medium by discharging a liquid;

a processing tray for loading the medium ejected by the ejecting section;

a side end aligning member that aligns a side end of the medium; and a control section that controls the side end aligning member, wherein the side end aligning member is positioned at a standby position when the medium is ejected from the ejecting section, when a value based on first information relating to recording density of at least one medium of the medium to be ejected this time and the medium ejected previously is equal to or greater than a threshold value, the control section specifies a first position, which overlaps the medium to be ejected this time in a width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

2. The medium loading device according to claim 1, wherein the value based on the first information is a total value obtained by adding first lower surface recording density which is recording density on a lower surface of the medium to be ejected this time and second upper surface recording density which is recording density on an upper surface of the medium ejected previously.

3. The medium loading device according to claim 2, wherein the second information includes a subtraction value obtained by subtracting the first lower surface recording density from first upper surface recording density which is recording density on the upper surface of the medium to be ejected this time, and when the subtraction value is equal to or greater than a predetermined value, the control section lowers the threshold value as compared with a case where the subtraction value is less than the predetermined value.

4. The medium loading device according to claim 1, wherein the value based on the first information is a subtraction value obtained by subtracting first lower surface recording density which is recording density on a lower surface of the medium to be ejected this time from first upper surface recording density which is recording density on an upper surface of the medium to be ejected this time.

5. The medium loading device according to claim 4, wherein the second information includes a total value obtained by adding the first lower surface recording density and second upper surface recording density which is recording density on an upper surface of the medium ejected previously, and when the total value is equal to or greater than a predetermined value, the control section lowers the threshold value as compared with a case where the total value is less than the predetermined value.

6. The medium loading device according to claim 1, wherein the second information includes at least one of a size of the medium to be ejected this time, a basis weight of the medium to be ejected this time, and a type of the medium to be ejected this time.

7. The medium loading device according to claim 1, wherein the second information includes at least one of a temperature and a humidity of an environment in which the medium to be ejected this time is recorded.

8. The medium loading device according to claim 1, wherein the second information includes the number of the media loaded on the processing tray when the medium to be ejected this time is ejected.

9. The medium loading device according to claim 1, wherein the second information includes a first elapsed time from recording of the medium to be ejected this time to ejection of the medium to be ejected this time.

10. The medium loading device according to claim 1, wherein the second information includes a second elapsed time from recording of the medium ejected previously to ejection of the medium to be ejected this time.

11. The medium loading device according to claim 1, wherein a distance in the width direction between an aligning surface of the side end aligning member at the first position and an assumed side end of the medium when the medium to be ejected this time is ejected from the ejecting section is defined by an overlapping amount, and the control section determines the overlapping amount based on the second information relating to at least one medium among the media recorded before the ejection at this time, and controls the side end aligning member by the overlapping amount determined based on the second information.

12. The medium loading device according to claim 1, wherein when the side end aligning member moves to the first position when the medium to be ejected this time is ejected, after the side end aligning member moves from the first position to the second position, the side end aligning member aligns the side end of the medium to be ejected this time with the side end of the medium loaded on the processing tray, and the control section determines a timing at which the side end aligning member moves from the first position based on the second information relating to at least one medium among the media recorded before the ejection at this time, and controls the side end aligning member at the timing determined based on the second information.

13. An image forming system comprising:

a recording section that performs recording by discharging a liquid on a medium;

an ejecting section that repeats ejection of the medium recorded by the recording section;

a processing tray for loading the media in order of being ejected by the ejecting section;

a side end aligning member that is disposed below the medium to be ejected this time, is positioned at a standby position when the medium is ejected, then moves in a width direction orthogonal to an ejecting direction of the medium, and aligns a side end of the medium with a side end of the medium loaded on the processing tray; and a control section that controls the side end aligning member, wherein when a value based on first information relating to recording density of at least one medium of the medium to be ejected this time and the media ejected previously is equal to or greater than a threshold value, the control section specifies a first position, which overlaps the medium to be ejected this time in the width direction, as the standby position, and when the value based on the first information is less than the threshold value, the control section specifies a second position, which does not overlap the medium to be ejected this time in the width direction, as the standby position, and the control section adjusts the threshold value based on second information relating to at least one medium among the media recorded before the ejection at this time.

* * * * *